US010163376B2

(12) United States Patent
Richardson

(10) Patent No.: US 10,163,376 B2
(45) Date of Patent: Dec. 25, 2018

(54) DISPLAY ASSEMBLY

(71) Applicant: Ronald Douglas Richardson, Chilliwack (CA)

(72) Inventor: Ronald Douglas Richardson, Chilliwack (CA)

( * ) Notice: Subject to any disclaimer, the term of this patent is extended or adjusted under 35 U.S.C. 154(b) by 0 days.

(21) Appl. No.: 15/797,298

(22) Filed: Oct. 30, 2017

(65) Prior Publication Data

US 2018/0122276 A1 May 3, 2018

Related U.S. Application Data

(60) Provisional application No. 62/415,282, filed on Oct. 31, 2016.

(51) Int. Cl.

| | |
|---|---|
| ***G09F 9/46*** | (2006.01) |
| ***G09F 15/00*** | (2006.01) |
| ***G09F 7/08*** | (2006.01) |

(52) U.S. Cl.

CPC ..... *G09F 9/46* (2013.01); *G09F 7/08* (2013.01); *G09F 15/0056* (2013.01)

(58) Field of Classification Search

CPC ..... G09F 1/10; G09F 1/08; G09F 9/46; G09F 7/08; G09F 15/0056

See application file for complete search history.

(56) References Cited

U.S. PATENT DOCUMENTS

| | | | | |
|---|---|---|---|---|
| 636,319 | A | 11/1899 | Camp | |
| 772,343 | A * | 10/1904 | Diehl | A63H 33/04 40/539 |
| 3,824,712 | A | 7/1974 | Powell | |
| 4,123,862 | A | 11/1978 | Dyer et al. | |
| 4,777,067 | A | 10/1988 | Woronow et al. | |
| 5,157,852 | A * | 10/1992 | Patrou | G09F 1/08 40/124.16 |
| 6,187,415 | B1 | 2/2001 | Gaa | |
| 6,871,433 | B2 * | 3/2005 | Anza' | G09F 1/10 40/124.08 |
| 7,490,425 | B2 | 2/2009 | Crowell et al. | |
| 2010/0229442 | A1 | 9/2010 | Snow et al. | |

FOREIGN PATENT DOCUMENTS

| | | |
|---|---|---|
| FR | 1128129 | 2/1957 |
| FR | 2801840 | 6/2001 |
| GB | 598336 | 2/1948 |
| GB | 1431439 | 4/1976 |

* cited by examiner

*Primary Examiner* — Cassandra Davis
(74) *Attorney, Agent, or Firm* — Cameron IP

(57) ABSTRACT

There is provided a display assembly. The assembly includes an elongate mounting member. The mounting member has a top, a bottom spaced-apart from the top, and a plurality of spaced-apart grooves extending from the top to the bottom thereof. The assembly includes a plurality of planar members. Each of the planar member includes image indicia thereon. The planar members are shaped to fit within respective ones of the grooves, whereby the image indicia so arranged conveys a three-dimensional effect.

24 Claims, 94 Drawing Sheets

DISPLAY ASSEMBLY

BACKGROUND OF THE INVENTION

Field of the Invention

There is provided a display assembly. In particular, there is provided a display assembly comprising a plurality of planar members having two-dimensional image indicia thereon, with the planar members being arranged to convey a three-dimensional effect.

BRIEF SUMMARY OF INVENTION

There is provided, and it is an object to provide, an improved display assembly.

According to a first aspect, there is provided a display assembly. The assembly includes an elongate mounting member. The mounting member has a top, a bottom spaced-apart from the top, and a plurality of spaced-apart grooves extending from the top to the bottom thereof. The assembly includes a plurality of planar members. Each of the planar member includes image indicia thereon. The planar members are shaped to fit within respective ones of the grooves, whereby the image indicia so arranged conveys a three-dimensional effect.

According to a second aspect, there is provided a display assembly. The assembly includes a pair of elongate mounting members. Each elongate mounting member has a top, a bottom spaced-apart from the top, and a plurality of spaced-apart grooves extending from the top to the bottom thereof. The assembly includes a plurality of upright planar members. Each upright planar member includes image indicia thereon. The upright planar members are shaped to fit within respective ones of said grooves. The assembly includes a front mounting member extending between the elongate mounting members. The front mounting member is shaped to fit within a forward pair of the grooves. The front mounting member angle forward relative to the upright planar members.

According a third aspect, there is provided a display assembly having a front and a rear spaced-apart from the front. The assembly includes a pair of elongate mounting members. Each of the mounting members has a top, a bottom spaced-apart from the top, a front, and a rear opposite the front. Each of the mounting members has a centrally positioned recessed region between the front and the rear thereof. The recessed region extends from the bottom towards the top of its mounting member. Each of the mounting members includes a plurality of longitudinally spaced-apart protrusions. The protrusions are obround in side profile. Each of the protrusions extends from the top of its respective ones of the mounting members towards the bottom of its respective ones of the mounting members. Each of the mounting members has a plurality of spaced-apart grooves extending from the top to the bottom thereof. The grooves are centrally located within respective ones of the protrusions. The assembly further includes a rear planar member aligned with the rear of the assembly, at least one intermediate planar member, and a front planar member aligned with the front of the assembly. Each of the planar members include image indicia thereon. The image indicia of the front planar member is centrally located, the planar members being shaped to fit within respective ones of said grooves, the image indicia so arranged conveys a three-dimensional effect thereby.

According to fourth aspect, there is provided a display assembly. The assembly has a front and a rear spaced-apart from the front. The assembly includes a set of elongate mounting members. Each of the mounting members has a top, a bottom spaced-apart from the top, a front and a rear opposite the front. Each of the mounting members has a plurality of evenly spaced-apart grooves extending from the top to the bottom thereof and a distance of separation between respective ones of the grooves. Each of the elongate members has a different said distance of separation between its grooves. The assembly includes a plurality of planar members each of which including image indicia thereon. The planar members are shaped to fit within respective ones of the grooves of a given one of the mounting members. The image indicia so arranged conveys a three-dimensional effect thereby. Substitution of one of the mounting members for another of the mounting members enables the degree of the three-dimensional effect to be adjusted.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
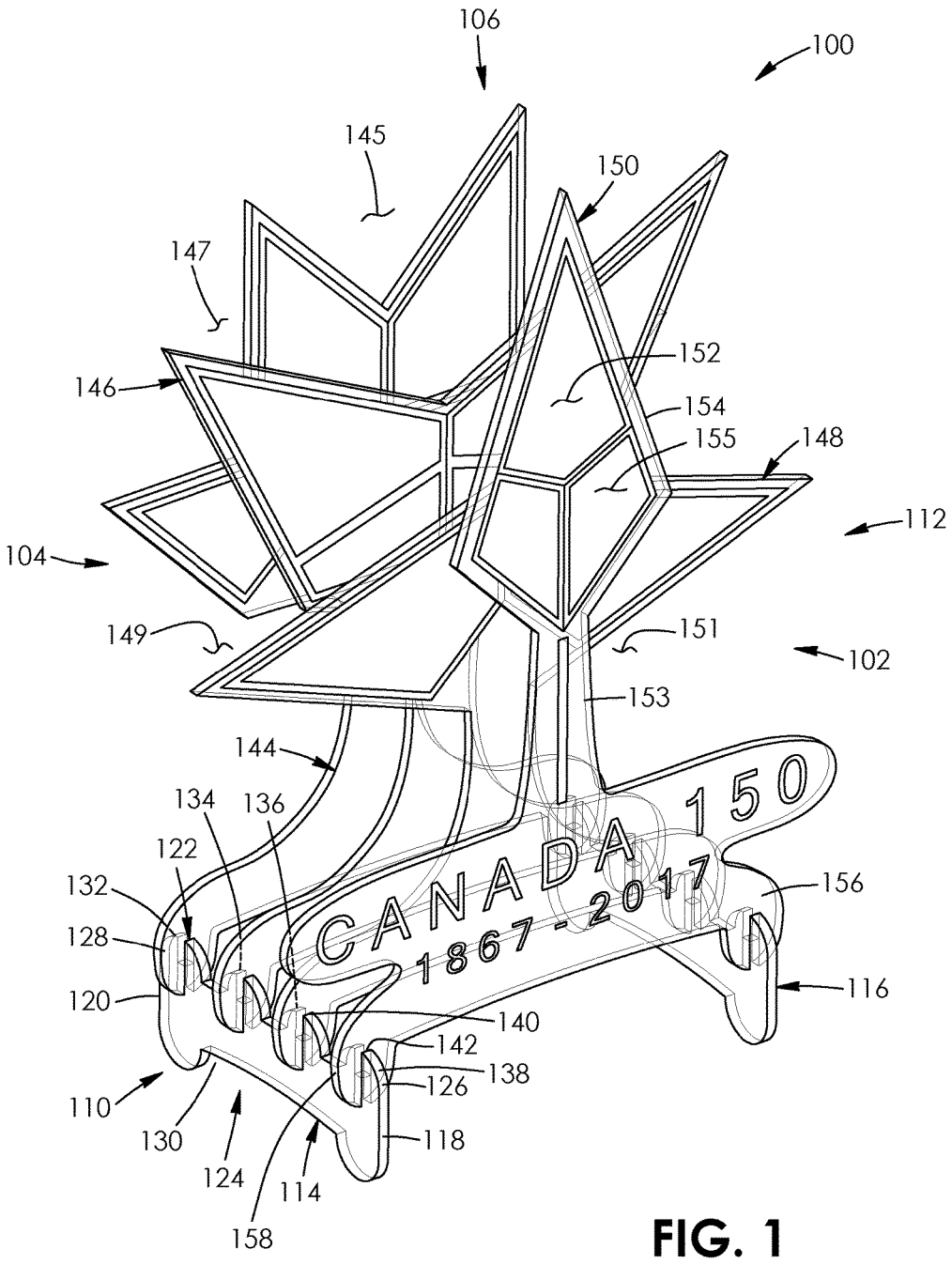
FIG. 1 is a front, left side perspective view of a display assembly according to a first aspect, the display assembly including a pair of mounting members, a rear planar member, a pair of intermediate planar members and a front planar member.

Referring to the drawings and first to FIG. 1, there is shown a display assembly 100. The assembly is shaped to be a tabletop decor novelty item that inhibits dust accumulation by virtue of minimal horizontal surfaces on the item.

The assembly has a front 102, a rear 104 spaced-apart from the front, a top 106, a bottom 108 spaced-apart from the top and a pair of spaced-apart sides 110 and 112. The front and rear of the assembly extend between the sides and top and bottom of the assembly 100.

The assembly includes a pair of elongate mounting members 114 and 116 in this example. The mounting members are cut out from clear acrylic sheet, in this example. However, this is not strictly required and the mounting members may be made of other materials and have other thicknesses in other examples. The mounting members are cut to shape via a flat-bed laser cutter, in this example. The laser cutters per se are well known to those skilled in the art and thus will not be described in detail. A Trotec™ Speedy 300 Laser Cutter may be used to this end, for example, which may be purchased at Trotec Laser GmbH, having an address of Freilingerstr. 99, 4614 Marchtrenk, Austria.

Each mounting member has a front 118 aligned with the front 102 of the assembly, a rear 120 aligned with the rear 104 of the assembly, a top 122 and a bottom 124 spaced-apart from the top. Each of the mounting members is planar and transparent in this example. Each of the mounting members is substantially the same in shape, parts and function and thus only mounting member 114 will be discussed in detail.

Each mounting member 114 includes a front portion 126 adjacent to the front 102 of the assembly 100 and a rear portion 128 adjacent to the rear 104 of the assembly. The front and rear portions of the mounting members are obround in side profile in this example.

Figure 9:
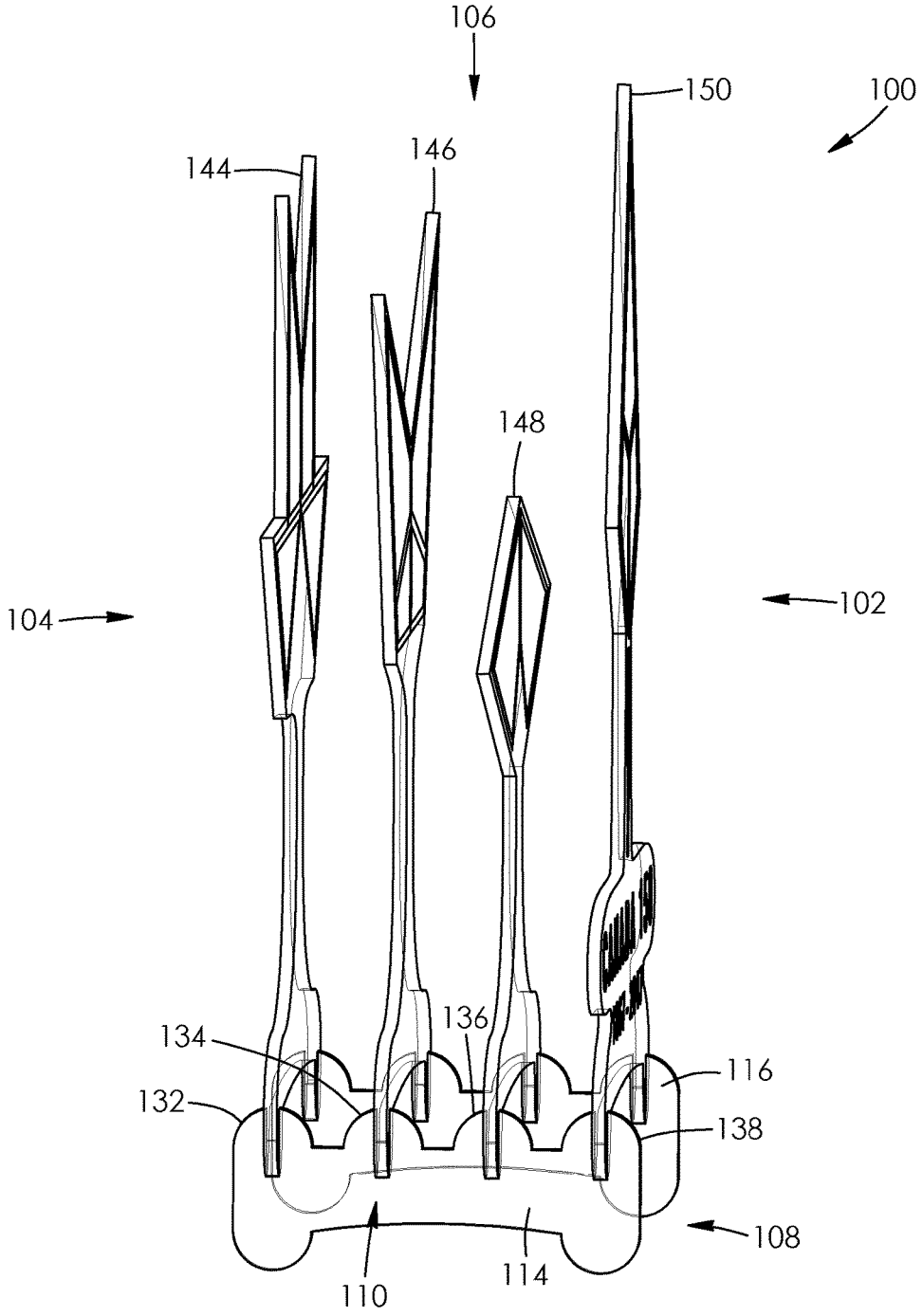
FIG. 9 is a left side elevation view thereof.

Each mounting member 114 in this example has an elongate recessed region 130 extending from its bottom 124 towards the top 122 thereof. The recessed region extends between the front portion 126 and the rear portion 128 of the mounting member. As seen in FIG. 9, each mounting member 114 is generally an inverted u-shape in side profile in this example delineated by the front and rear portions and the elongate recessed region thereof.

Each mounting member 114 includes a plurality of longitudinally spaced-apart, upwardly-extending protrusions, in this example protrusions 132, 134, 136 and 138. Referring to FIG. 1, protrusion 132 is an upper part of the rear portion 128 of the mounting member and protrusion 138 is an upper part of the front portion 126 of the mounting member in this example. Protrusions 134 and 136 may be referred to as intermediate portions of the mounting member. Each of the protrusions 132, 134, 136 and 138 extends from the top 122 of its mounting member 114 towards the bottom 124 of its mounting member. The tops of the protrusions are semi-circular in side profile in this example.

Figure 10:
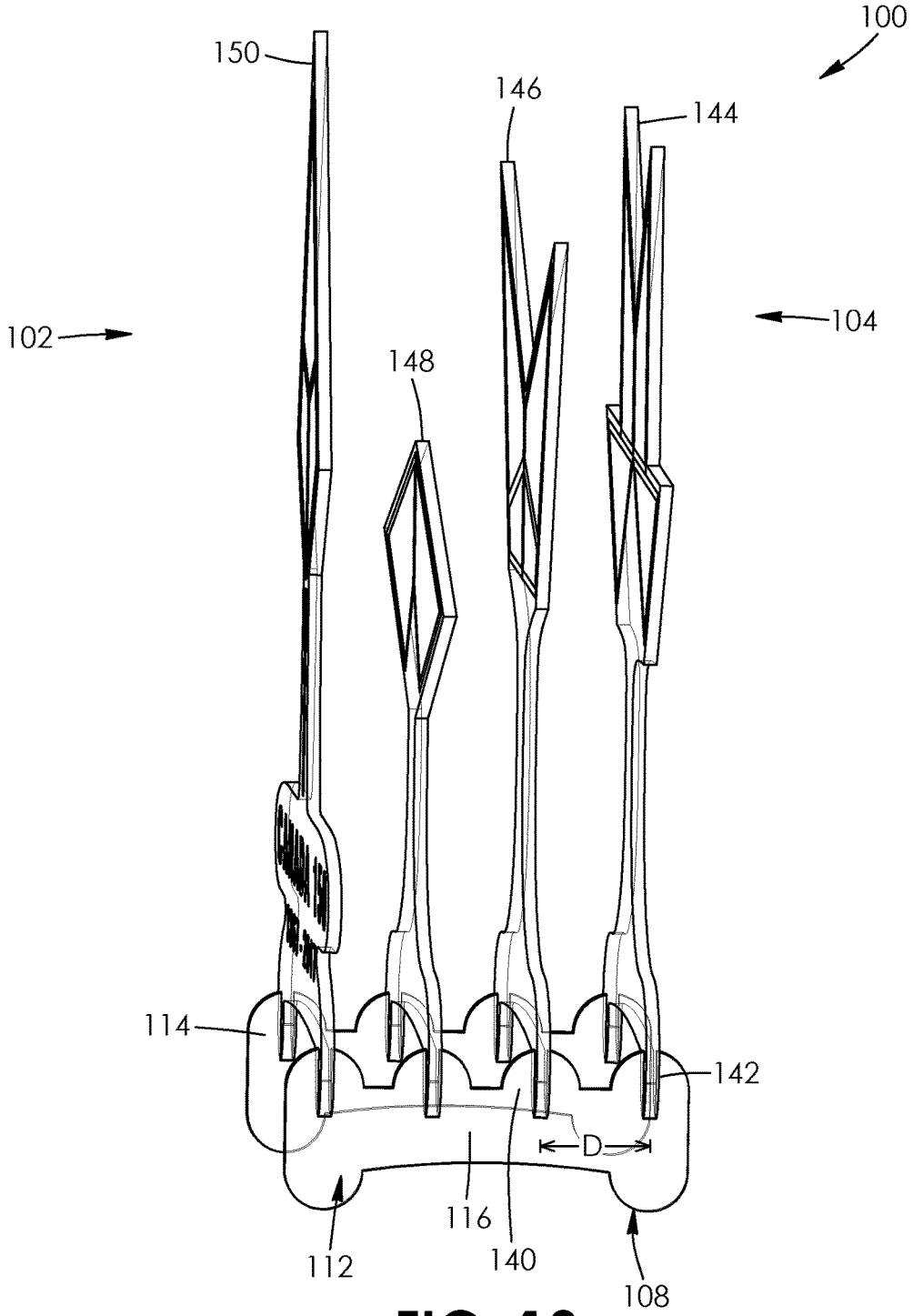
FIG. 10 is a right side elevation view thereof.
Figure 11:
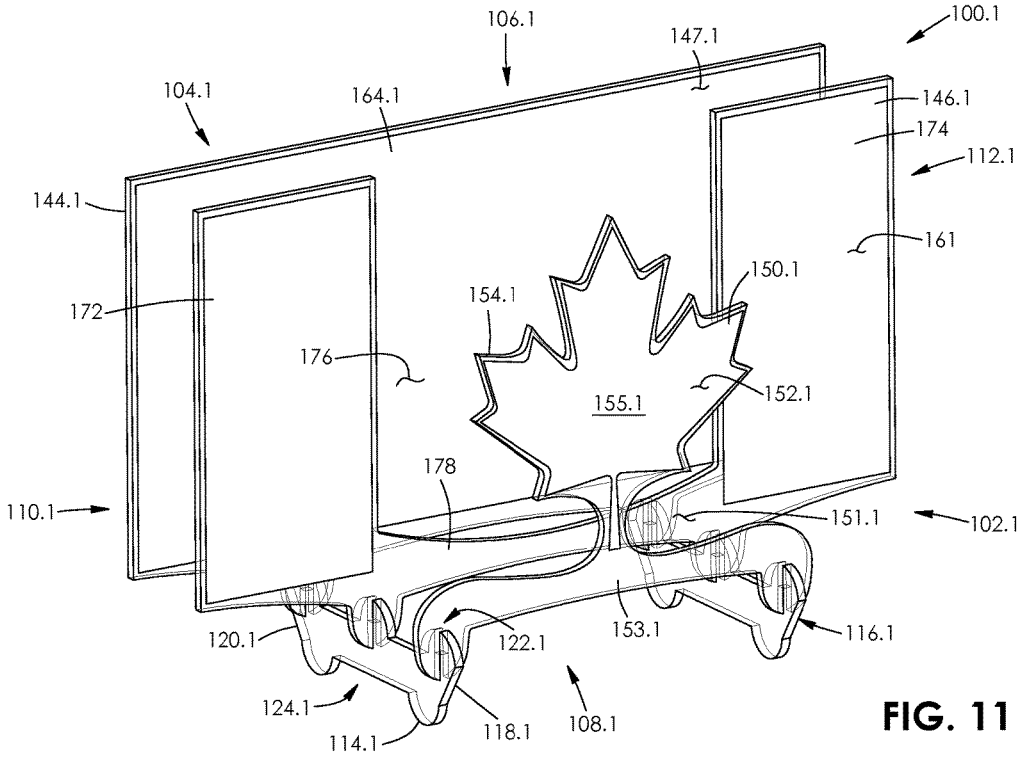
FIG. 11 is a front, left side perspective view of a display assembly according to a second aspect, the display assembly including a pair of mounting members, a rear planar member, an intermediate planar member and a front planar member.
Figure 12:
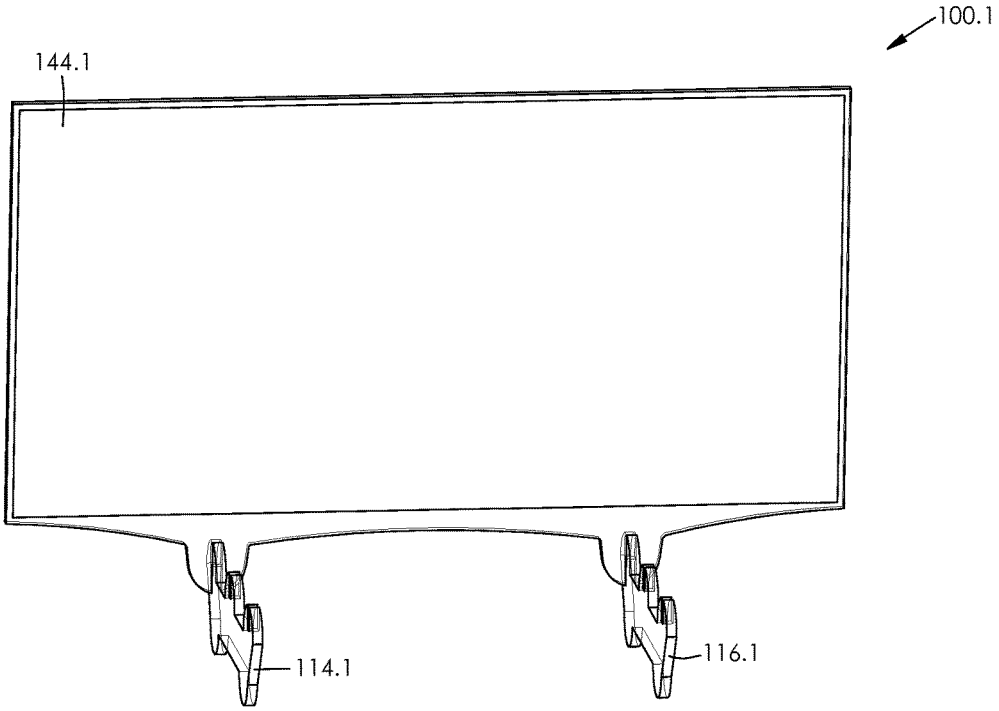
FIG. 12 is a front elevation view of the mounting members and the rear planar member of FIG. 11 mounted thereon.
Figure 13:
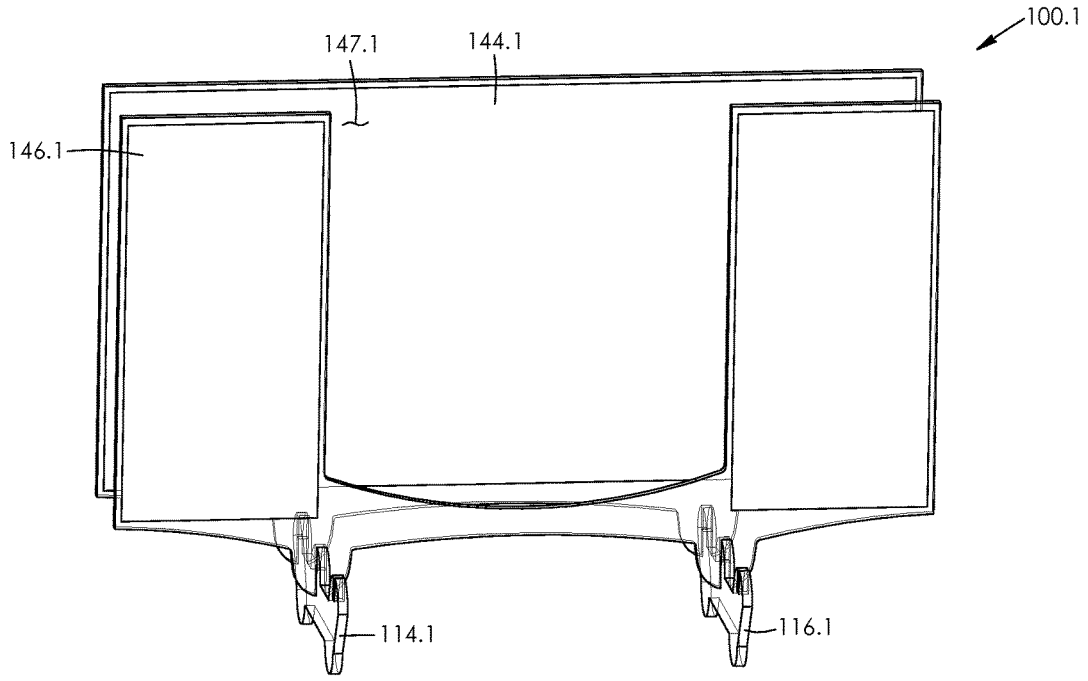
FIG. 13 is a front elevation view of the mounting members, and the rear planar member and the intermediate planar member of FIG. 11 mounted thereon.

Each mounting member 114 has a plurality of spaced-apart grooves extending from the top to the bottom thereof, with the grooves being centrally located within respective ones of the protrusions. This is shown by grooves 140 and 142 for protrusions 136 and 138. As seen in FIG. 10, the grooves are spaced-apart from each other by a generally consistent distance D in this example.

Referring back to FIG. 1, the assembly 100 includes a plurality of vertically-extending planar members, in this example a rear planar member 144 adjacent to the rear 104 of the assembly, a first intermediate planar member 146, a second or second intermediate planar member 148, and a front planar member 150 adjacent to the front 102 of the assembly. The first intermediate planar member is between the rear planar member and the second intermediate planar member. The second intermediate planar member 148 is between the first intermediate planar member 146 and the front planar member 150. Each of the planar members in this example comprises clear acrylic sheet having a thickness of ⅛ inch. However, this is not strictly required and the planar members may be made of other materials and have other thicknesses in other embodiments.

Each of the planar members 144, 146, 148, and 150 is cut to shape via a flat-bed laser cutter. As seen in FIG. 1, the front planar member 150 has more cut-out portions 151 in terms of front area compared to the cut-out portions 145 of the rear planar member 144 in this embodiment. The front planar member also has more cut-out portions 151 in terms of front area relative to the cut-out portions 147 and 149 of intermediate planar members 146 and 148, respectively, in this embodiment.

Figure 3:
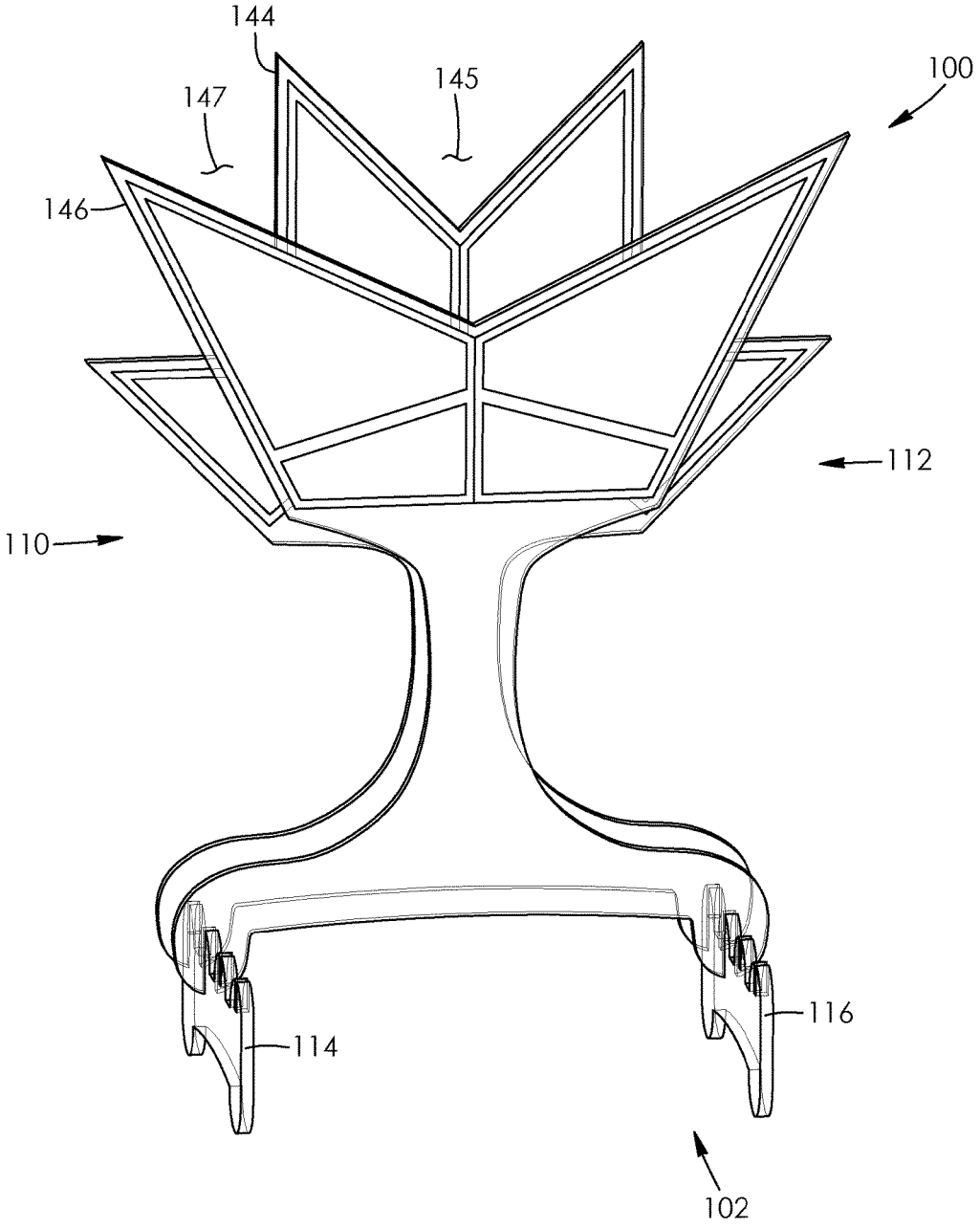
FIG. 3 is a front elevation view of the mounting members, and the rear planar member and a first of the intermediate planar members of FIG. 1 mounted thereon.
Figure 4:
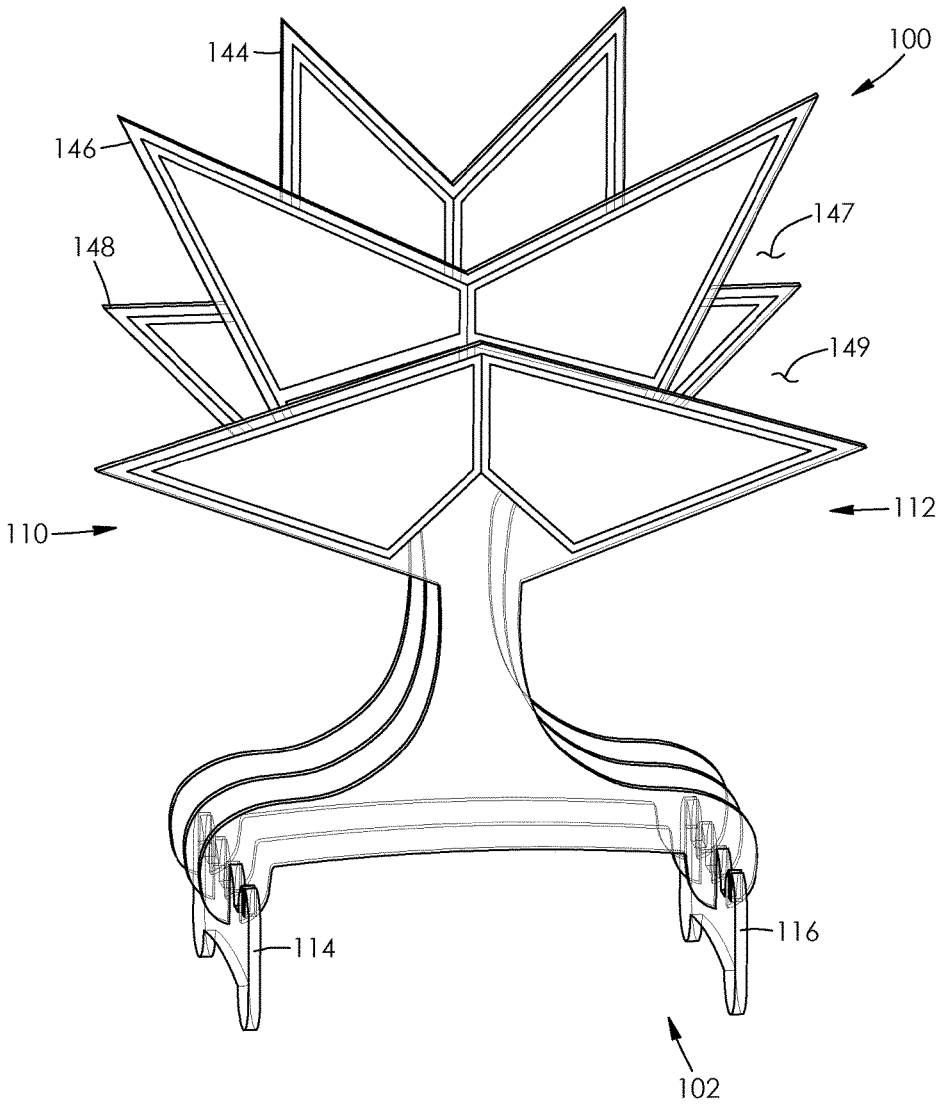
FIG. 4 is a front elevation view of the mounting members, and the rear planar member and both the intermediate planar members of FIG. 1 mounted thereon.

As seen in FIG. 3, intermediate planar member 146 has more cut-out portions 147 in terms of front area relative to the cut-out portions 145 of rear planar member 144 in this embodiment. As seen in FIG. 4, intermediate planar member 148 has more cut-out portions 149 in terms of front area relative to the cut-out portions 147 of intermediate planar member 146 in this embodiment.

Referring back to FIG. 1, each of the planar members 144, 146, 148 and 150 includes image indicia which is pre-applied thereon in this example, as shown by indicia 152 for front planar member 150. The image indicia may be applied to outer surfaces 155 of the planar members 150 using either full-colour, self-adhesive decals or direct-to-substrate, UV print-on-back, reverse-image printing for example. Such printing technology is known per se and thus will not be described in detail. An example of a suitable printer is a Mimaki™ UJF-6042 MkII UV Printer, which may be purchased at Mimaki Engineering Co., Ltd., having an address of 2182-3, Shigeno-Otsu, Tomi Nagano 3890512, Japan. The planar members are cut using the flat-bed laser cutter following the outline shape of the image indicia in this embodiment. The image indicia 152 in this example comprises a series of geometric and triangular shapes which represent cut-out or spaced-apart portions of Canada's $150^{th}$ Anniversary two-dimensional logo in this example, with each of the planar members 144, 146, 148 and 150 incorporating parts thereof. The image indicia extends inwards and thus enables the creater of the assembly 100 to incorporate further aspects to the logo that would otherwise be hidden and thus not conveyed when the logo is shown in its original two-dimensional form.

Figure 5:
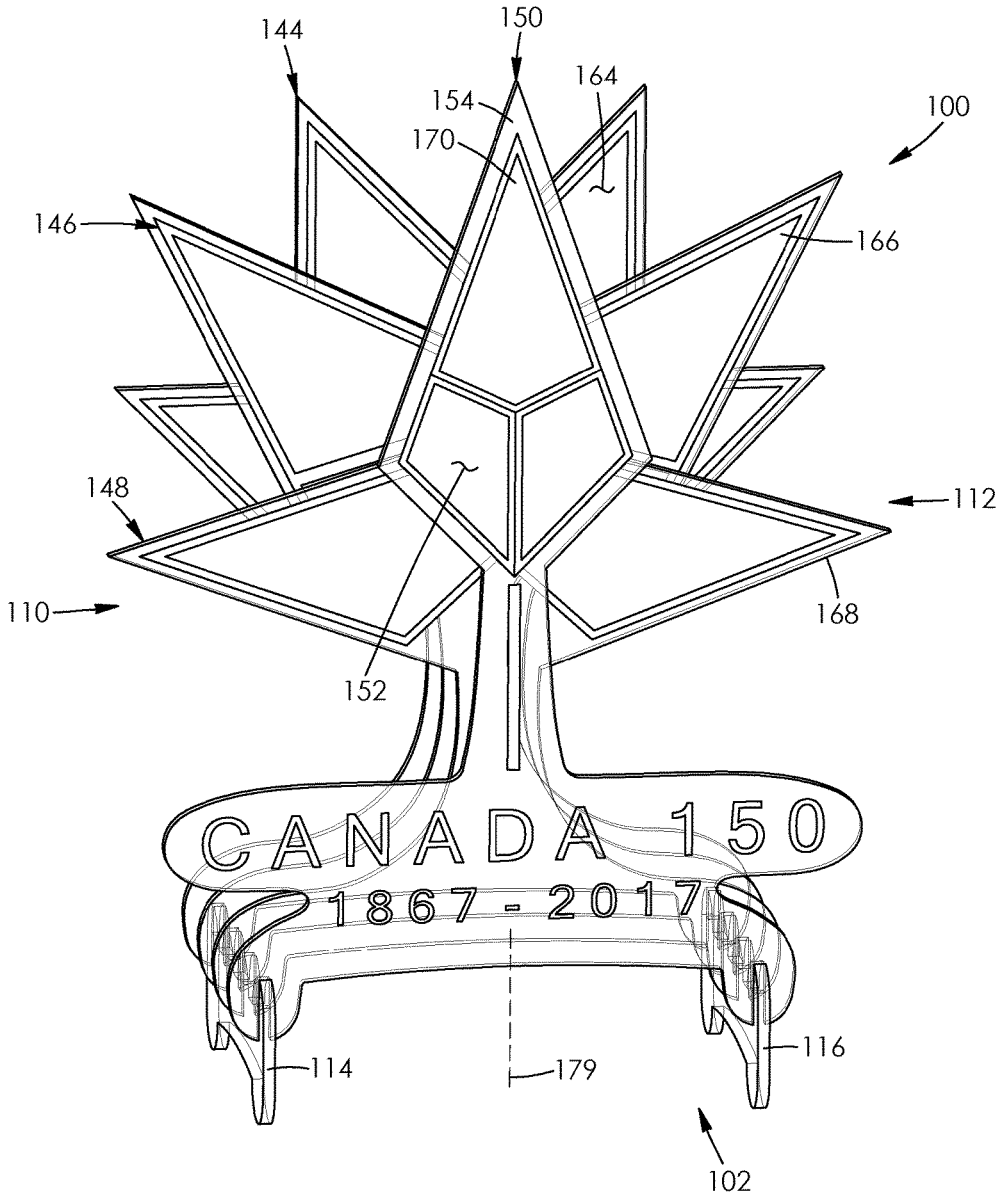
FIG. 5 is a front elevation view of the mounting members, and the rear planar member, the intermediate planar members and the front planar member of FIG. 1 mounted thereon.
Figure 6:
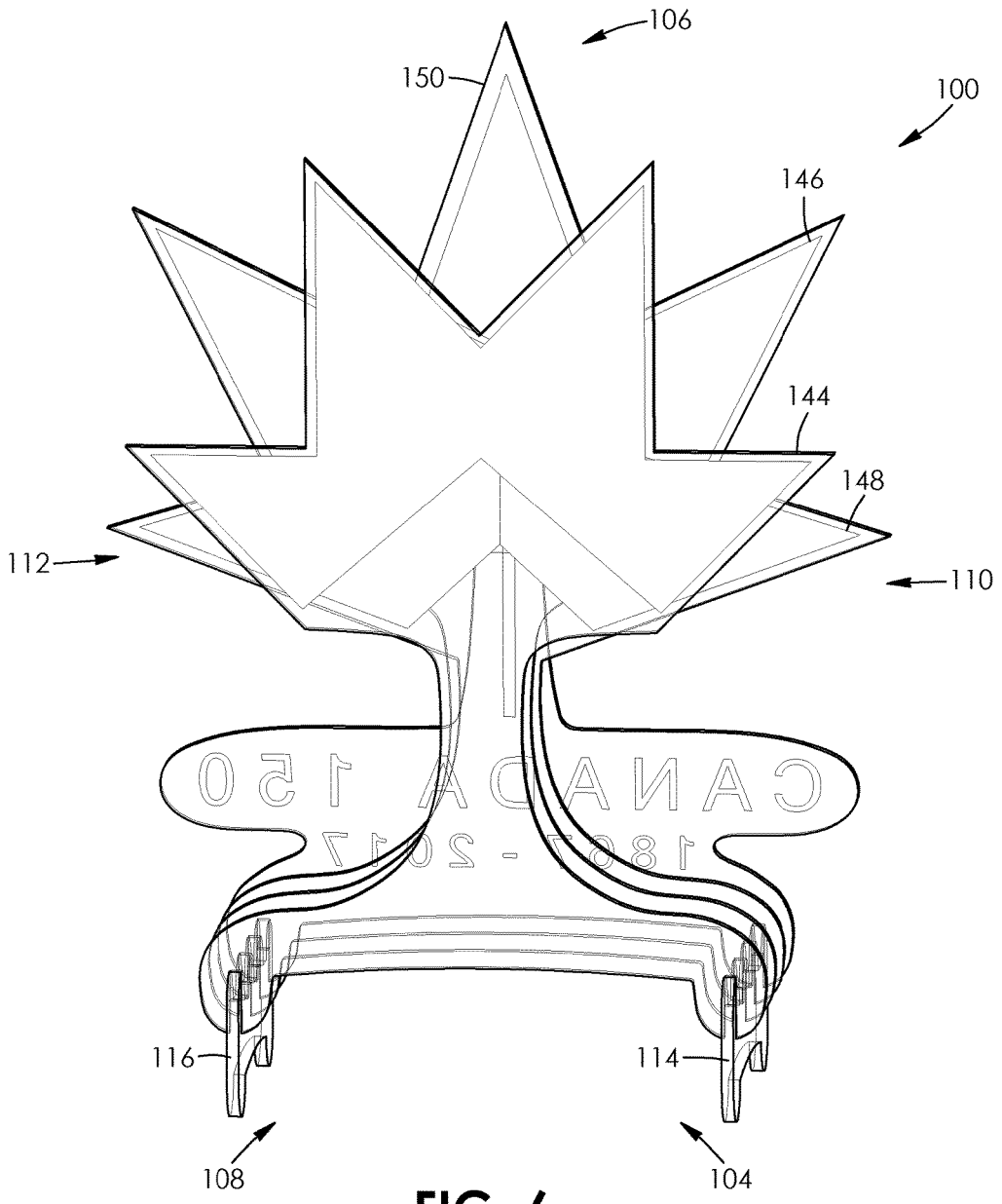
FIG. 6 is a rear elevation view of the assembly of FIG. 1.
Figure 7:
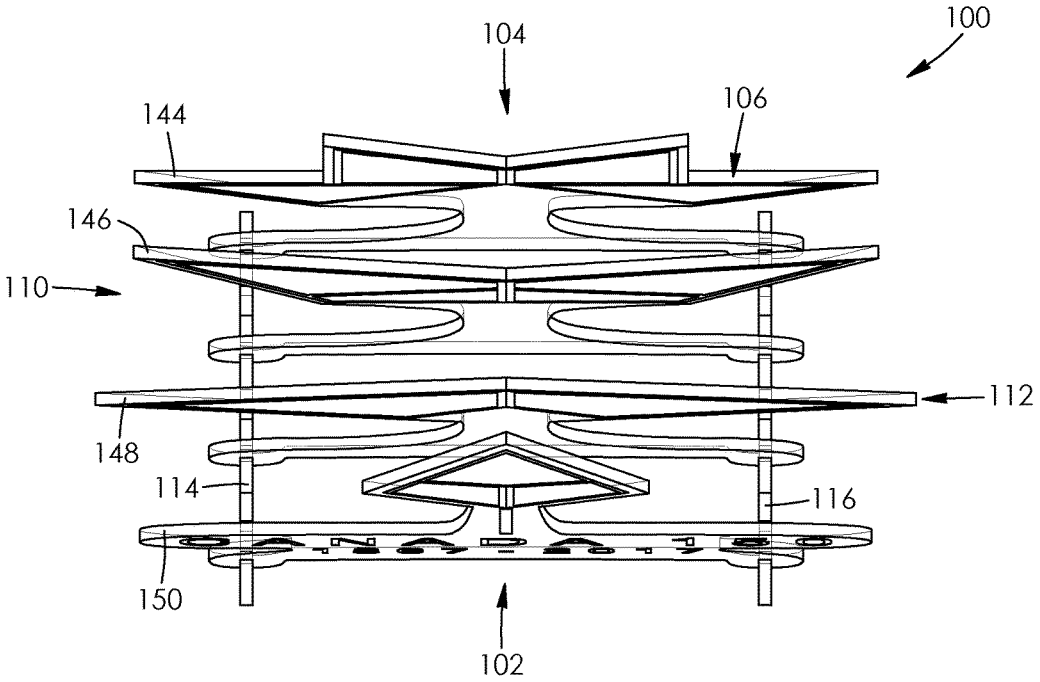
FIG. 7 is a top, front perspective view thereof.
Figure 8:
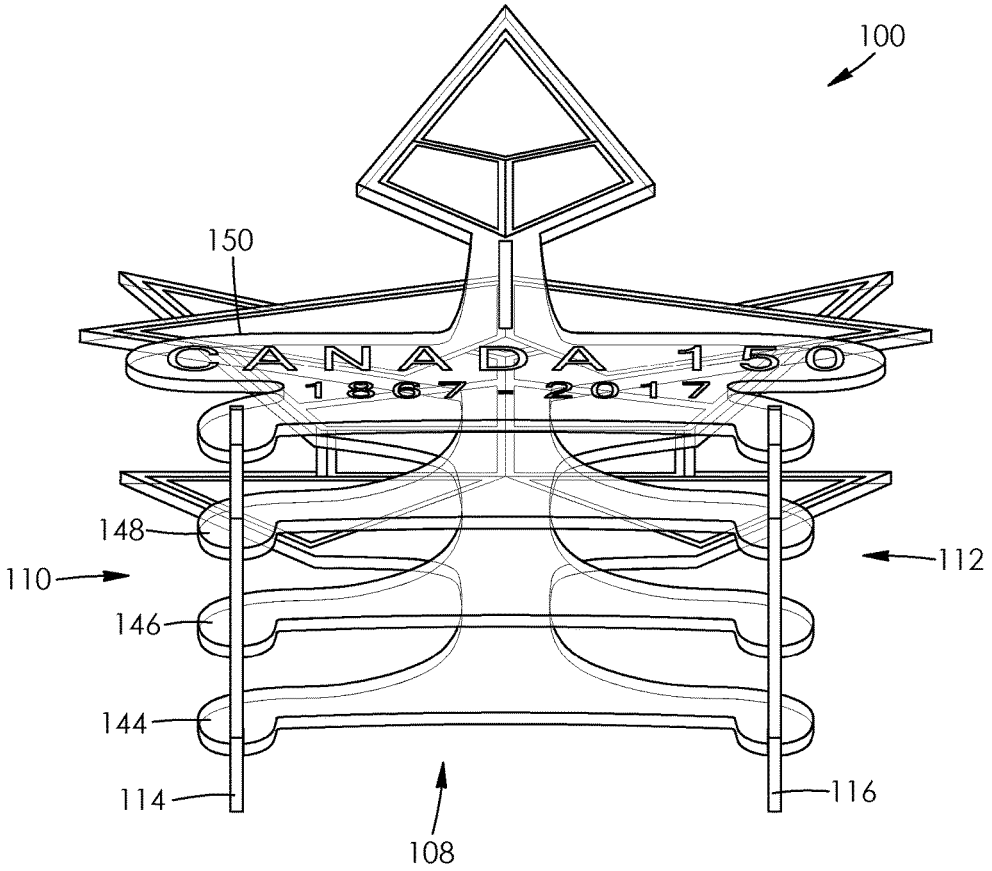
FIG. 8 is a bottom, front perspective view thereof.

As seen in FIG. 5, the image indicia 152 of the front planar member is centrally located relative to the image indicia of the other planar members when the assembly 100 is viewed from the front.

Each of the planar members includes a peripheral portion which is transparent and which extends about the image indicia in this example. This is shown by peripheral portion 154 for planar member 150 in FIG. 1.

Figure 2:
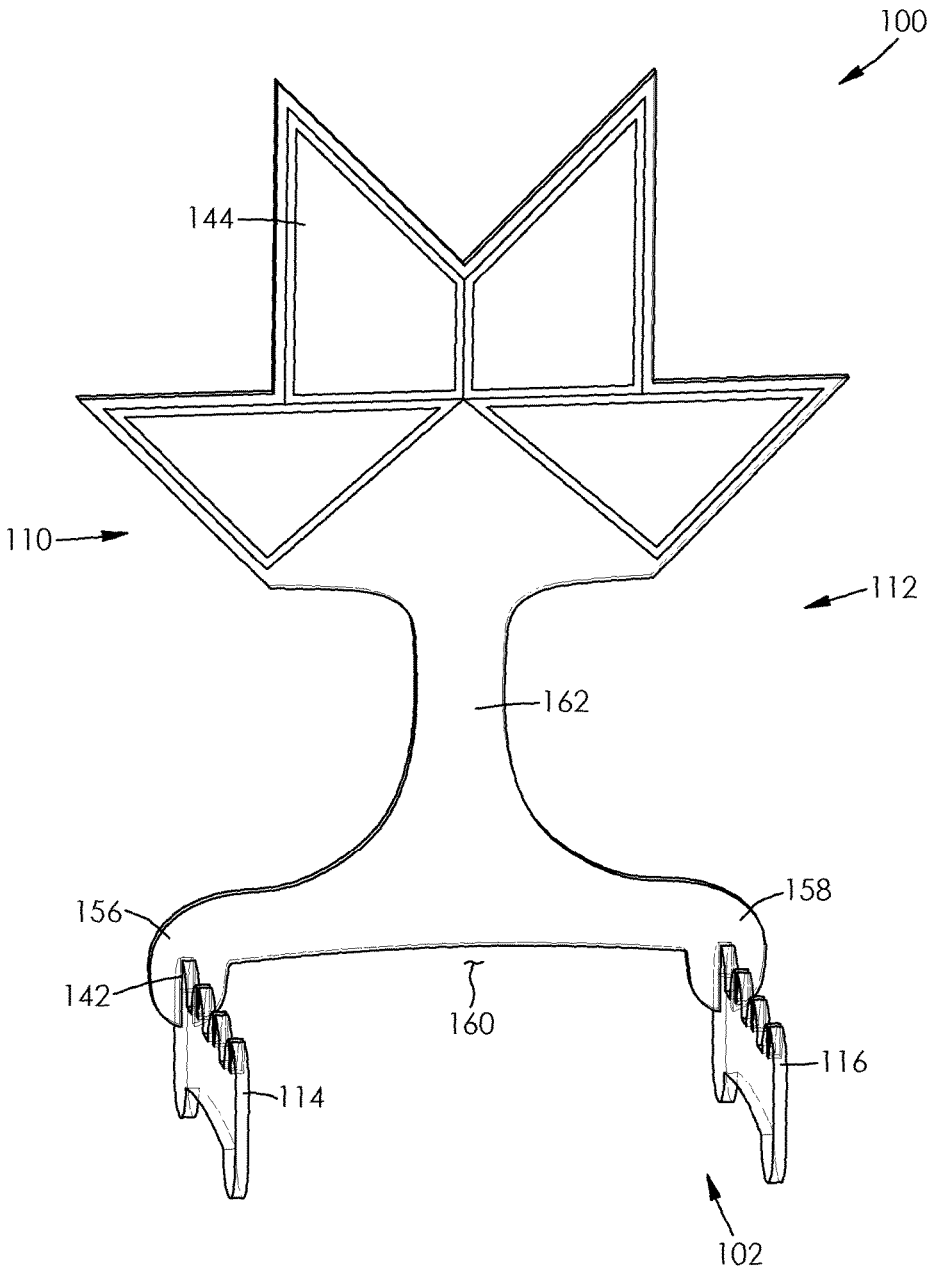
FIG. 2 is a front elevation view of the mounting members and the rear planar member of FIG. 1 mounted thereon.

Each of the planar members includes a lower mounting portion which is transparent in this example. This is shown by mounting portion 153 of planar member 150 in FIG. 1. The mounting portions of the planar members have a generally inverted u-shape in front profile this example. As seen in FIG. 2, each mounting portion includes a pair of spaced-apart protrusions 156 and 158 which are shaped to be received within respective grooves 142 of the mounting members 114 and 116. The mounting members are thus shaped to position each of the planar members in a vertically-extending manner, with each of the planar members thus being in the assigned order and being equidistant from each other, back to front. The planar members 144, 146, 148 and 150 so arranged are perpendicular to the mounting members 114 and 116 in this example.

The protrusions 156 and 158 are generally oval-like in shape in front profile in this example. Each planar member has a recessed region between the protrusions of its mounting portion in this example, as shown by recessed region 160 for planar member 144 in FIG. 2. Each of the planar members 144 in this embodiment includes an elongate connection or stem portion 162 which extends between the image indicia and the mounting portion 153 of the planar member. The stem portions of the planar members are transparent in this example.

Each of the plurality of planar members has a front area. As seen in FIG. 5, the rear planar member 144 has at least a portion thereof, in this example a plurality of portions thereof as indicated by portion 164, which extend outwards relative to the other of the planar members 146, 148 and 150 at least when the assembly 100 is viewed from the front. Portions 164 of the rear planar member extends outwards relative to the intermediate planar members 146 and 148 and relative to the front planar member 150 in this example.

As seen in FIG. 5, intermediate planar member 146 has at least a portion thereof, in this example a plurality of portions thereof as indicated by portion 166, which extend outwards relative to the rear planar member 144, intermediate planar member 148 and front planar member 150 in this example at least when the assembly 100 is viewed from the front. Similarly, intermediate planar member 148 has at least a portion thereof, in this example a plurality of portions thereof as indicated by portion 168, which extend outwards relative to the rear planar member 144, intermediate planar member 146 and front planar member 150 in this example at least when the assembly is viewed from the front. Front planar member 150 has at least a portion thereof, in this example portion 170 thereof which extends outwards relative to the rear planar member 144 and intermediate planar members 146 and 148 in this example at least when the assembly is viewed from the front.

The plurality of spaced-apart planar members 144, 146, 148 and 150 of the assembly 100 with two-dimensional image indicia thereon and so arranged via the mounting members 114 and 116 may thus display an overall image with having a three-dimensional effect. As seen in FIG. 5, each of the planar members is symmetrical and a mirror-image of itself about a vertically-extending central axis 179 of the assembly 100.

A common image, such as a national flag design, may be readily recognizable by the viewer. This may be because a person's memories hold a record of frequently seen images and one may be able to fill in other details of the image at mere glimpse thereof. The overall image conveyed may be recognizable as expected when viewed from the front as seen in FIG. 5. In this example, the image shown is Canada's $150^{th}$ Anniversary Logo. The assembly 100 is configured and shaped such that an adjustment of the lighting or viewing angle, as seen in FIG. 1, may result in an overall image conveyed which looks different. The assembly as herein described may attract a person's eyes often thereto as the appearance of the assembly changes with differing angles and lighting.

The viewer may know of the overall common image conveyed when viewed from the front; however, the overall image conveyed when viewed from a different angle, or with slightly different lighting, may cause the viewer to think that something is not quite right and/or that something is different and odd. The viewer's brain may instinctively try to figure out what is different to try to reconcile why is the overall image seen by the viewer's eyes does not match the image in the viewer's memory. This may cause the viewer to perform a mental double-take. The viewer's brain may thus take some time to reconcile the eye/memory mismatch and this may result is a bit of wonder: a puzzle or a challenge to previously assumed expectations.

For the methodology of co-ordinating the graphic printing process with the laser cutting process, both actions must be in sync with an extreme degree of accuracy in order for intricate printed shapes to be cut out properly. Alignment marks are printed on unused sections of the acrylic blank along with the graphics. Using the computer display attached to the laser, the operator manually lines up screen alignment marks one at a time with a laser pointer attached to the laser head in a back and forth fashion until multiple on-screen alignment mark positions match with the laser pointer mounted to the laser head. Alignment is now achieved and cutting may proceed.

Alternatively, one may use a video image recognition camera attached to the laser head to find and recognize specific alignment dots printed in unused portions of the acrylic blank. With the Trotec™ Speedy 300, this robotic option is called Job Control Vision. The camera is able to orient the laser cut pattern on-screen with the physical placement of the blank on the cutting surface using the printed "alignment dots". Once the software has found and recognized all of the alignment dots, the cutline to be used by the laser is now perfectly aligned with the printed graphics as designed and may proceed.

FIGS. 11 to 19 show a display assembly 100.1 according to a second aspect. Like parts have like numbers and functions as the display assembly 100 shown in FIGS. 1 to 10 with the addition of decimal extension ".1". Display assembly 100.1 is the same as described for display assembly 100 shown in FIGS. 1 to 10 with at least the following exceptions.

In this example, display assembly 100.1 conveys a Canadian flag and comprises only three planar members: rear planar member 144.1, intermediate planar member 146.1 and front planar member 150.1. The front planar member of the assembly is generally in the shape of a maple leaf with image indicia 152.1 that is red and has a front area that is smaller than that of intermediate planar member 146.1 and rear planar member 144.1.

Figure 14:
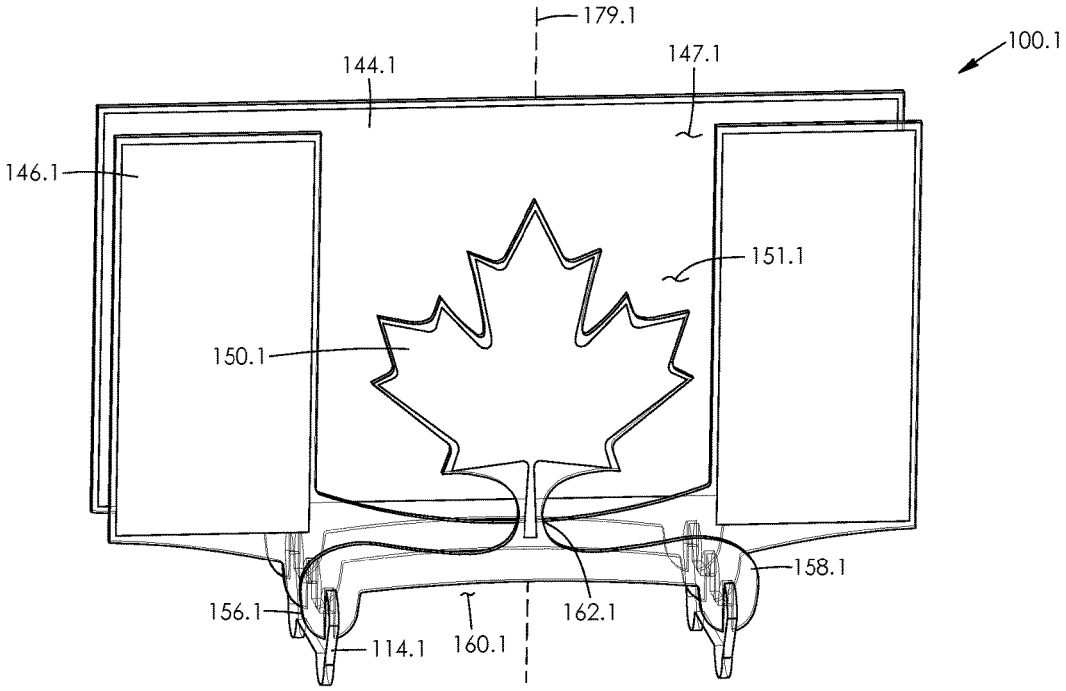
FIG. 14 is a front elevation view of the mounting members, and the rear planar member, the intermediate planar member and the front planar member of FIG. 11 mounted thereon.
Figure 15:
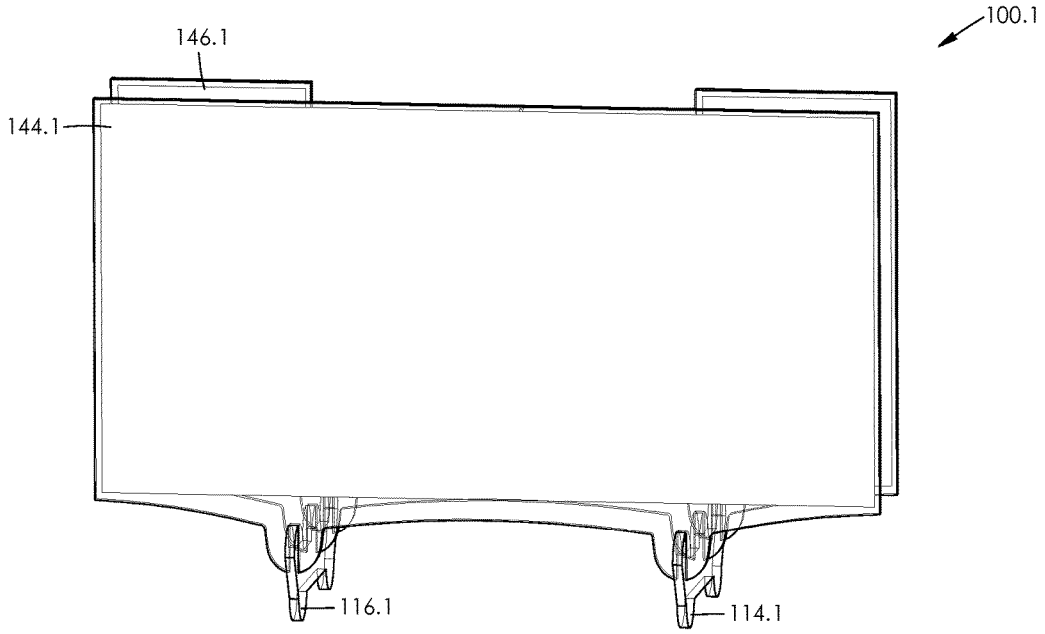
FIG. 15 is a rear elevation view of the assembly of FIG. 11.
Figure 16:
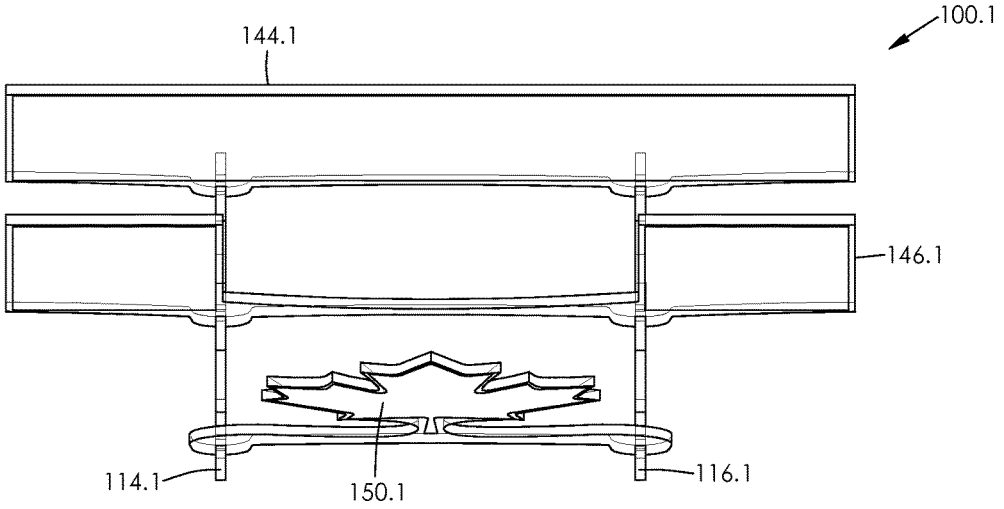
FIG. 16 is a top, front perspective view thereof.
Figure 17:
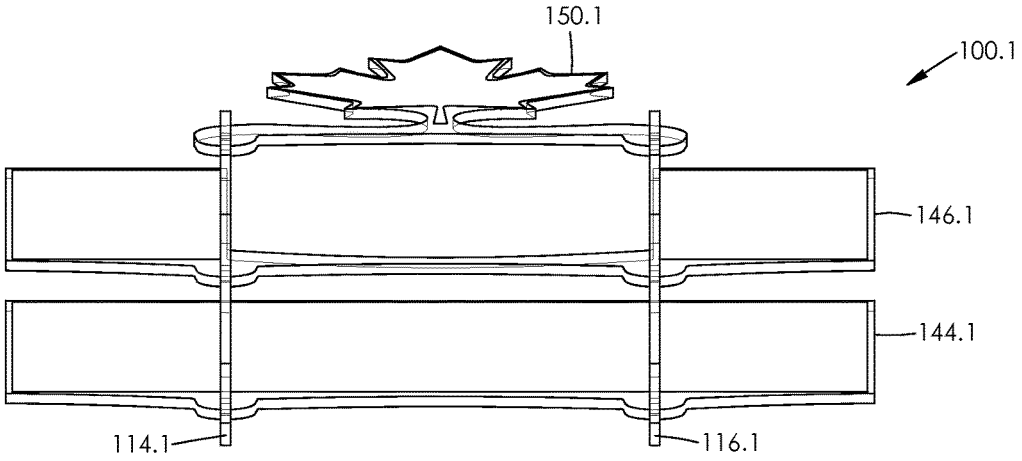
FIG. 17 is a bottom, front perspective view thereof.
Figure 18:
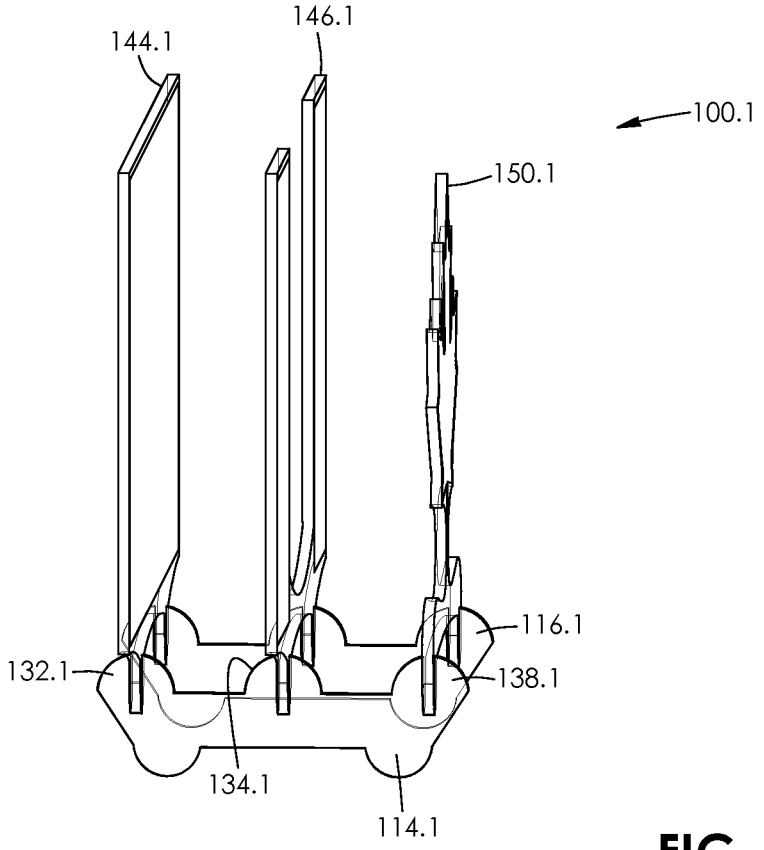
FIG. 18 is a left side elevation view thereof.
Figure 19:
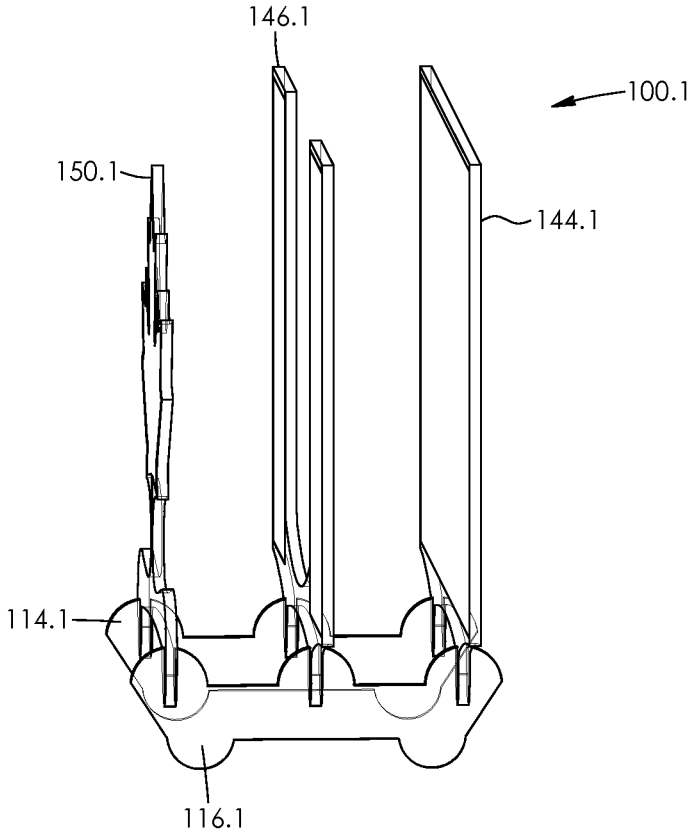
FIG. 19 is a right side elevation view thereof.
Figure 20:
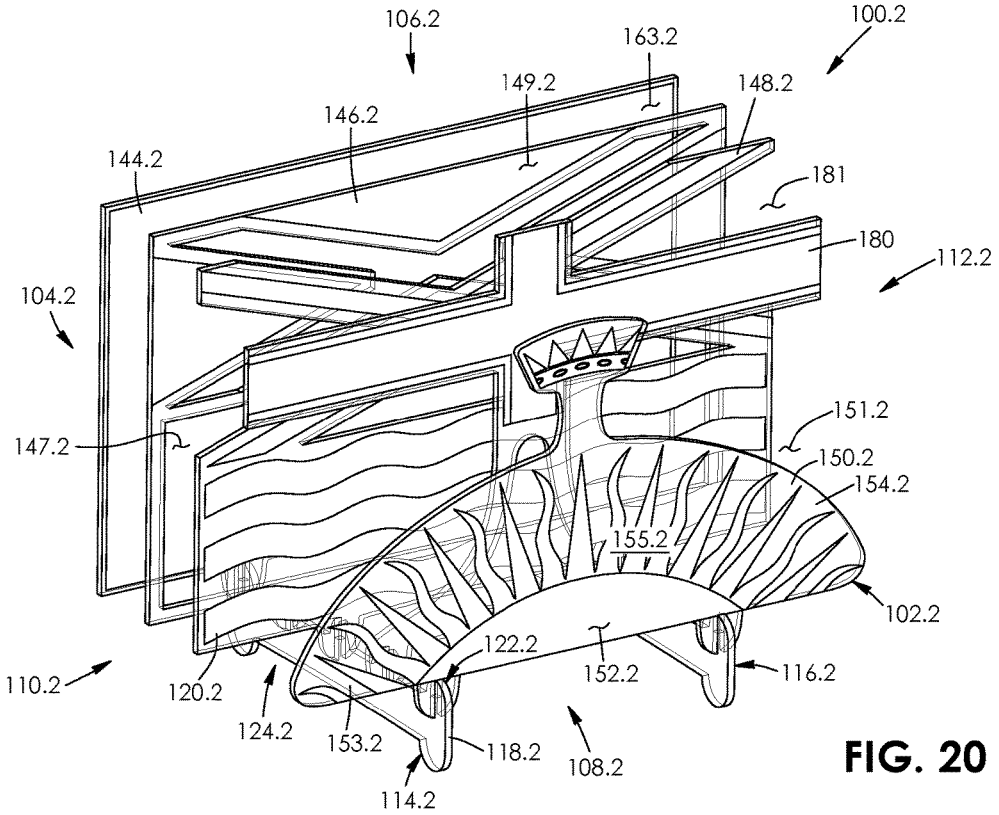
FIG. 20 is a front, left side perspective view of a display assembly according to a third aspect, the display assembly including a pair of mounting members, a rear planar member, three intermediate planar members and a front planar member.
Figure 21:
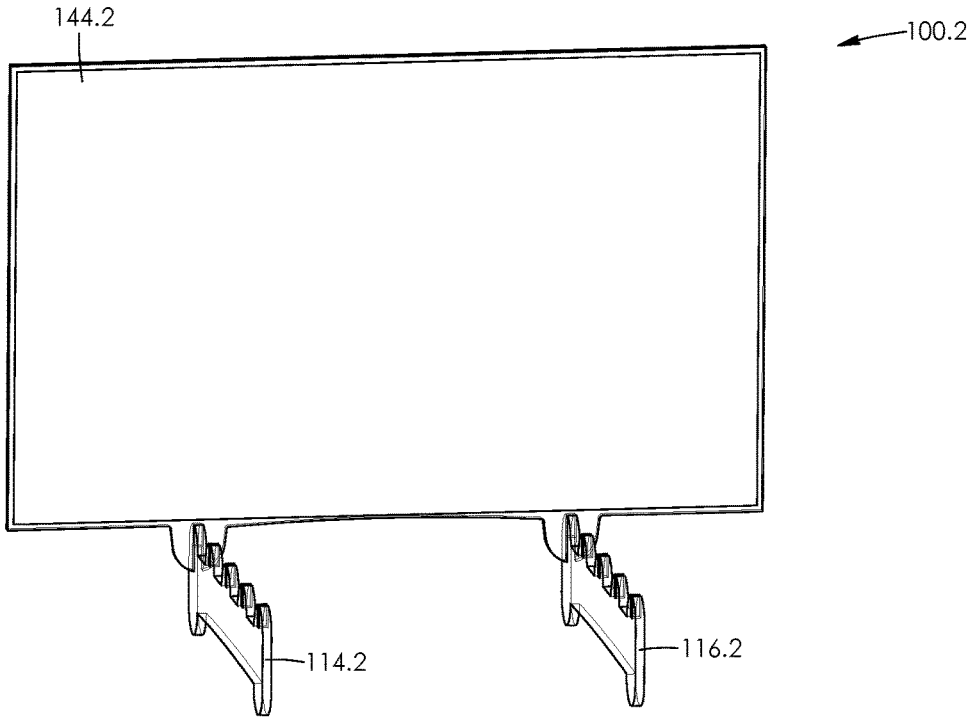
FIG. 21 is a front elevation view of the mounting members and the rear planar member of FIG. 20 mounted thereon.

Intermediate planar member 146.1 includes a pair of spaced-apart rectangular portions 172 and 174 which are generally shown with image indicia 161 in the form of the color red. The intermediate planar member has a recessed region 176 between the rectangular portions, with the recessed region being generally rectangular in shape. The intermediate planar member 146.1 includes an elongate connector portion 178 which couples together the rectangular portions 172 and 174 thereof. The connector portion 178 of the intermediate planar member is adjacent to the bottom 108.1 of the assembly 100.1 in this example and also function as the mounting portion of the planar member. As seen in FIG. 14, the image indicia 161 of the intermediate planar member is most visible or conspicuous and has a larger front area when viewed from the front of the assembly compared to the image indicia of the other of the planar members in this embodiment.

Rear planar member 144.1 has a front area that is two-dimensional geometric shape, in this example a rectangle. The image indicia 163 of the rear planar member is primarily unitary in color and in this example is white. The front area of the rear planar member 144.1 of assembly 100.1 is larger than the front areas of at least one of the other of the planar members and, in this example, is larger than the front area of the intermediate planar member 146.1 and the front area of the front planar member 150.1.

The front planar member 150.1 has more cut-out portions 151.1 in terms of front area relative to the cut-out portions 147.1 of the intermediate planar member 146.1. The front planar member and the intermediate planar member have more cut-out portions than the rear planar member, which is rectangular and thus may be said to not have any cut-out portions.

FIGS. 20 to 30 show a display assembly 100.2 according to a third aspect. Like parts have like numbers and functions as the display assembly 100.1 shown in FIGS. 11 to 19 with decimal extension ".2" replacing decimal extension ".1" and being added for like parts not previously having decimal extensions. Display assembly 100.2 is the same as described for display assembly 100.1 shown in FIGS. 11 to 19 with at least the following exceptions.

In this example, display assembly 100.2 conveys the flag of British Columbia, which is a province in Canada. The display assembly comprises only five planar members in this example: rear planar member 144.2, a first intermediate planar member 146.2, a second intermediate planar member 148.2, a third intermediate planar member 180, and front planar member 150.2. Planar member 146.2 extends between planar members 144.2 and 148.2. Planar member 148.2 extends between planar members 146.2 and 180. Planar member 180 extends between planar members 148.2 and 150.2.

Rear planar member 144.2 has a front area that is generally rectangular, with the image indicia 163.2 thereof being primarily unitary in color and in this example white. The front area of the rear planar member of assembly 100.2 is larger than the front areas of at least one of the other of the planar members and, in this example, is larger than the front areas of first intermediate planar member 146.2, second intermediate planar member 148.2, third intermediate planar member 180, and front planar member 150.2

Intermediate planar member 180 of assembly 100.2 is generally cross-shaped and has more cut-out portions 181 in terms of front area relative to the cut-out portions 147.2 and 149.2 of intermediate planar member 146.2 and 148.2, and cut-out portions 151.2 of front planar member 150.2. The front planar member and the intermediate planar members have more cut-out portions than the rear planar member, which is rectangular and thus may be said to not have any cut-out portions.

Figure 25:
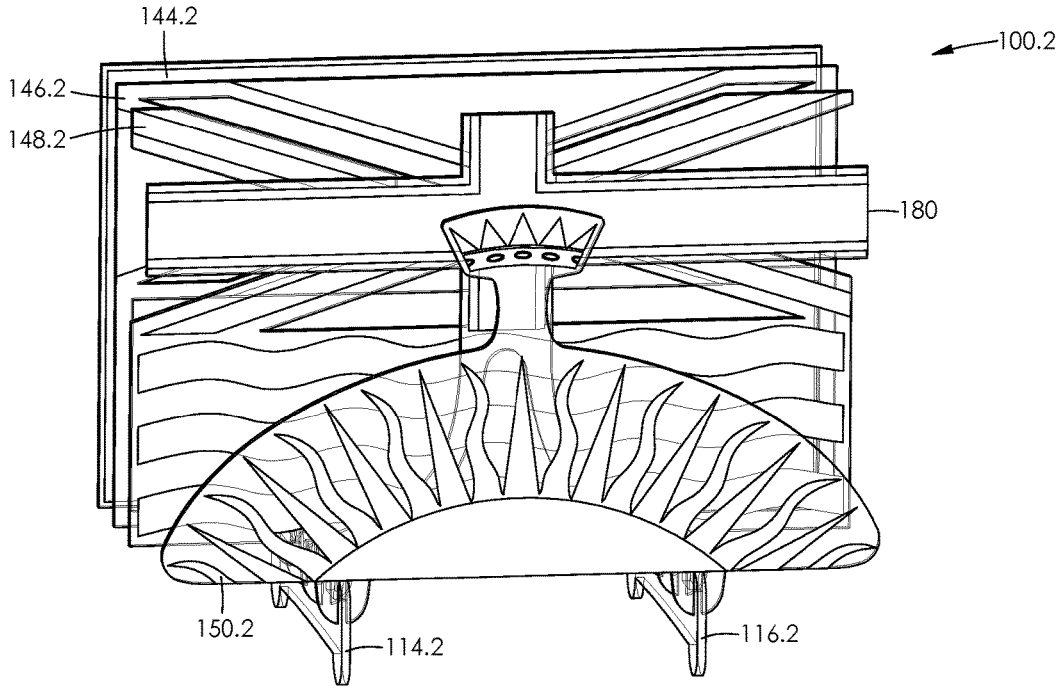
FIG. 25 is a front elevation view of the mounting members, and the rear planar member, the intermediate planar members and the front planar member of FIG. 20 mounted thereon.
Figure 26:
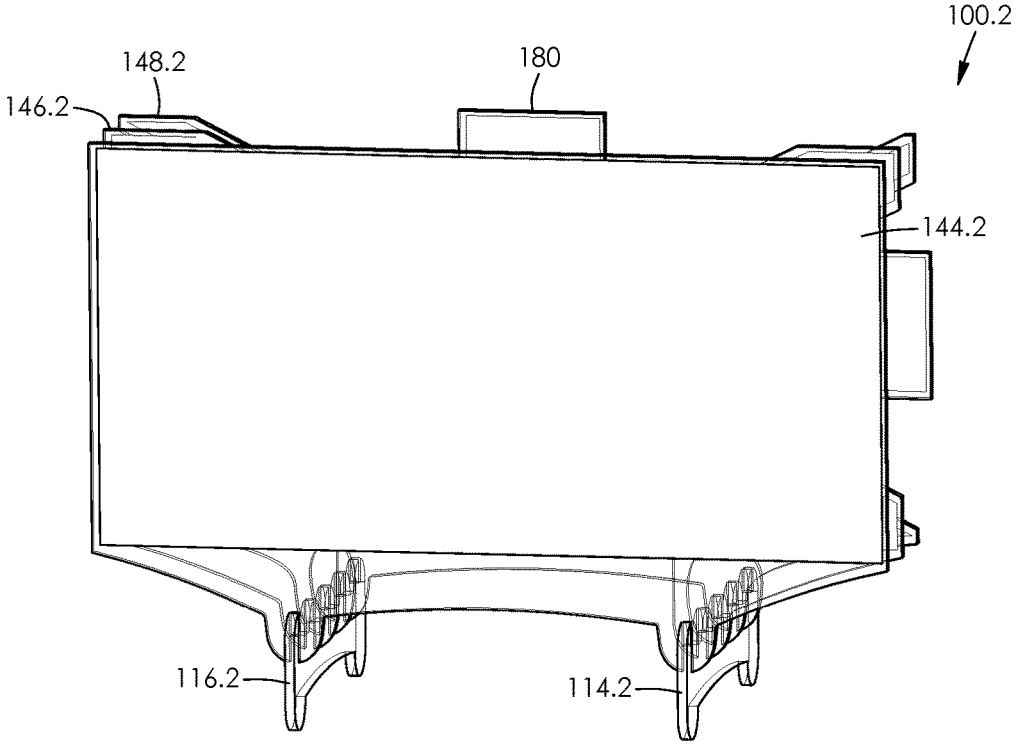
FIG. 26 is a rear elevation view of the assembly of FIG. 20.
Figure 27:
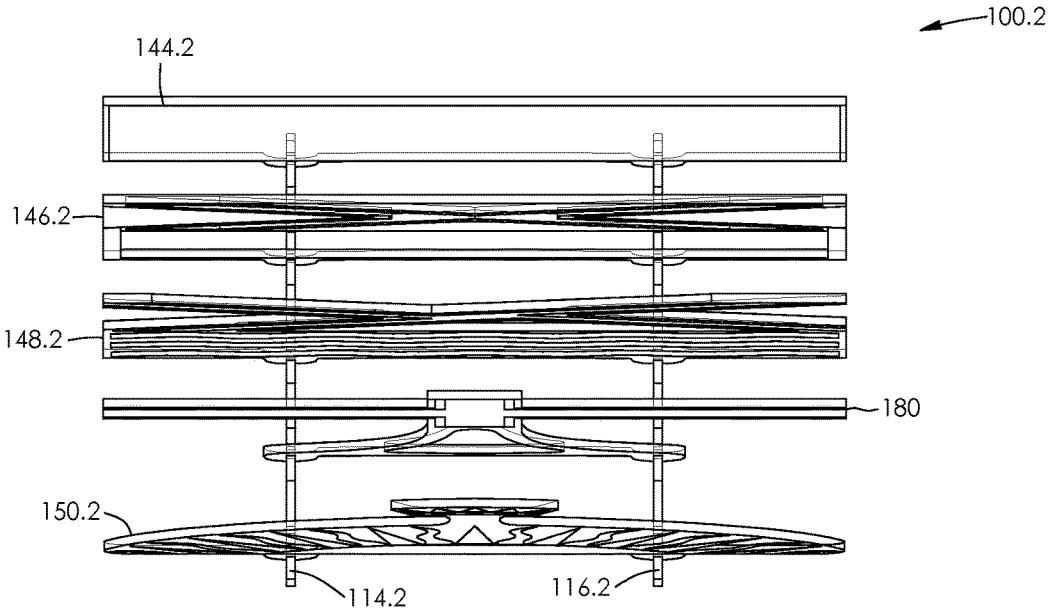
FIG. 27 is a top, front perspective view thereof.
Figure 28:
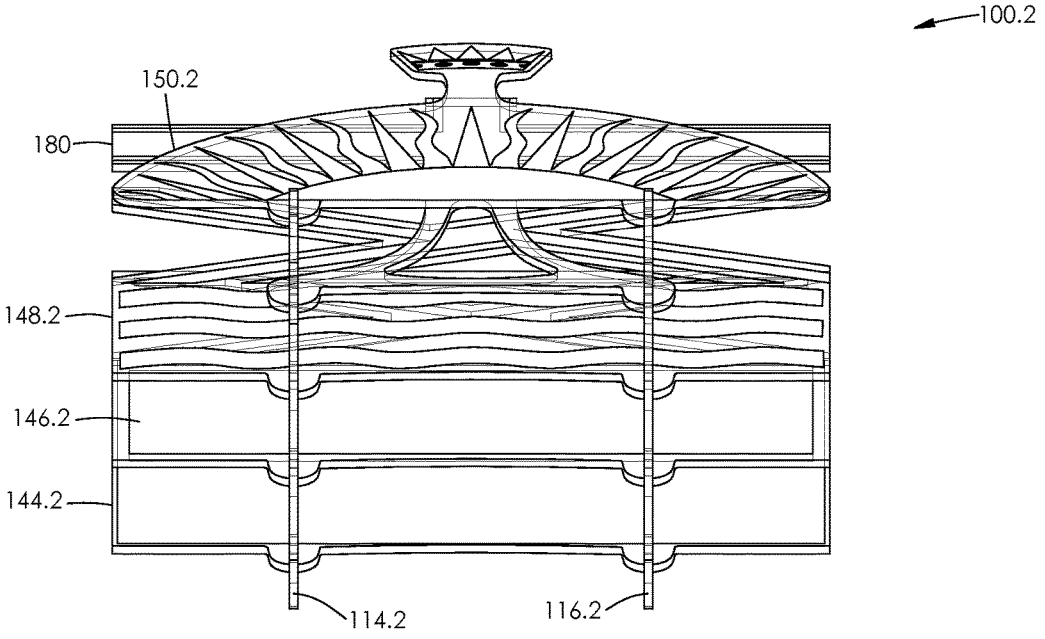
FIG. 28 is a bottom, front perspective view thereof.
Figure 29:
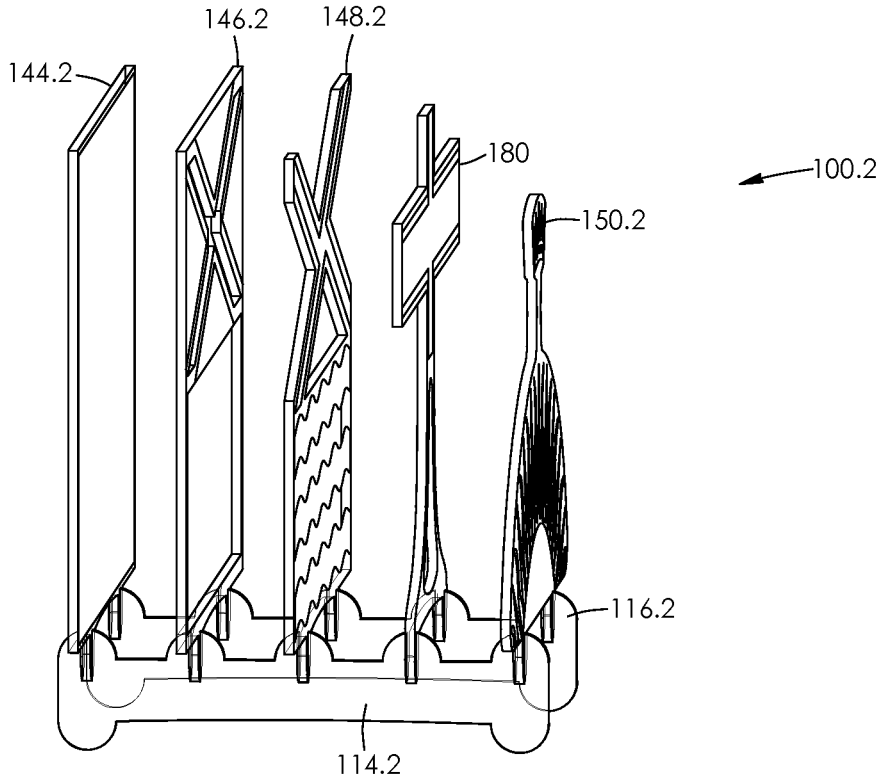
FIG. 29 is a left side elevation view thereof.
Figure 30:
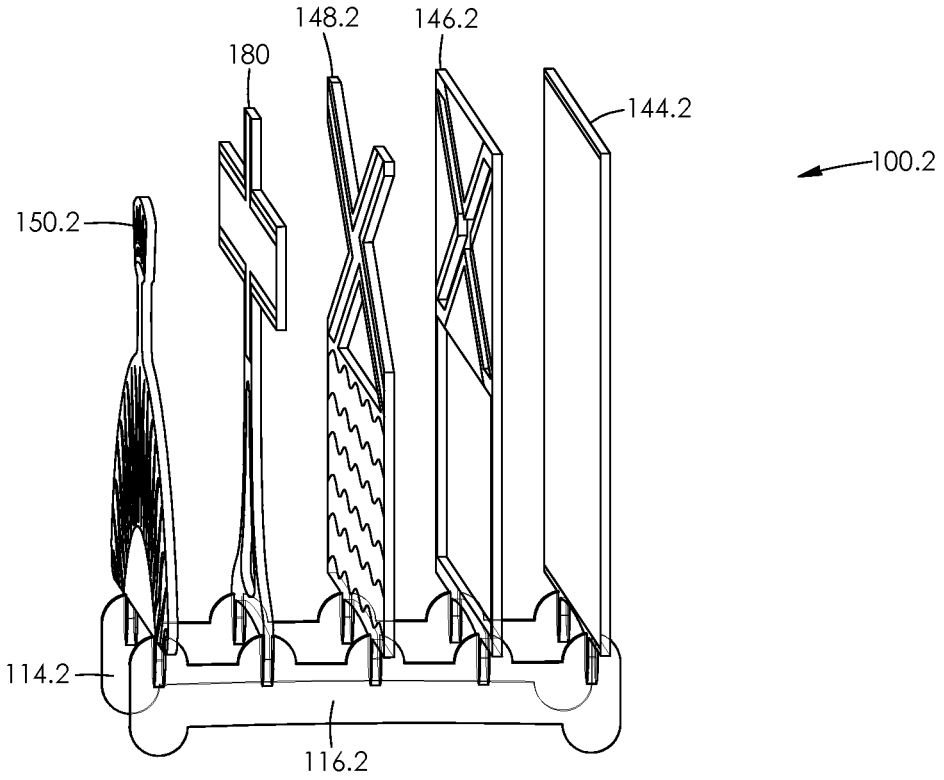
FIG. 30 is a right side elevation view thereof.
Figure 31:
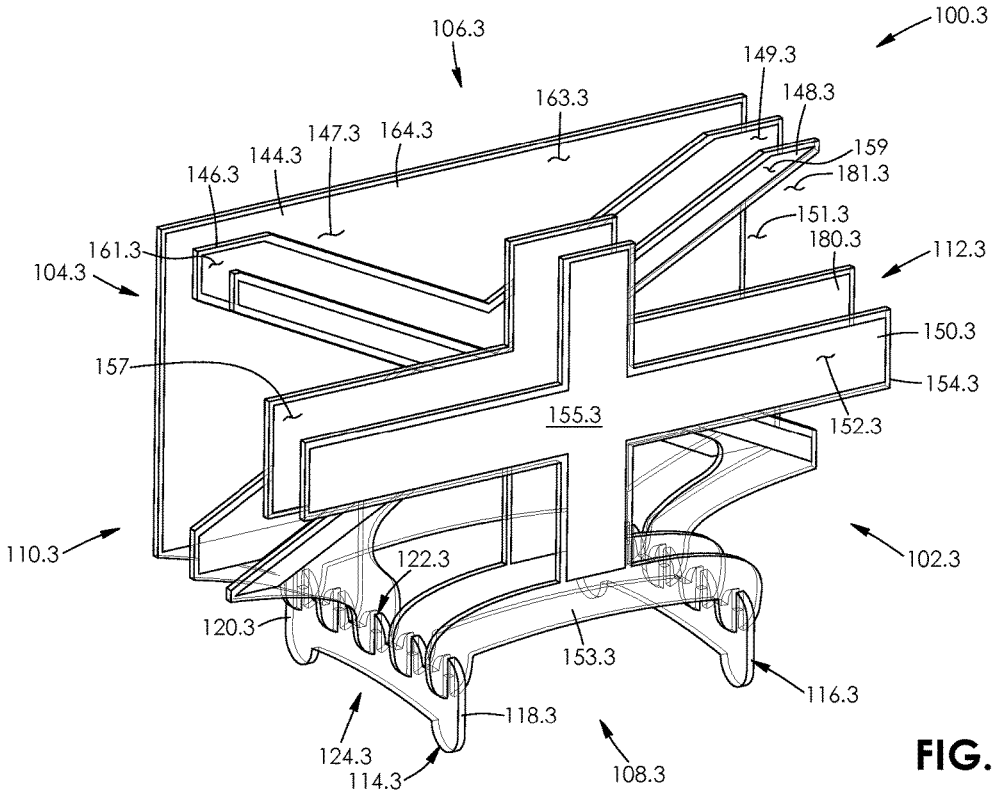
FIG. 31 is a front, left side perspective view of a display assembly according to a fourth aspect, the display assembly including a pair of mounting members, a rear planar member, three intermediate planar members and a front planar member.

As seen in FIG. 25, the image indicia 152.2 of the front planar member 150.2 of assembly 100.2 is most visible or conspicuous and has a larger front area when viewed from the front of the assembly compared to the image indicia of the other of the planar members in this example. The image indicia of the front planar member conveys a sun and a crown both shown in yellow in this example.

Figure 23:
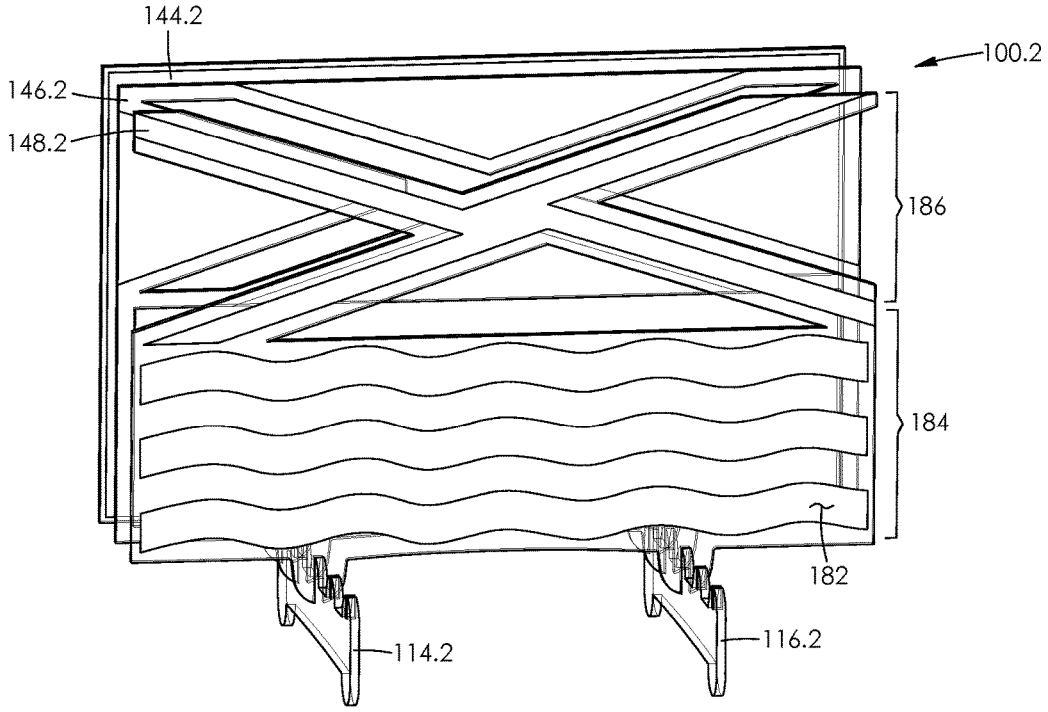
FIG. 23 is a front elevation view of the mounting members, and the rear planar member and the first and a second of the intermediate planar members of FIG. 20 mounted thereon.
Figure 24:
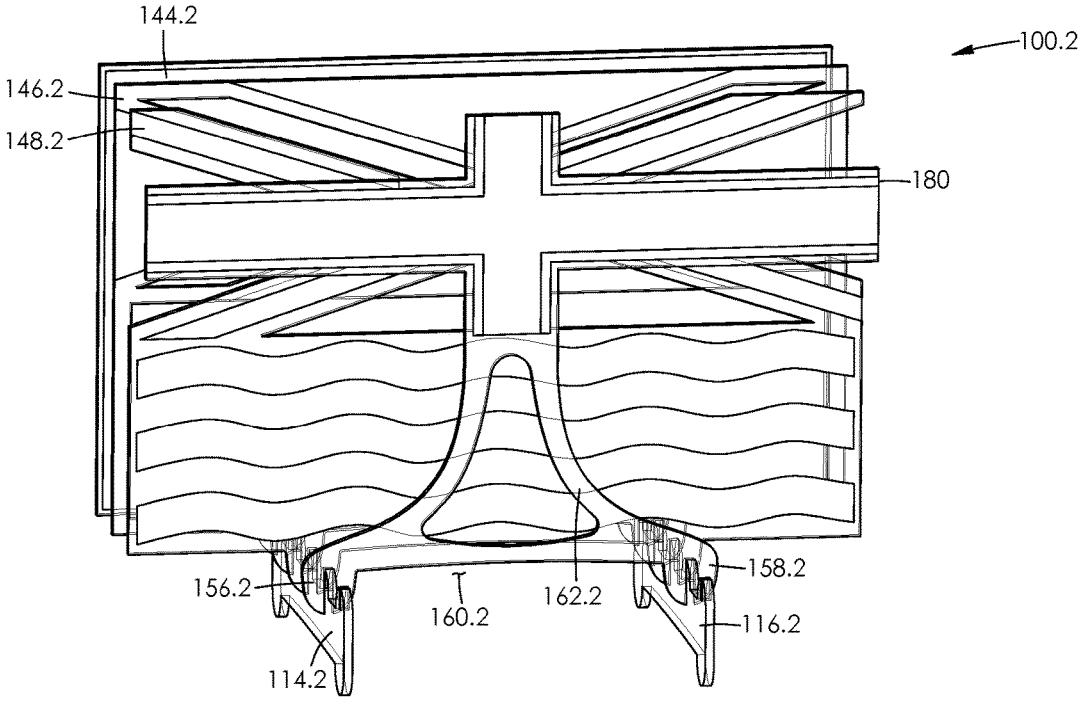
FIG. 24 is a front elevation view of the mounting members, and the rear planar member and all of the intermediate planar members of FIG. 20 mounted thereon.

As seen in FIG. 23, intermediate planar member 148.2 has image indicia 182 in the form of a plurality of wave images shown in blue at the lower section 184 thereof and a diagonally extending cross-shape shown in red at an upper section 186 thereof.

Figure 22:
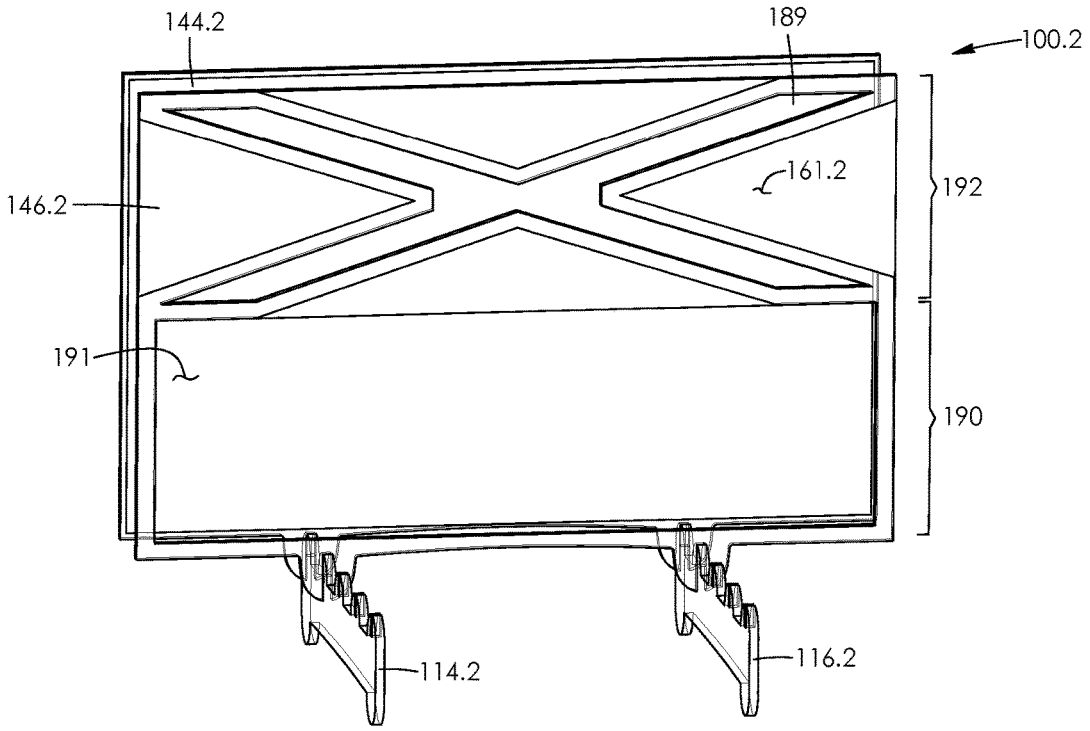
FIG. 22 is a front elevation view of the mounting members, and the rear planar member and a first of the intermediate planar members of FIG. 20 mounted thereon.

As seen in FIG. 22, intermediate planar member 146.2 has image indicia 161.2 in the form of a plurality of triangles shown in blue which define a diagonally extending cross-shaped cut-out portion 189 at an upper section 192 thereof, and includes a rectangular shaped cut-out portion 191 at a lower section 190 thereof.

FIGS. 31 to 41 show a display assembly 100.3 according to a fourth aspect. Like parts have like numbers and functions as the display assembly 100.2 shown in FIGS. 20 to 30 with decimal extension ".3" replacing decimal extension ".2" and being added for like parts not previously having decimal extensions. Display assembly 100.3 is the same as described for display assembly 100.2 shown in FIGS. 20 to 30 with at least the following exceptions.

In this example, display assembly 100.3 conveys the Union Jack, which is the national flag of the United Kingdom. The assembly comprises five planar members: rear planar member 144.3, first intermediate planar member 146.3, second intermediate planar member 148.3, third intermediate planar member 180.3 and front planar member 150.3.

Figure 35:
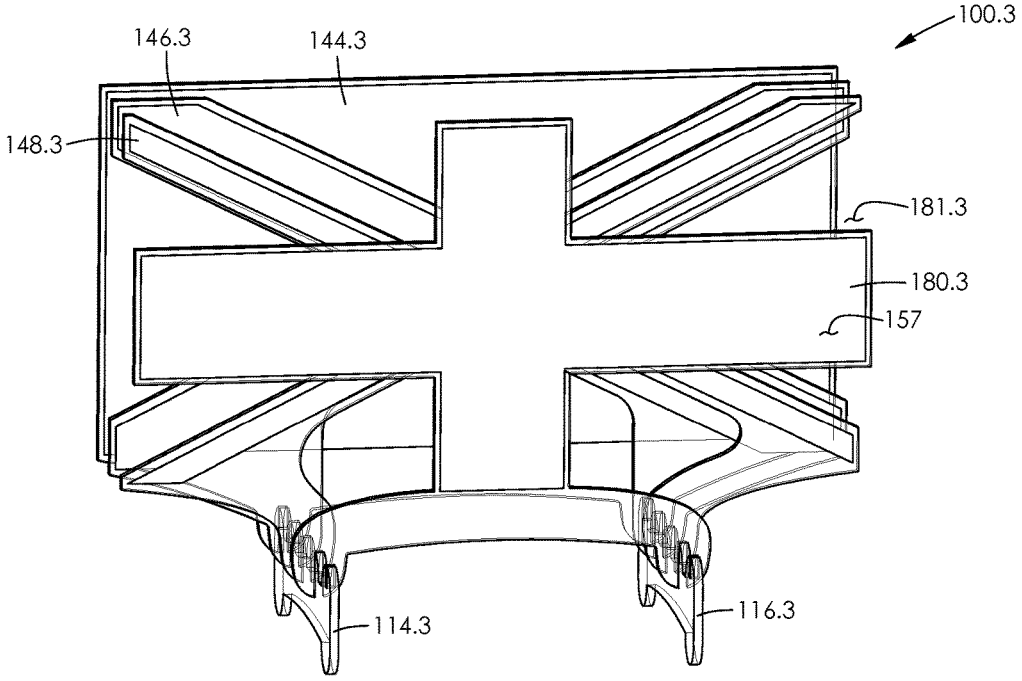
FIG. 35 is a front elevation view of the mounting members, and the rear planar member and all of the intermediate planar members of FIG. 31 mounted thereon.
Figure 36:
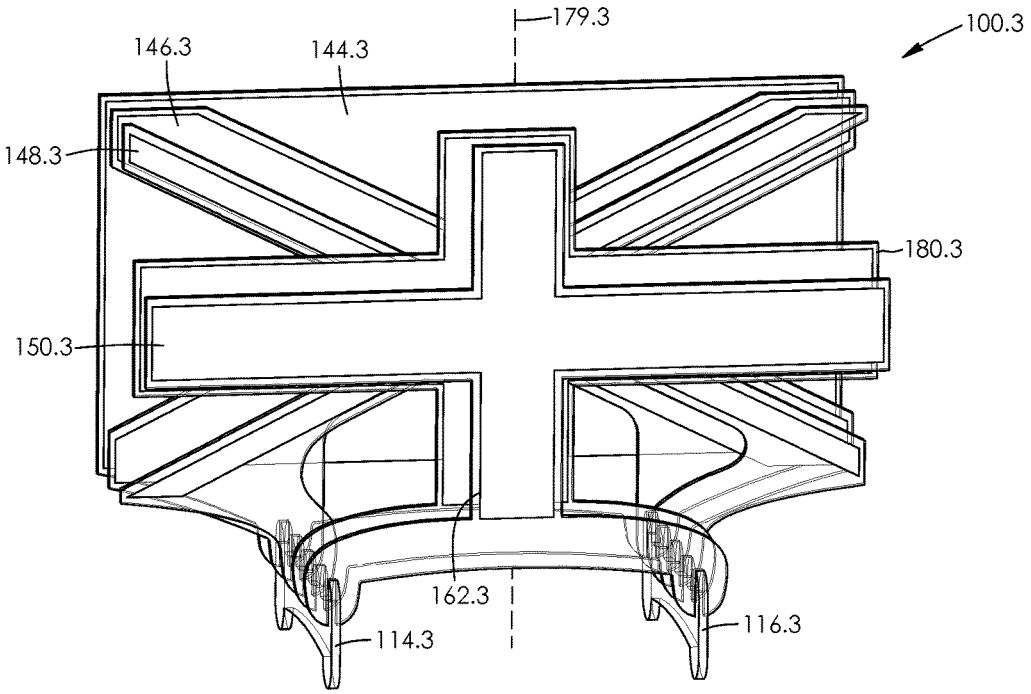
FIG. 36 is a front elevation view of the mounting members, and the rear planar member, the intermediate planar members and the front planar member of FIG. 31 mounted thereon.
Figure 37:
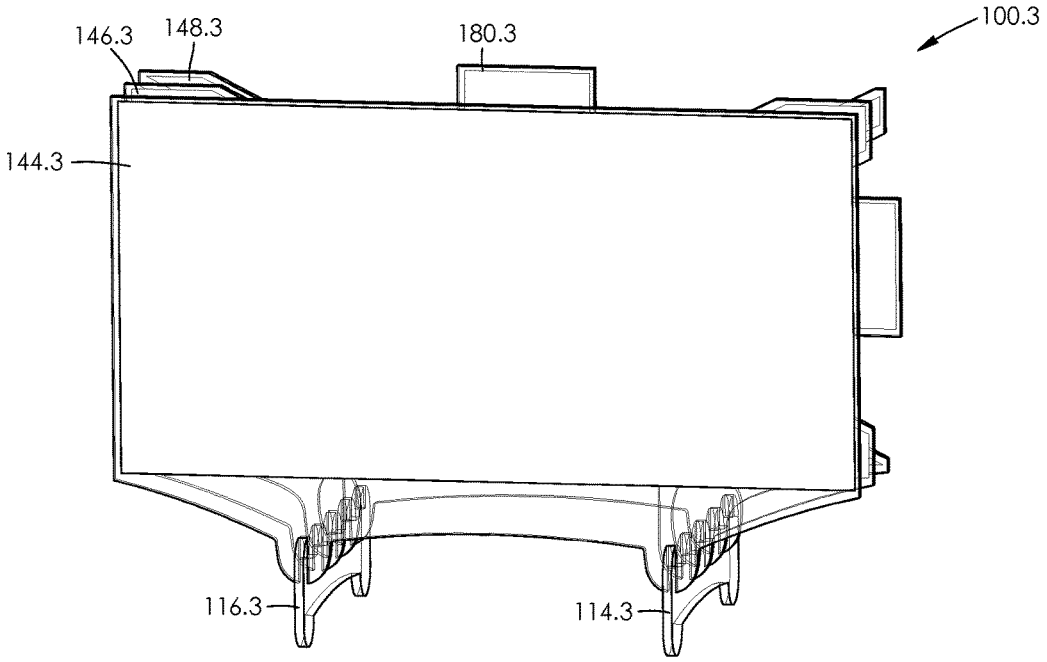
FIG. 37 is a rear elevation view of the assembly of FIG. 31.
Figure 38:
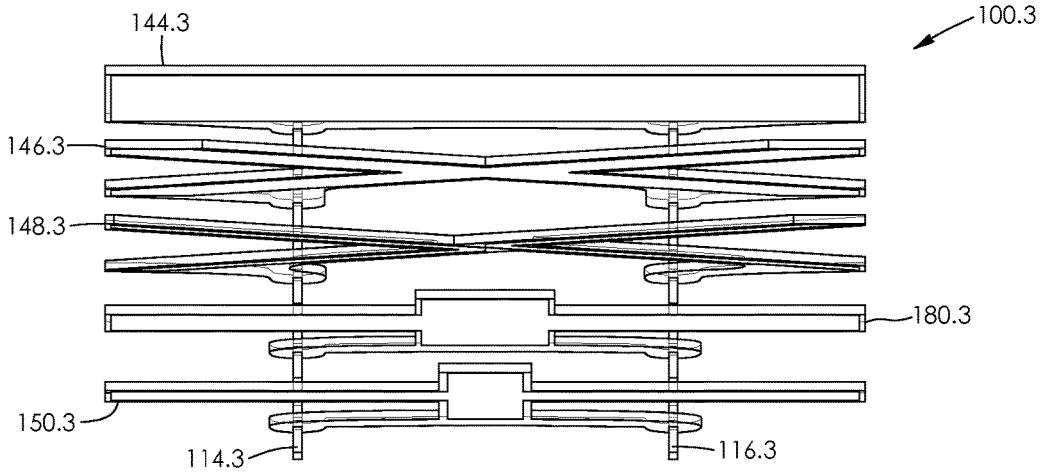
FIG. 38 is a top, front perspective view thereof.
Figure 39:
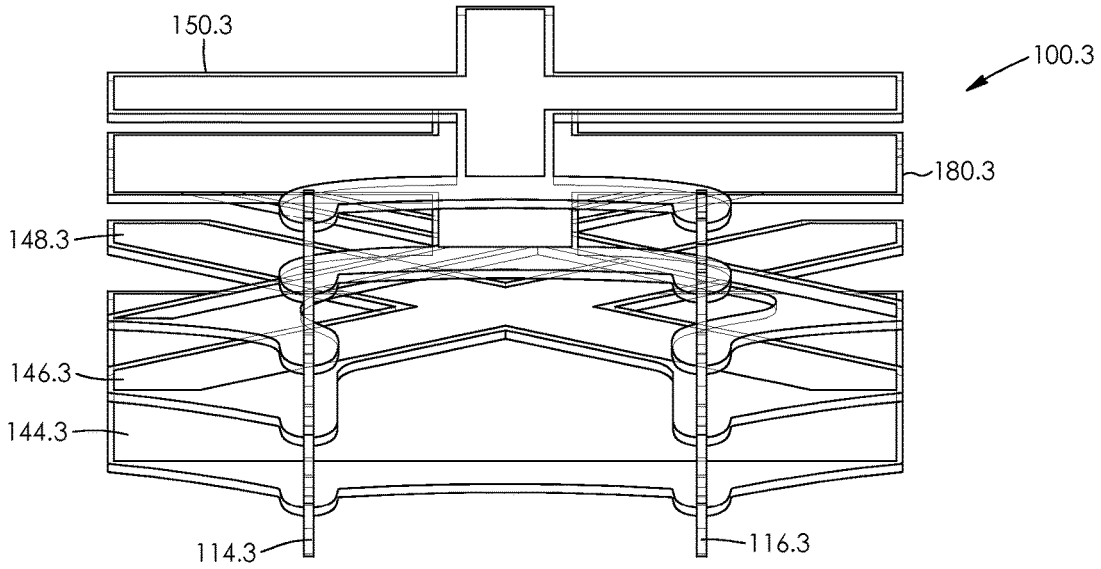
FIG. 39 is a bottom, front perspective view thereof.
Figure 40:
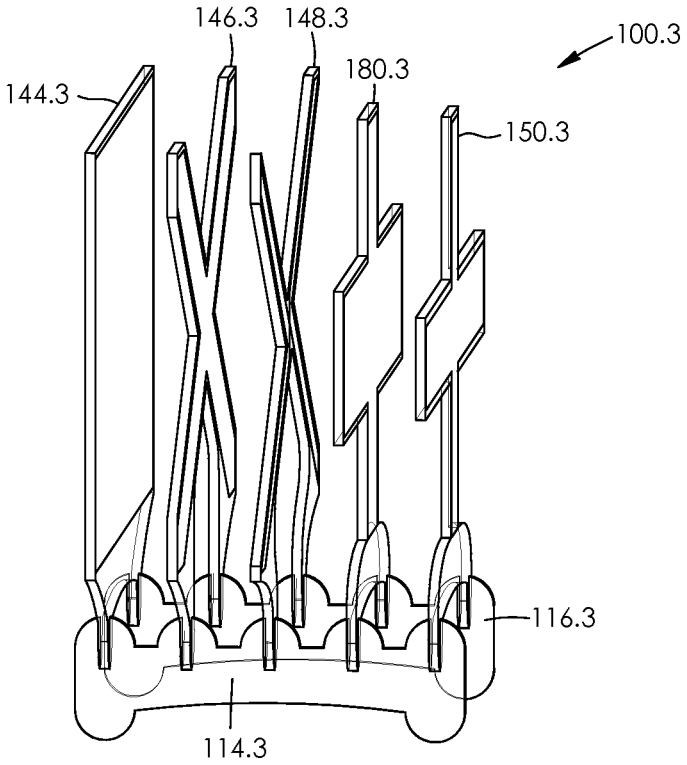
FIG. 40 is a left side elevation view thereof.
Figure 41:
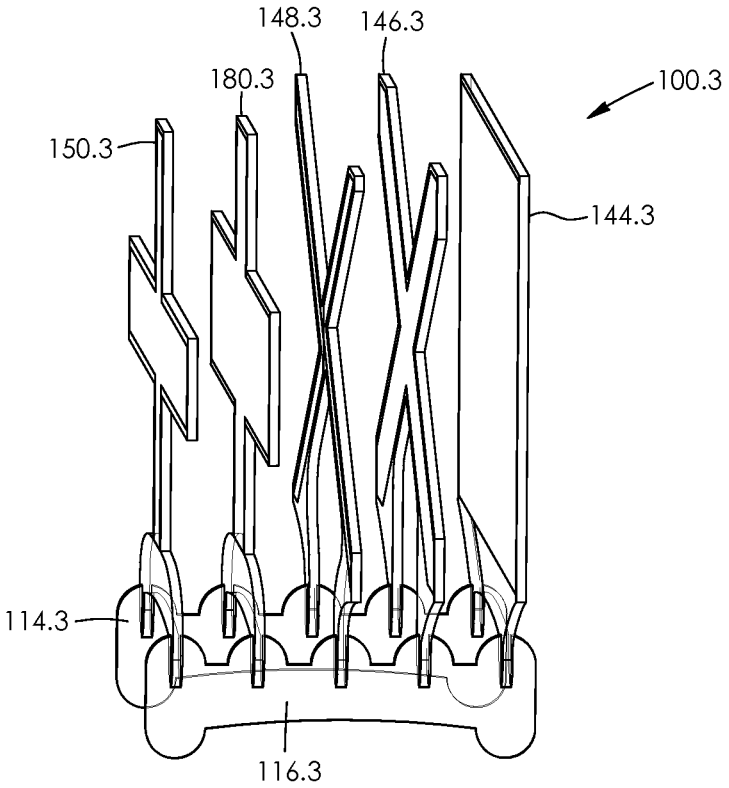
FIG. 41 is a right side elevation view thereof.
Figure 42:
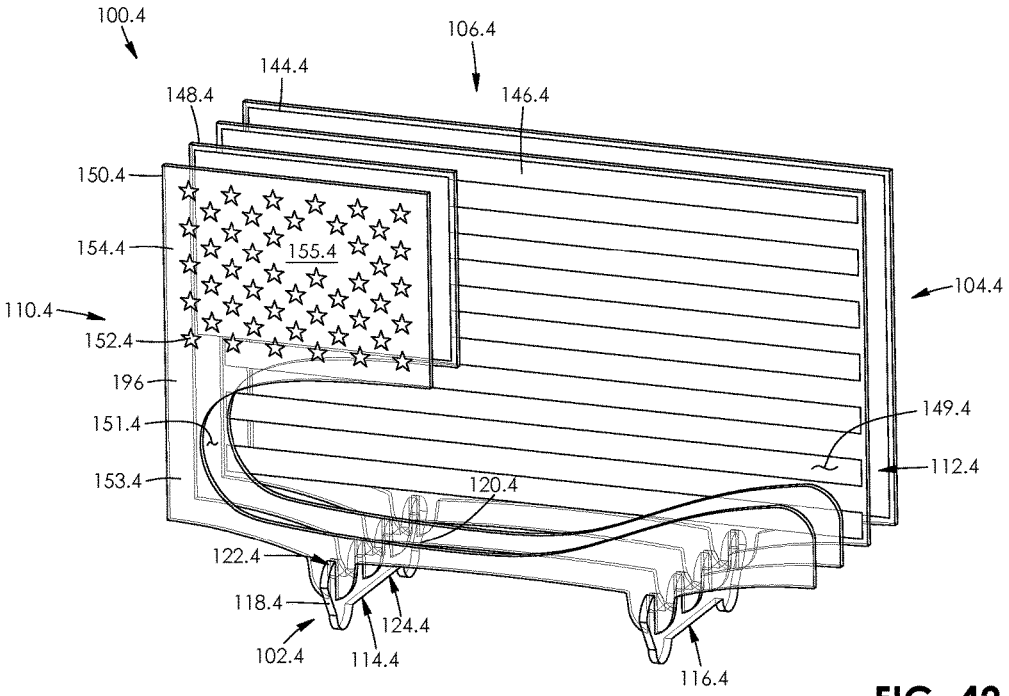
FIG. 42 is a front, right side perspective view of a display assembly according to a fifth aspect, the display assembly including a pair of mounting members, a rear planar member, a pair of intermediate planar members and a front planar member.

Front planar member 150.3 has four rectangular cut-out portions 151.3 and conveys indicia 152.3 and shape in the form of an upright cross that is red. As seen in FIG. 35, intermediate planar member 180.3 has four rectangular cut-out portions 181.3 and conveys indicia 157 and shape in the form of an upright cross that is white. Referring back to FIG. 1, intermediate planar member 180.3 has a larger front area than the rest of the intermediate planar members 146.3 and 148.3 and front planar member 150.3 in this embodiment.

Figure 32:
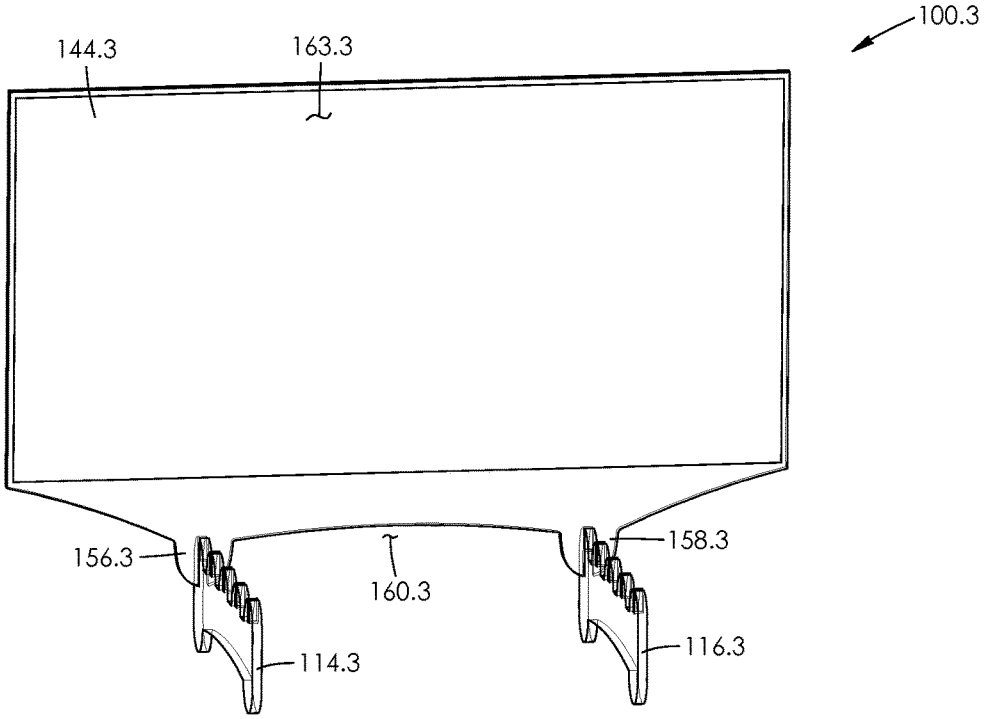
FIG. 32 is a front elevation view of the mounting members and the rear planar member of FIG. 31 mounted thereon.
Figure 33:
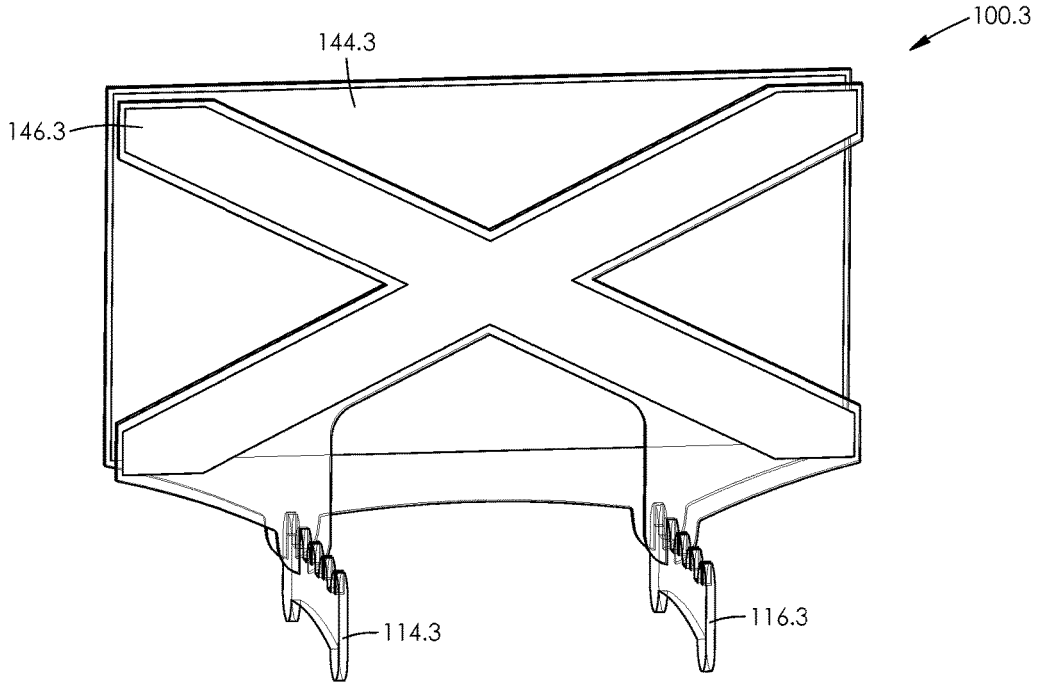
FIG. 33 is a front elevation view of the mounting members, and the rear planar member and a first of the intermediate planar members of FIG. 31 mounted thereon.
Figure 34:
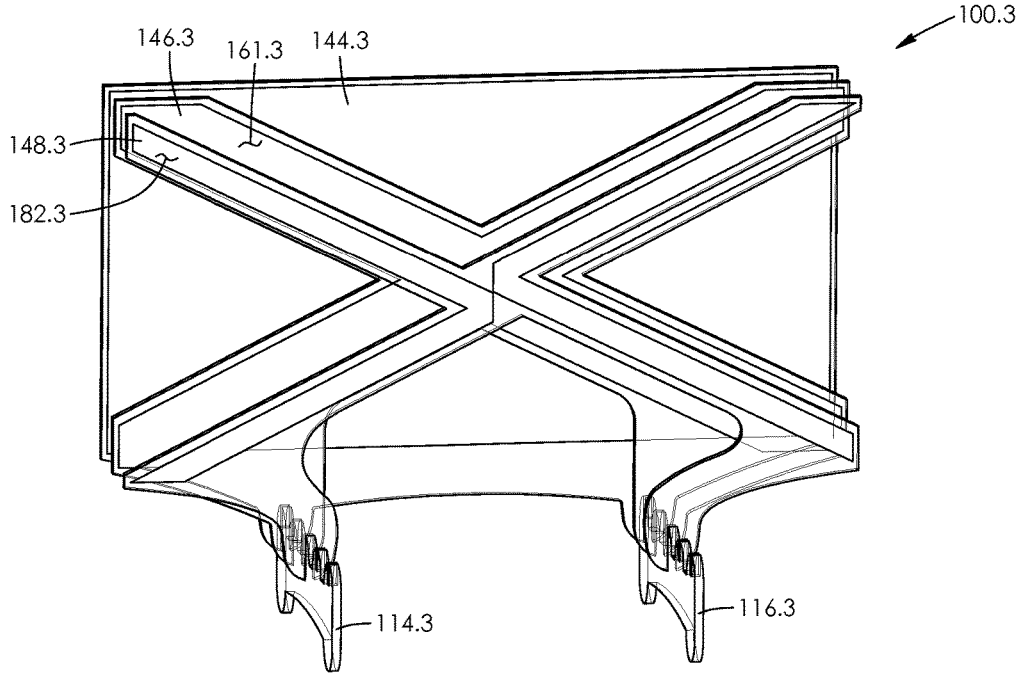
FIG. 34 is a front elevation view of the mounting members, and the rear planar member and the first and a second of the intermediate planar members of FIG. 31 mounted thereon.

As seen in FIG. 34, intermediate planar member 148.3 conveys indicia 182.3 and a shape in the form of a diagonally extending cross that is red. As seen in FIG. 35, intermediate planar member 146.3 has a larger front area compared to that of intermediate planar member 148.3 seen in FIG. 34, and conveys indicia 161 and a shape in the form of a diagonally extending cross that is white. As seen in FIG. 32, rear planar member 144.3 is generally rectangular in shape, has image indicia 163 in the form of a blue rectangle and has a front area that is larger than that of the rest of the planar members 146.3, 148.3, 180.3 and 150.3 in this embodiment.

FIGS. 42 to 51 show a display assembly 100.4 according to a fifth aspect. Like parts have like numbers and functions as the display assembly 100.3 shown in FIGS. 31 to 41 with decimal extension ".4" replacing decimal extension ".3" and being added for like parts not previously having decimal extensions. Display assembly 100.4 is the same as described for display assembly 100.3 shown in FIGS. 31 to 41 with at least the following exceptions.

In this example, display assembly 100.4 conveys the national flag of the United States of America, and comprises four planar members: rear planar member 144.4, first intermediate planar member 146.4, second intermediate planar member 148.4, and front planar member 150.4.

Figure 43:
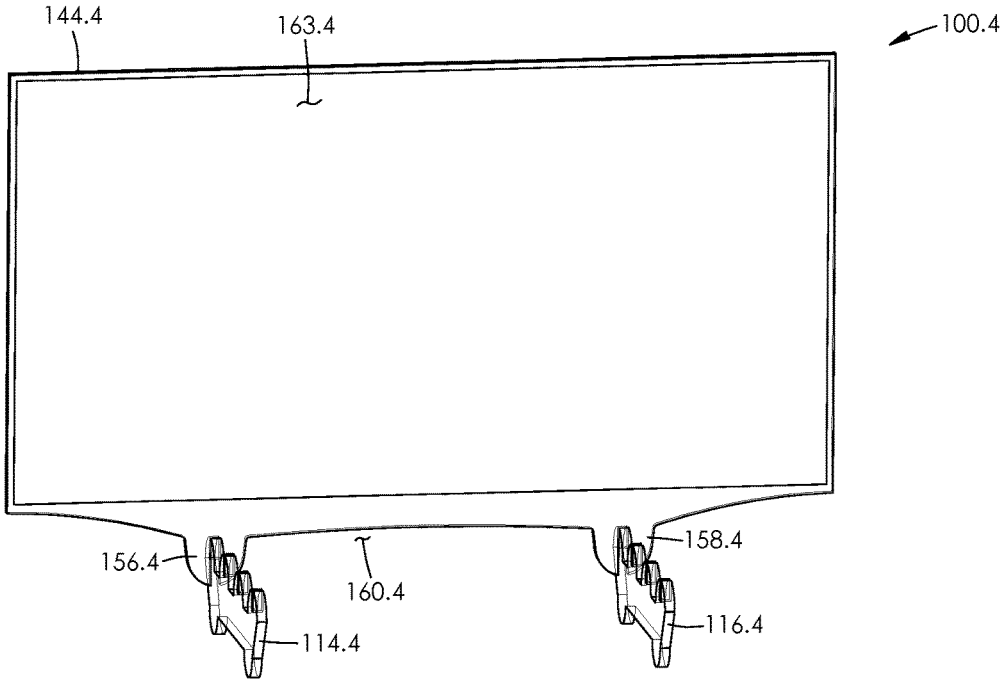
FIG. 43 is a front elevation view of the mounting members and the rear planar member of FIG. 42 mounted thereon.
Figure 44:
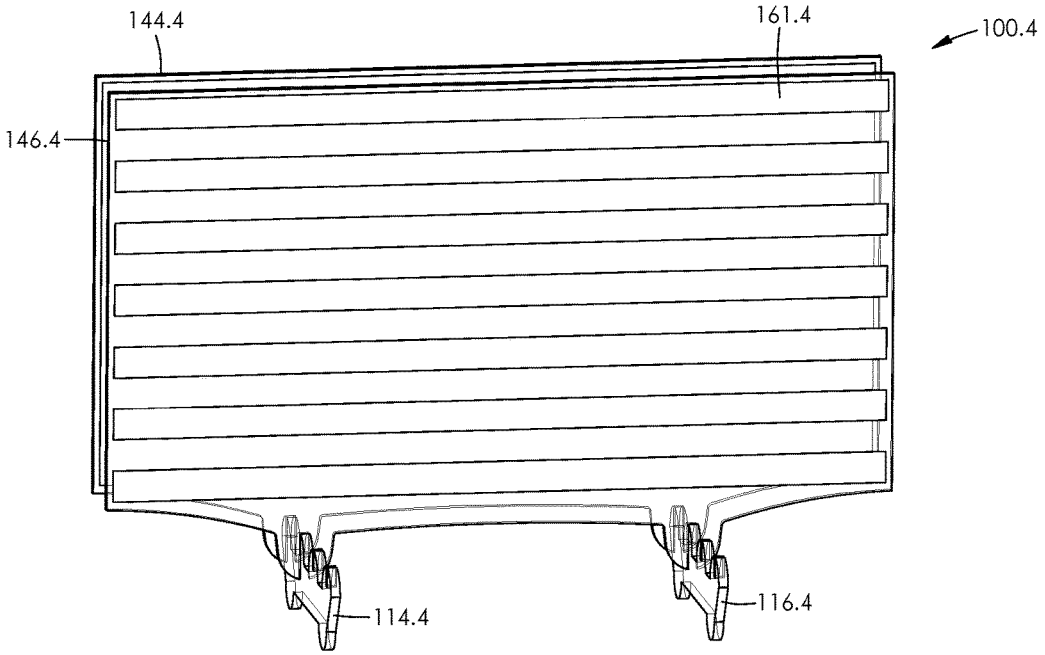
FIG. 44 is a front elevation view of the mounting members, and the rear planar member and a first of the intermediate planar members of FIG. 42 mounted thereon.

As seen in FIG. 43, the rear planar member 144.4 is generally rectangular in shape, has image indicia 163.4 in the form of a white rectangle and has a front area that is the same as that of intermediate planar member 146.4 seen in FIG. 44, and larger than that of planar members 148.4 and 150.4 in this embodiment seen in FIG. 43. Referring back to FIG. 44, intermediate planar member 146.4 has indicia 161.4 comprising a plurality of longitudinally-extending and vertically spaced-apart red rectangles with transparency therebetween.

Figure 45:
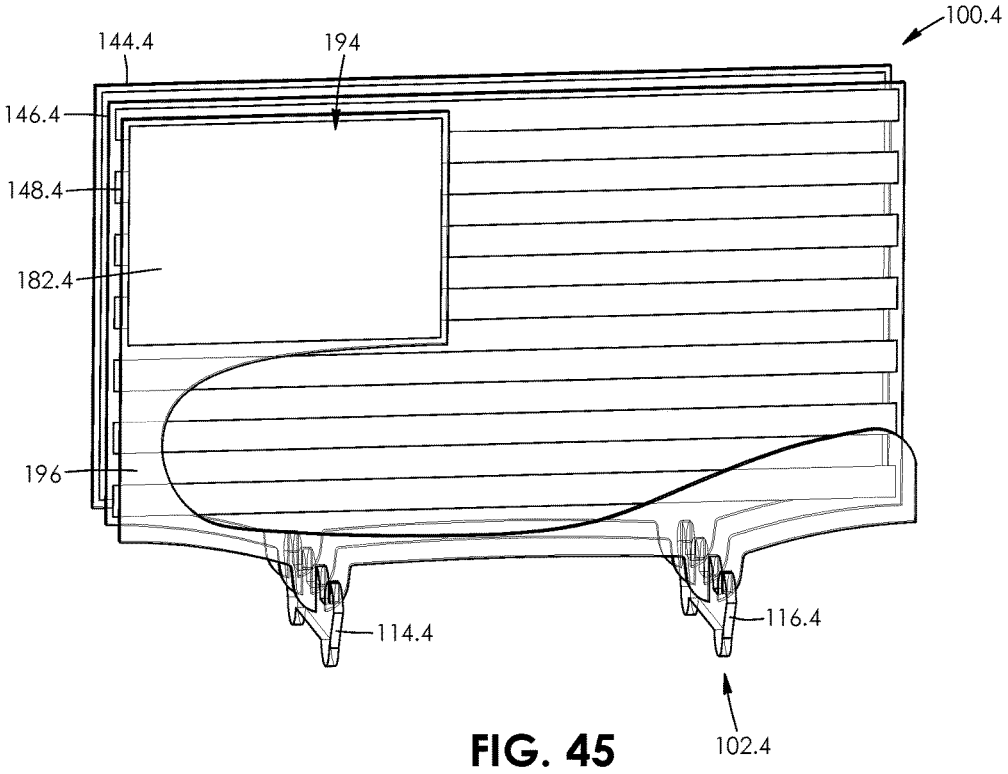
FIG. 45 is a front elevation view of the mounting members, and the rear planar member and both the intermediate planar members of FIG. 42 mounted thereon.

As seen in FIG. 45, intermediate planar member 148.4 has image indicia 182.4 in the form of a blue rectangle which is positioned in the top left corner region 194 of the assembly when viewed from the front 102.4. This is positioned in place via elongate connector in this example stem portion 196 of the planar member.

Figure 46:
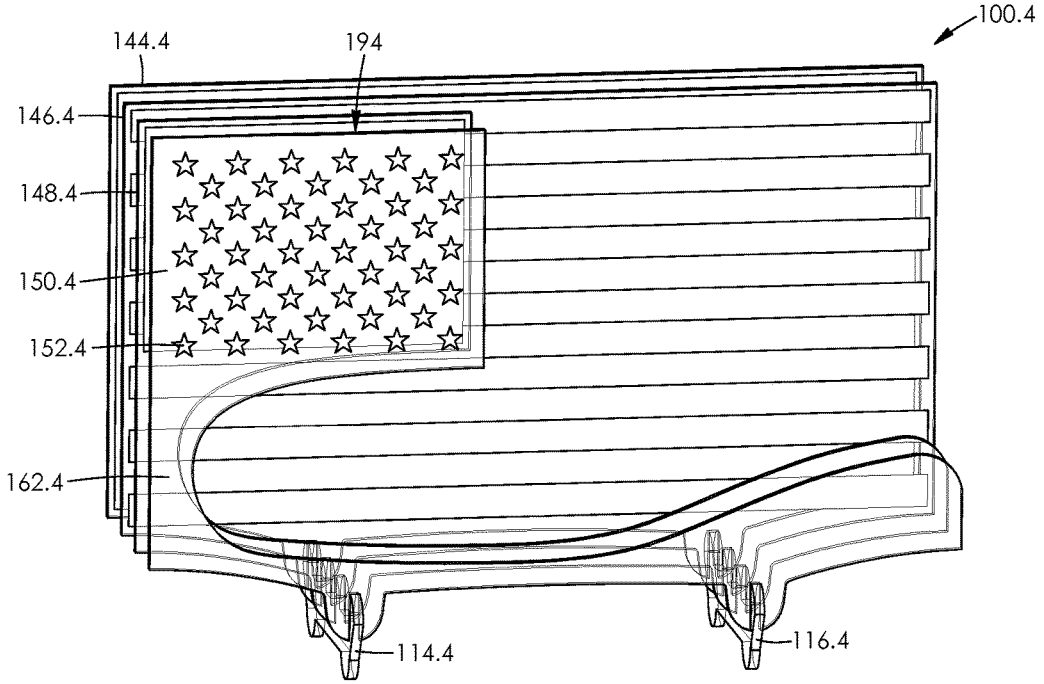
FIG. 46 is a front elevation view of the mounting members, and the rear planar member, the intermediate planar members and the front planar member of FIG. 42 mounted thereon.
Figure 47:
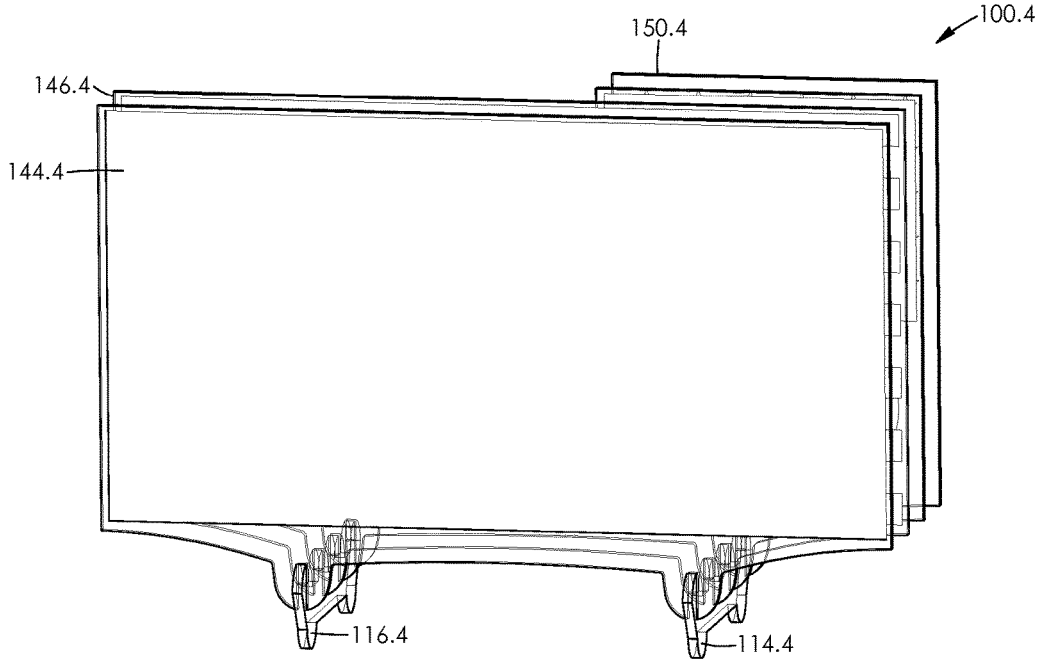
FIG. 47 is a rear elevation view of the assembly of FIG. 42.
Figure 48:
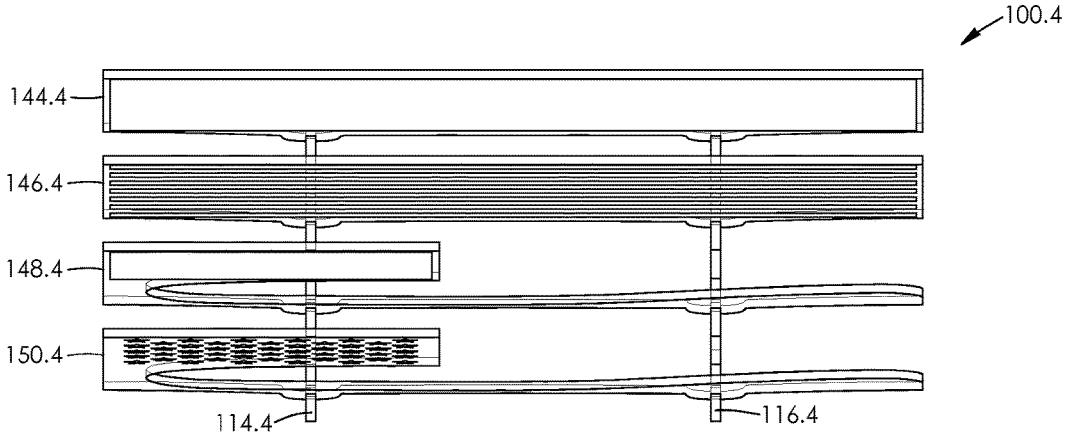
FIG. 48 is a top, front perspective view thereof.
Figure 49:
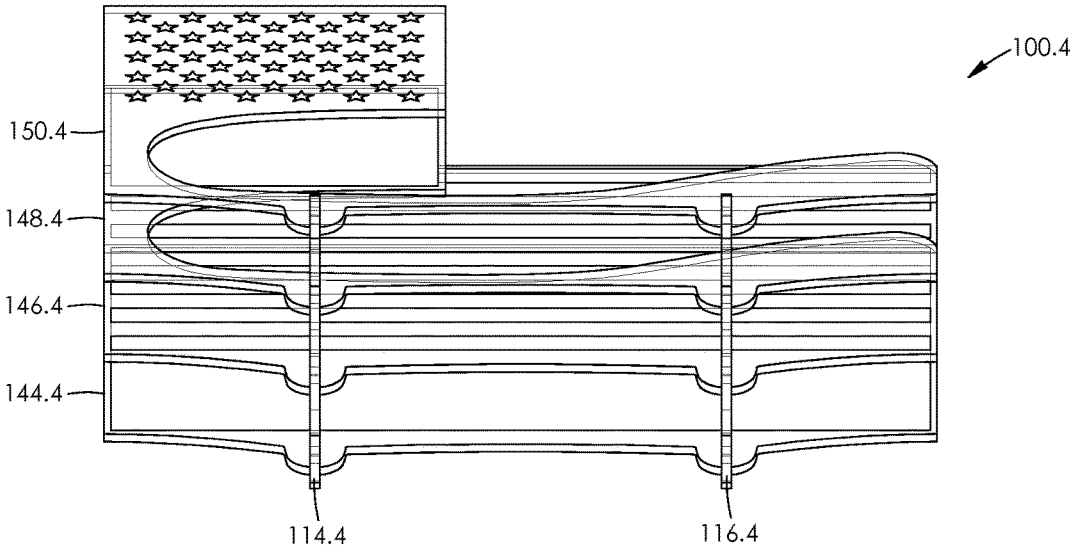
FIG. 49 is a bottom, front perspective view thereof.
Figure 50:
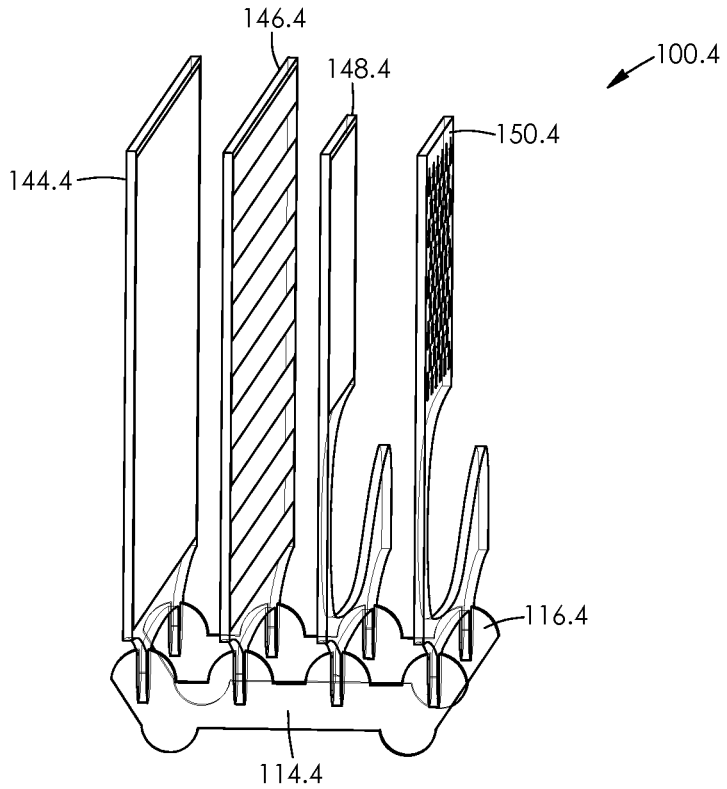
FIG. 50 is a left side elevation view thereof.
Figure 51:
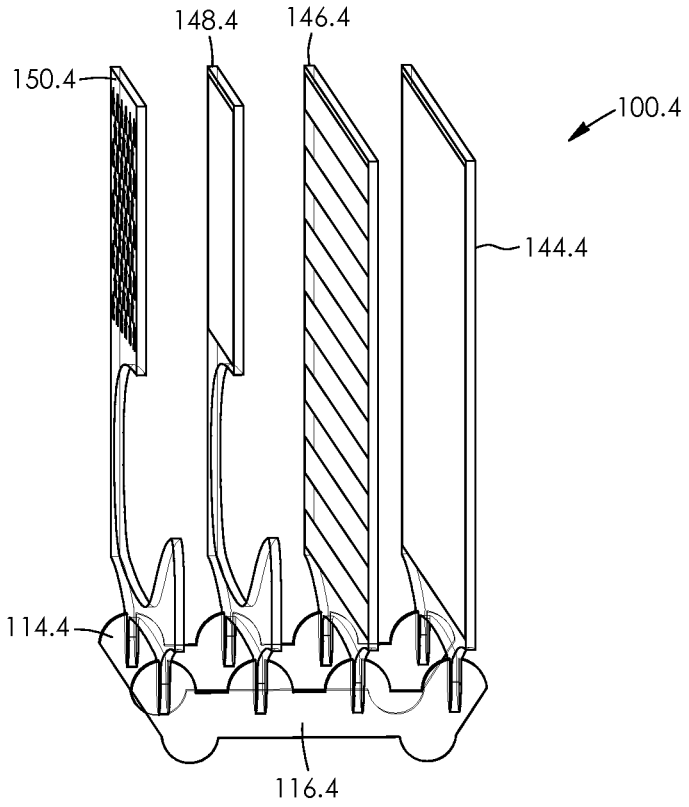
FIG. 51 is a right side elevation view thereof.
Figure 52:
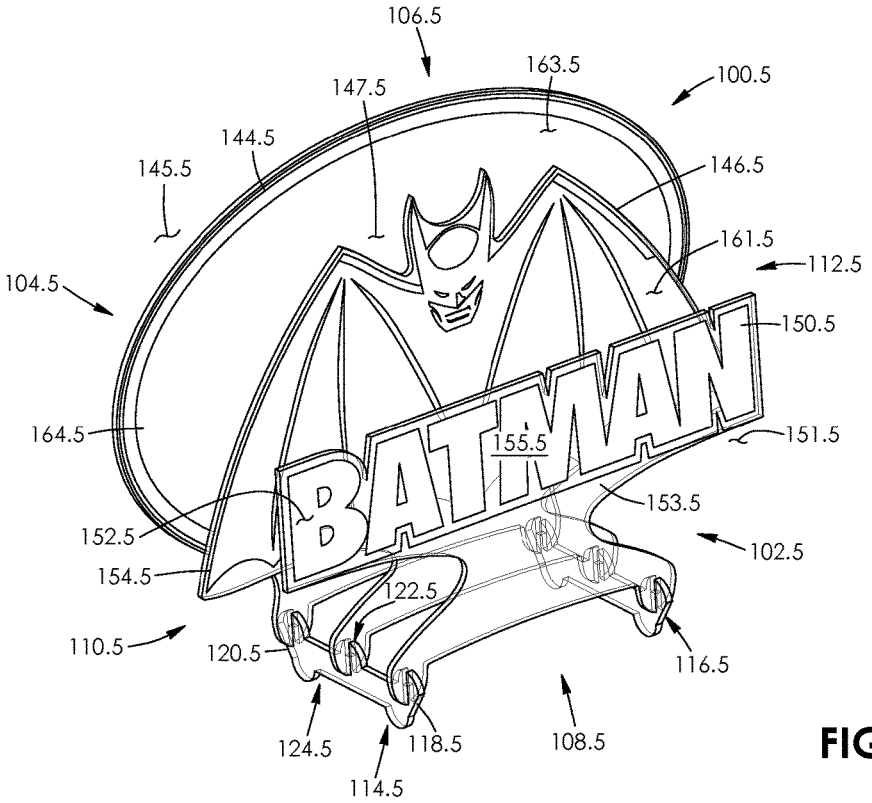
FIG. 52 is a front, left side perspective view of a display assembly according to a sixth aspect, the display assembly including a pair of mounting members, a rear planar member, an intermediate planar member and a front planar member.
Figure 53:
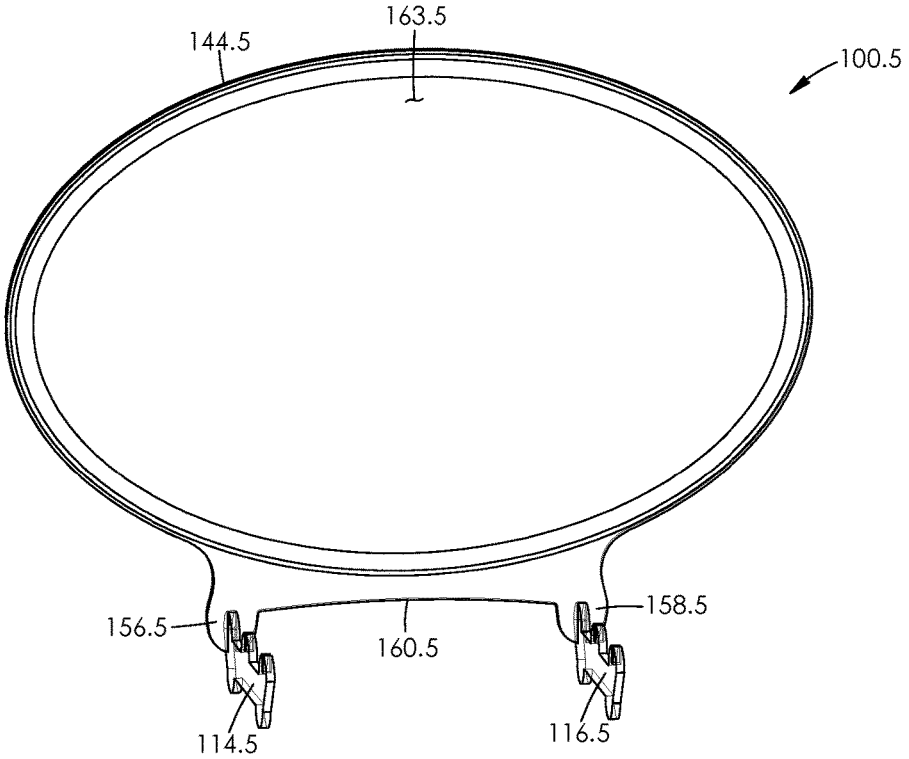
FIG. 53 is a front elevation view of the mounting members and the rear planar member of FIG. 52 mounted thereon.
Figure 54:
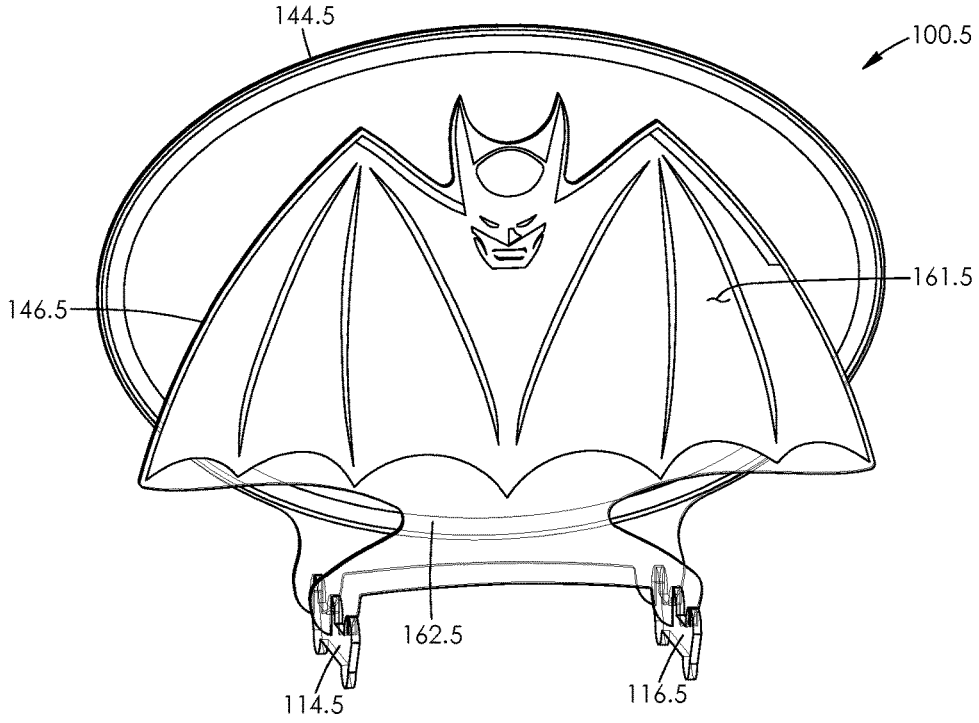
FIG. 54 is a front elevation view of the mounting members, and the rear planar member and the intermediate planar member of FIG. 52 mounted thereon.
Figure 55:
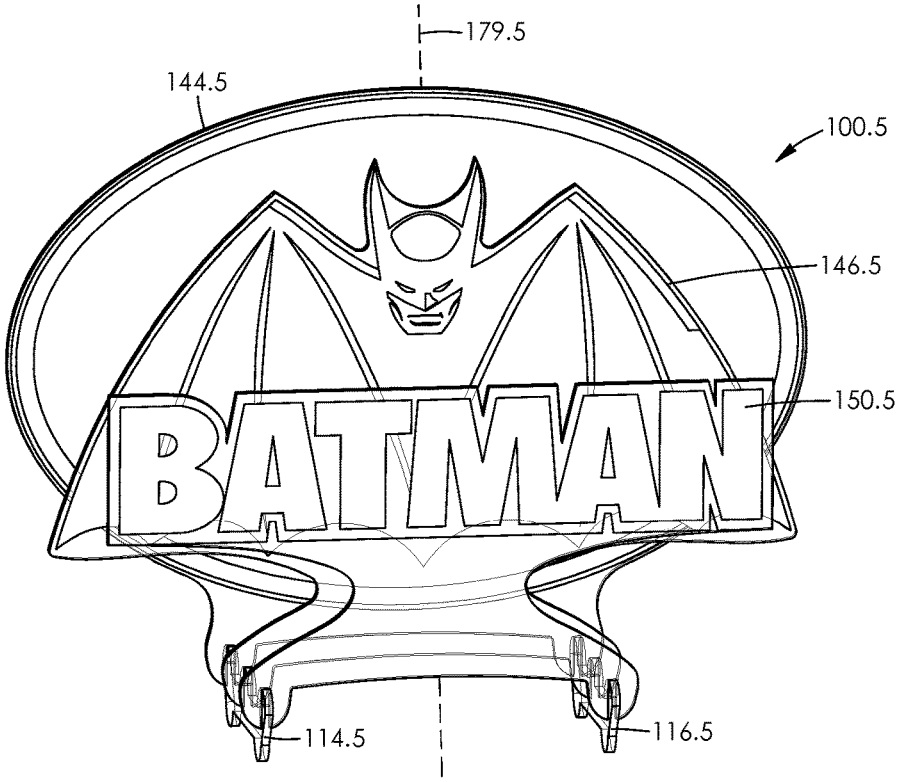
FIG. 55 is a front elevation view of the mounting members, and the rear planar member, the intermediate planar member and the front planar member of FIG. 52 mounted thereon.
Figure 56:
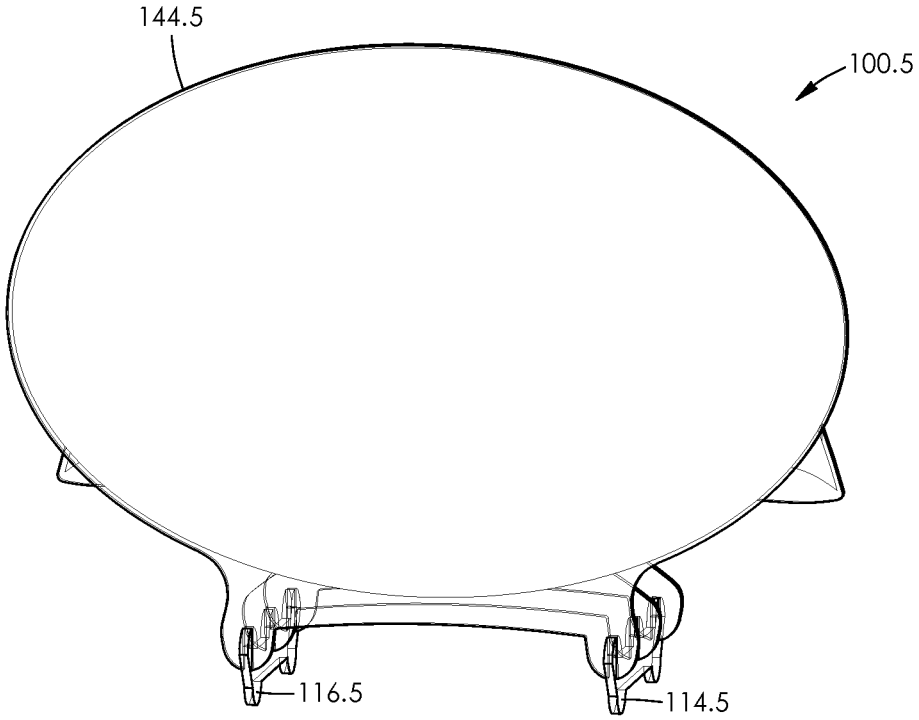
FIG. 56 is a rear elevation view of the assembly of FIG. 52.
Figure 57:
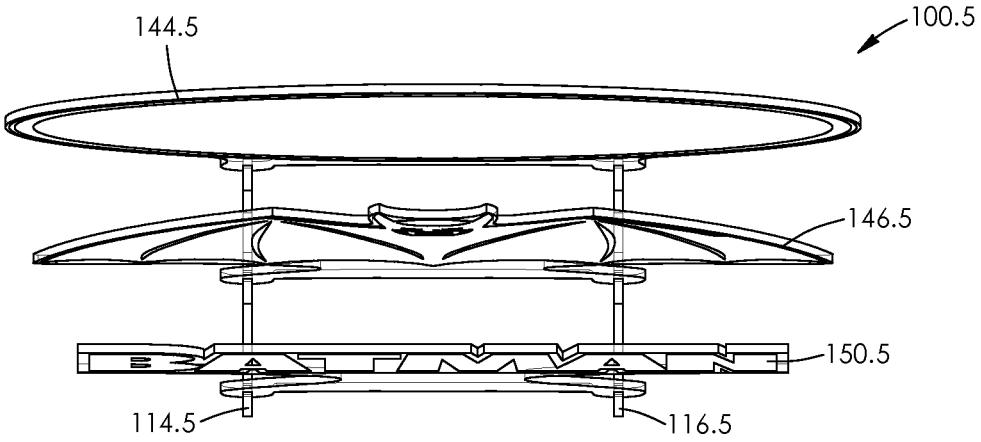
FIG. 57 is a top, front perspective view thereof.
Figure 58:
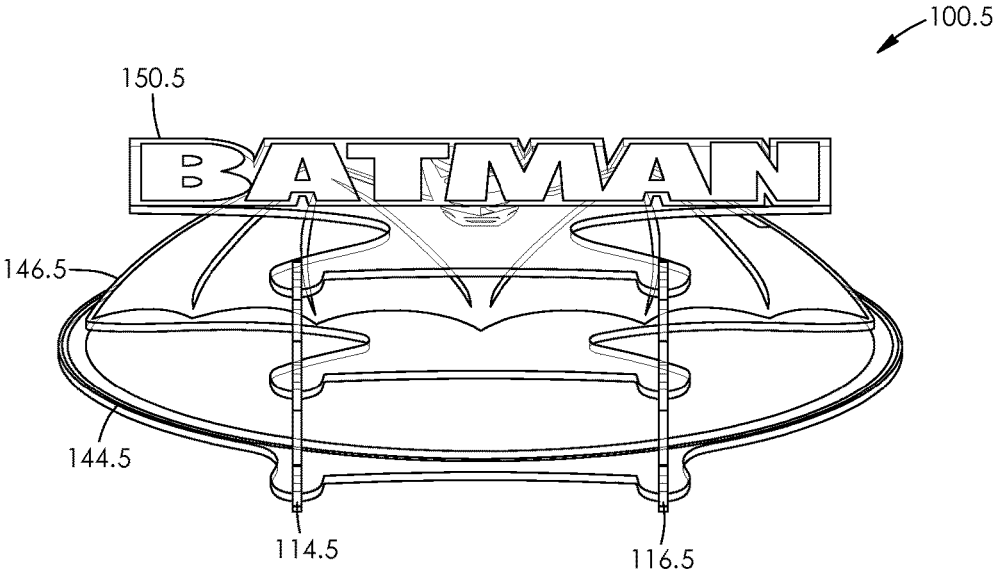
FIG. 58 is a bottom, front perspective view thereof.
Figure 59:
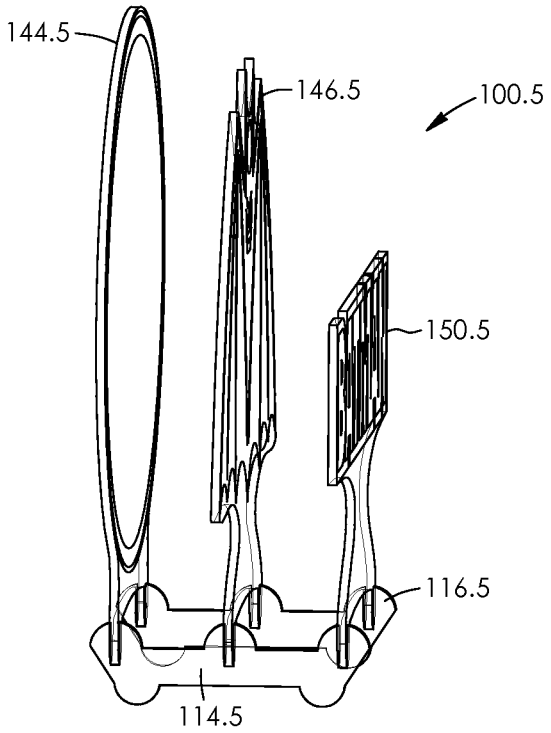
FIG. 59 is a left side elevation view thereof.
Figure 60:
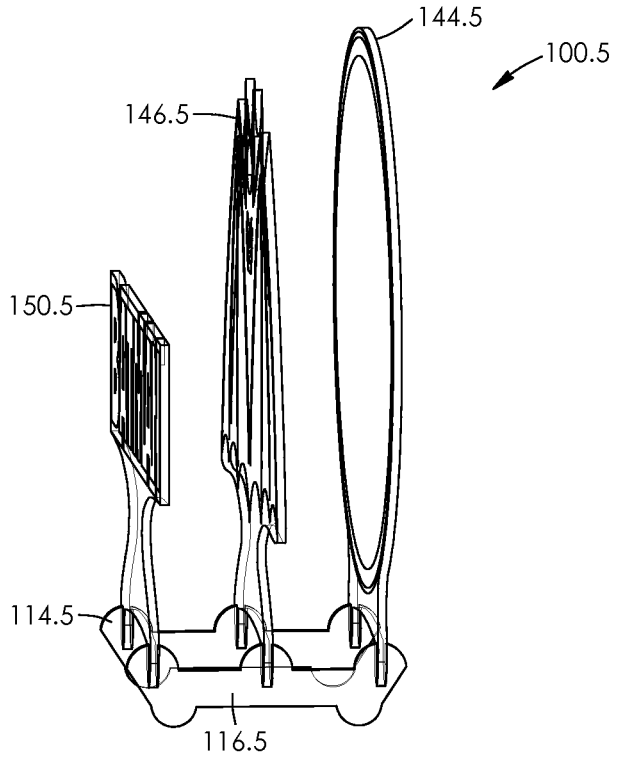
FIG. 60 is a right side elevation view thereof.
Figure 61:
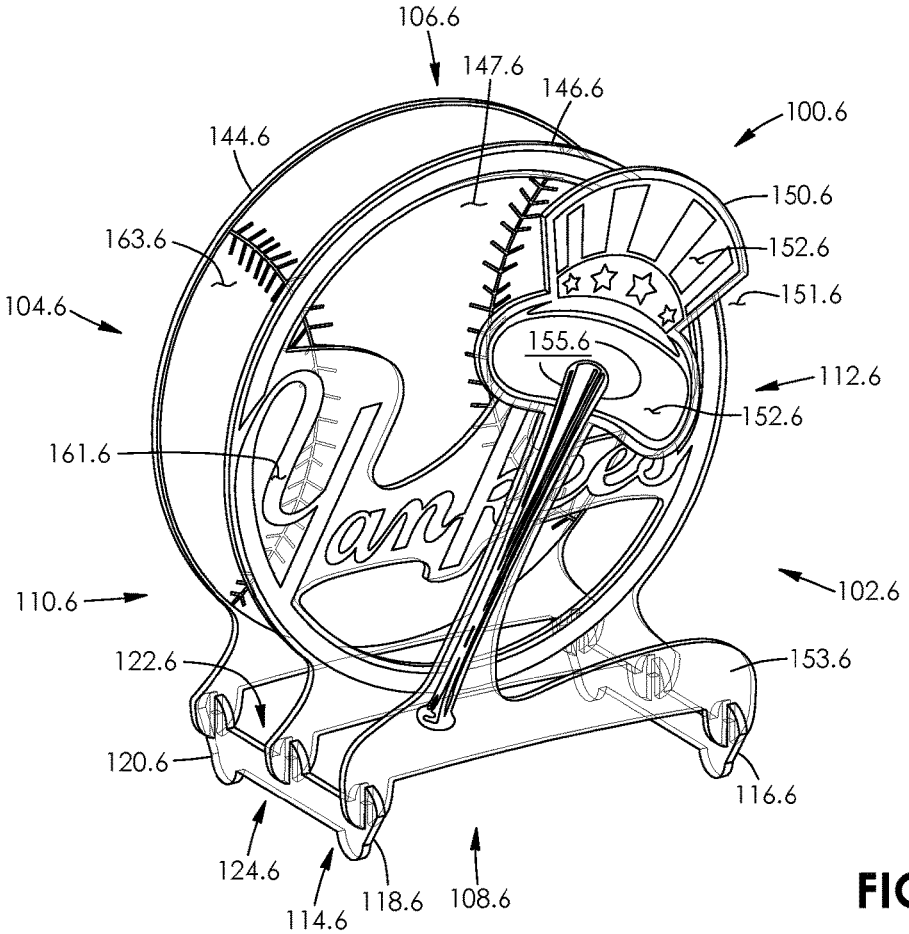
FIG. 61 is a front, left side perspective view of a display assembly according to a seventh aspect, the display assembly including a pair of mounting members, a rear planar member, an intermediate planar member and a front planar member.
Figure 62:
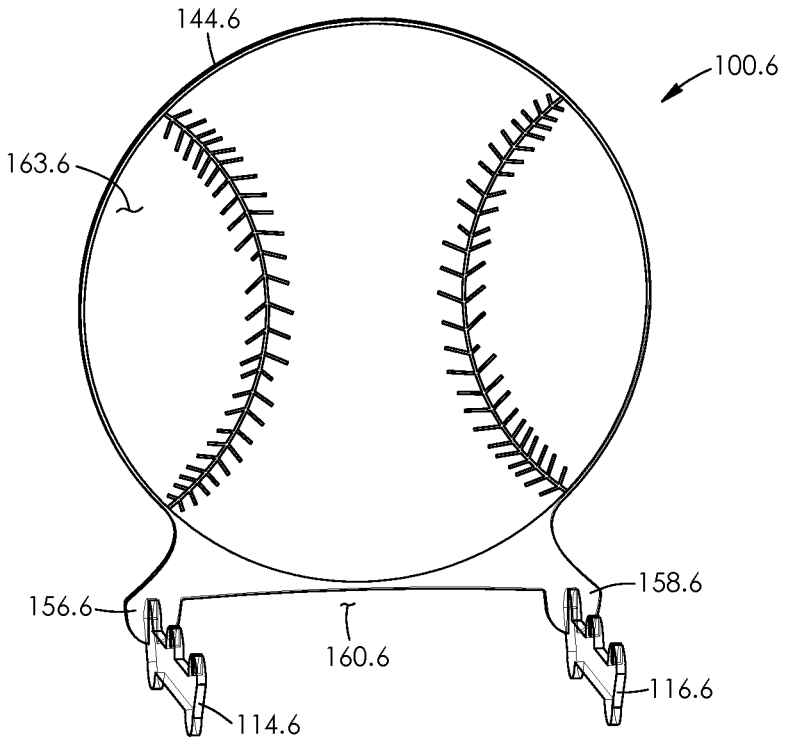
FIG. 62 is a front elevation view of the mounting members and the rear planar member of FIG. 61 mounted thereon.
Figure 63:
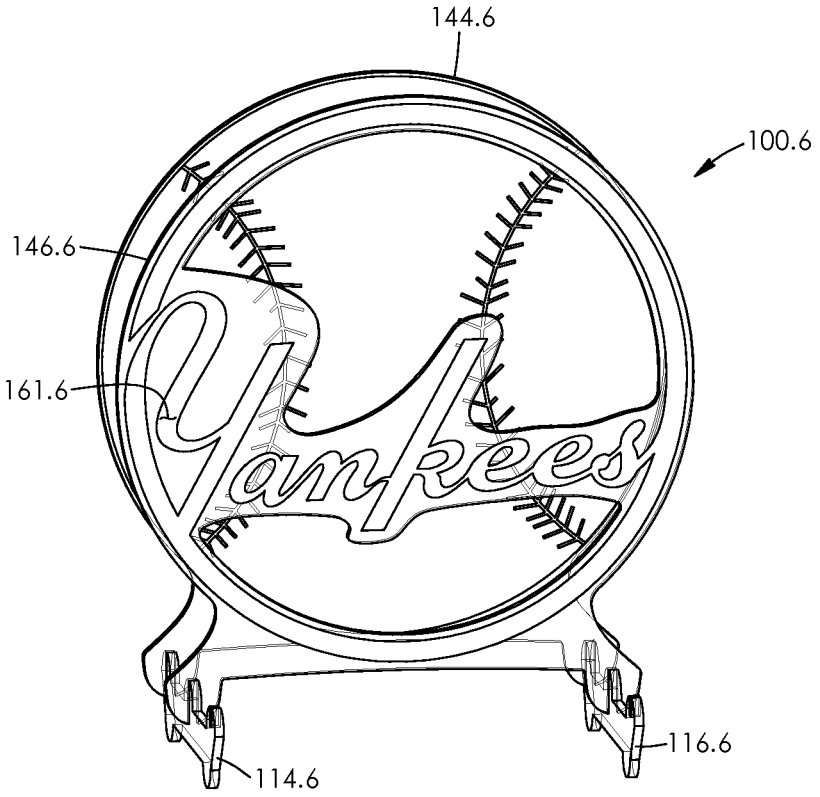
FIG. 63 is a front elevation view of the mounting members, and the rear planar member and the intermediate planar member of FIG. 61 mounted thereon.
Figure 64:
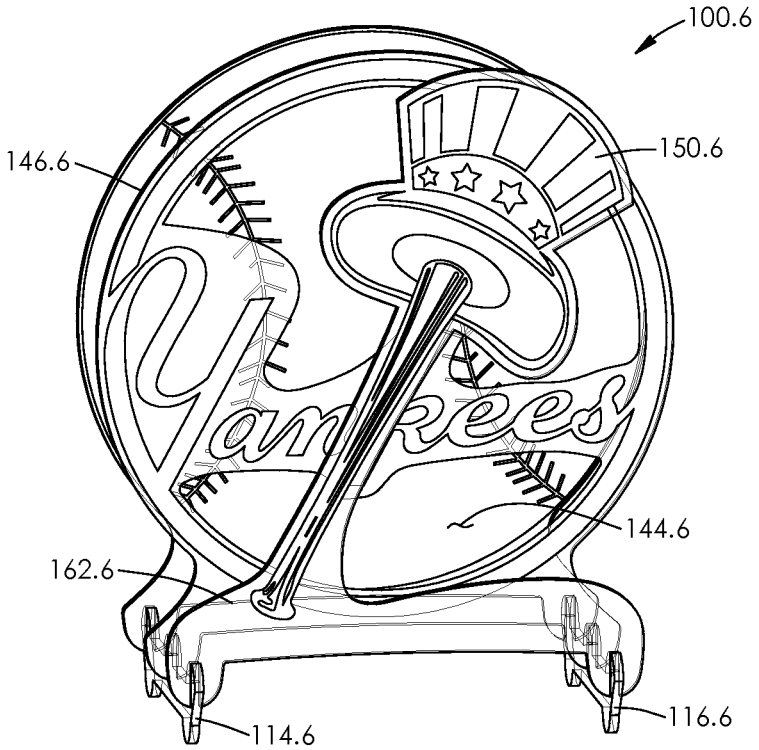
FIG. 64 is a front elevation view of the mounting members, and the rear planar member, the intermediate planar member and the front planar member of FIG. 61 mounted thereon.
Figure 65:
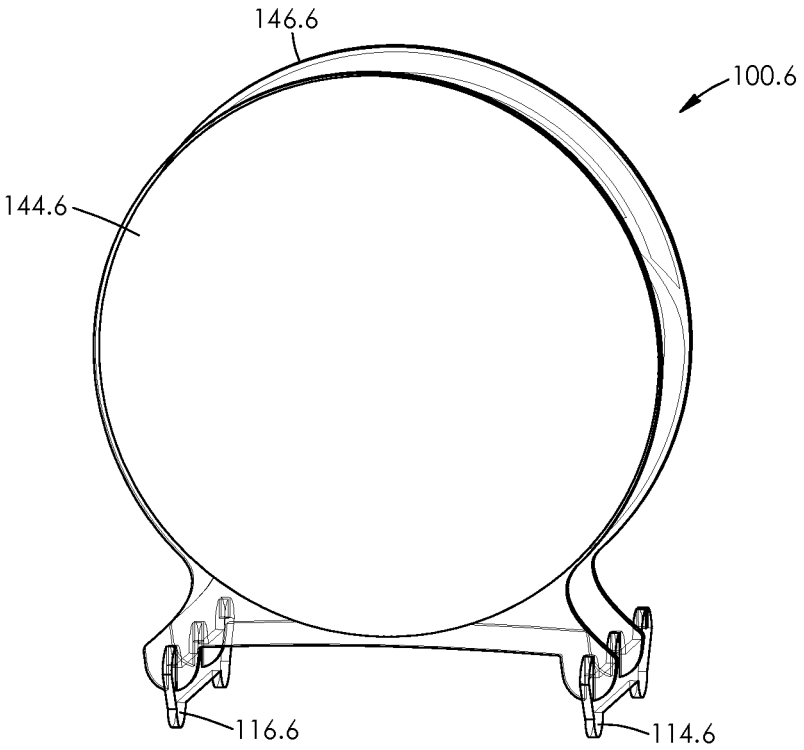
FIG. 65 is a rear elevation view of the assembly of FIG. 61.
Figure 66:
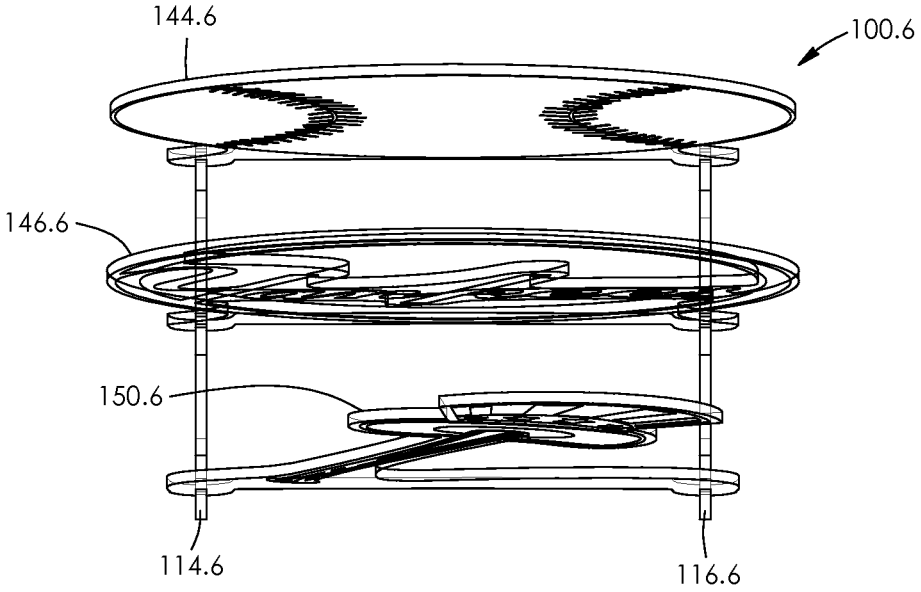
FIG. 66 is a top, front perspective view thereof.
Figure 67:
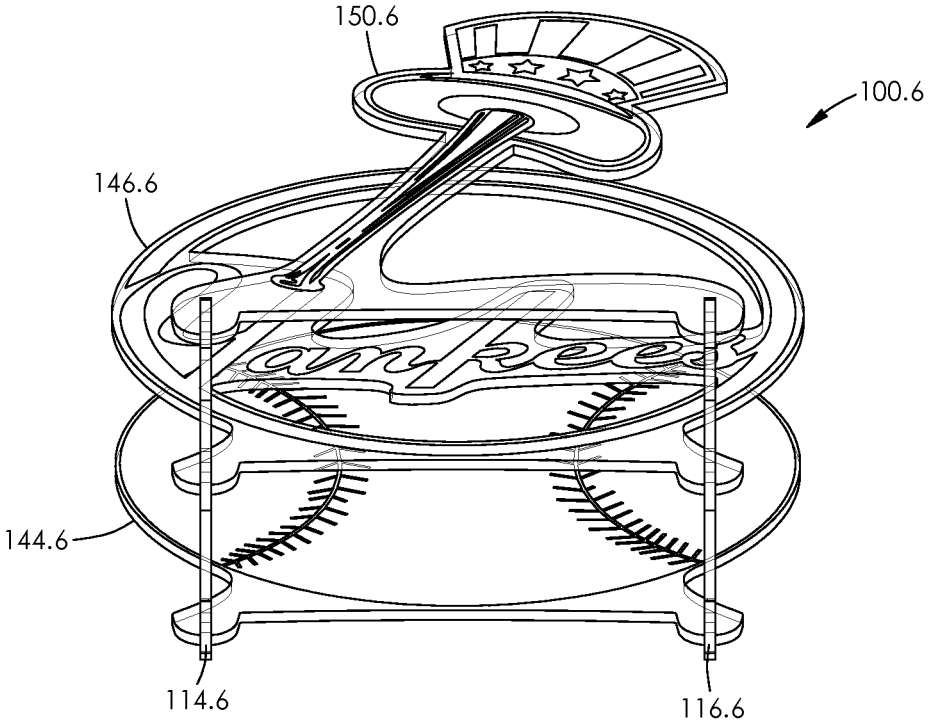
FIG. 67 is a bottom, front perspective view thereof.
Figure 68:
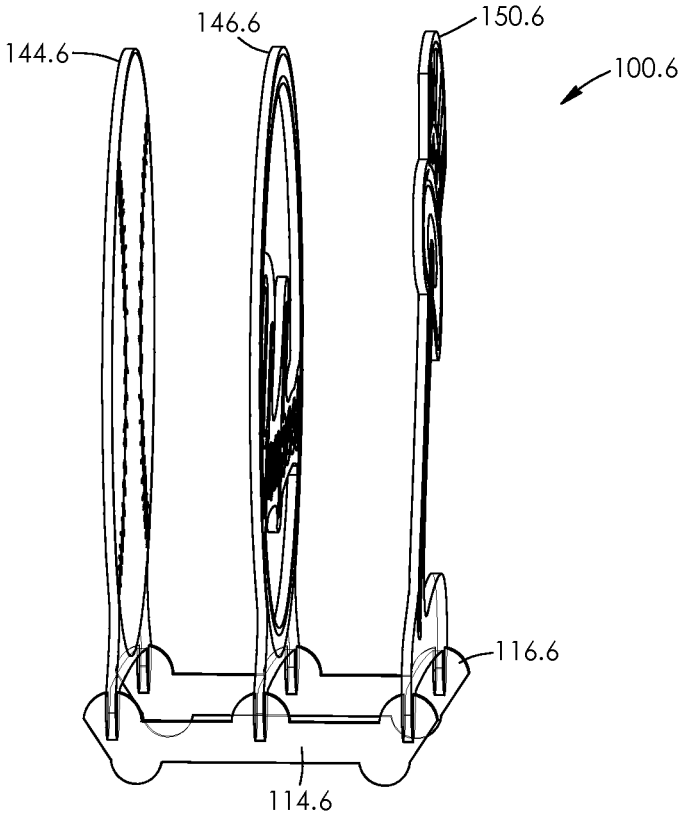
FIG. 68 is a left side elevation view thereof.
Figure 69:
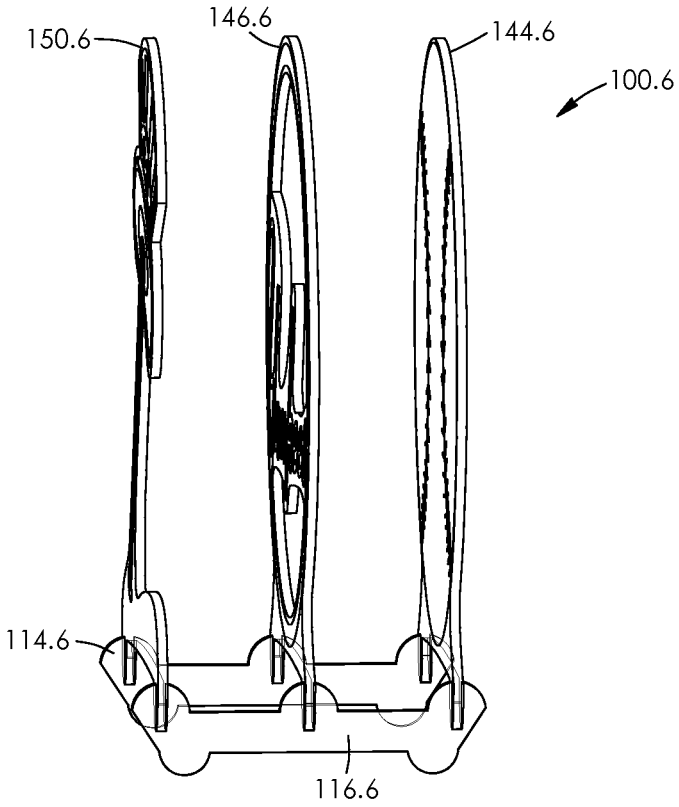
FIG. 69 is a right side elevation view thereof.
Figure 70:
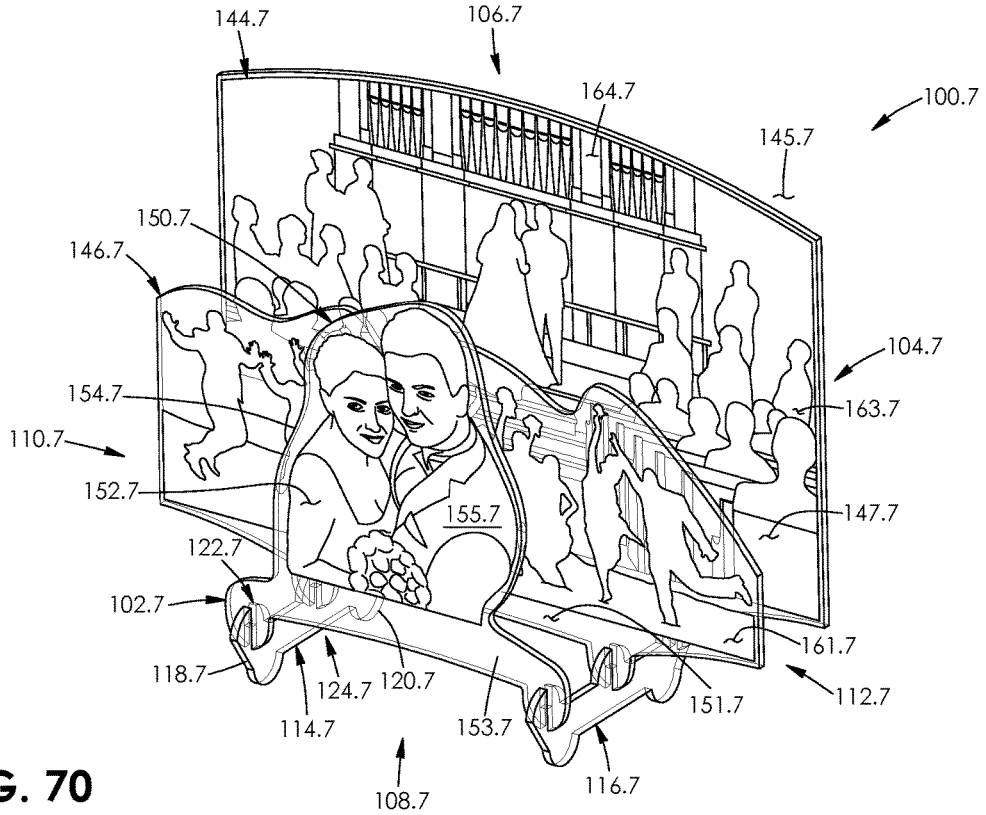
FIG. 70 is a front, right side perspective view of a display assembly according to an eighth aspect, the display assembly including a pair of mounting members, a rear planar member, an intermediate planar member and a front planar member.
Figure 71:
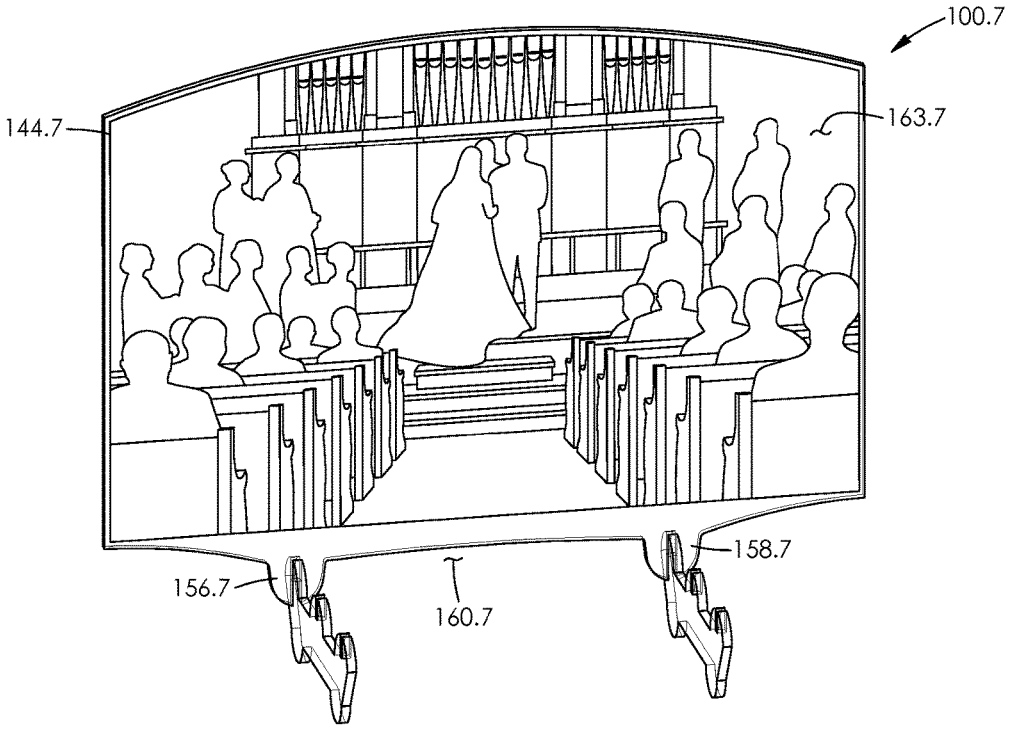
FIG. 71 is a front elevation view of the mounting members and the rear planar member of FIG. 70 mounted thereon.
Figure 72:
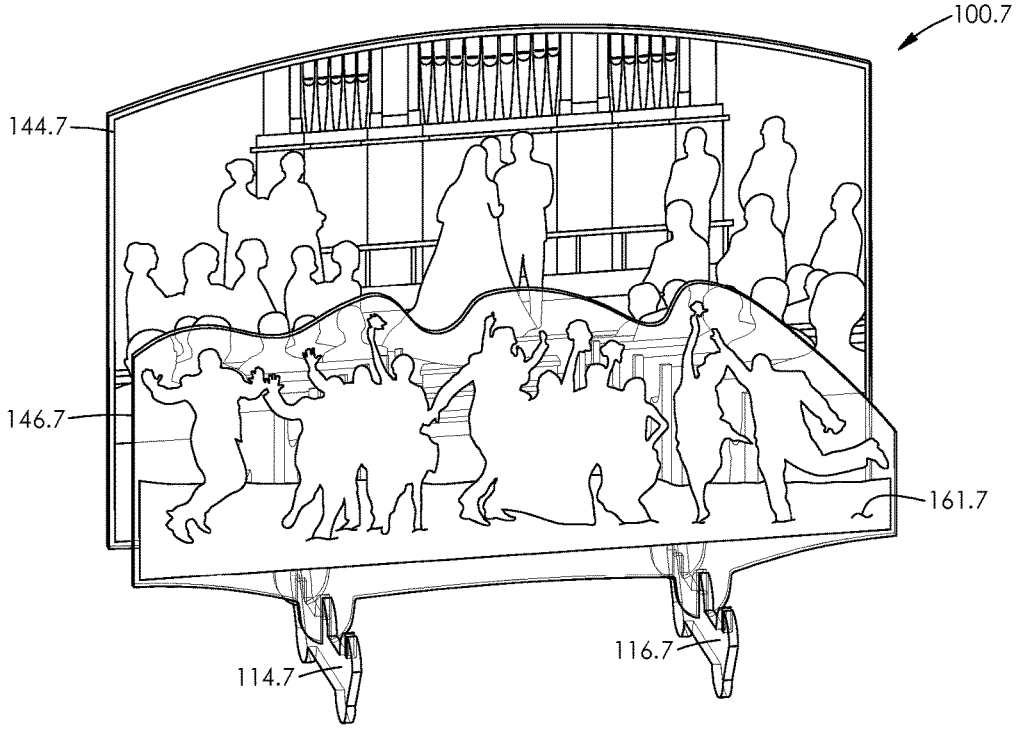
FIG. 72 is a front elevation view of the mounting members, and the rear planar member and the intermediate planar member of FIG. 70 mounted thereon.
Figure 73:
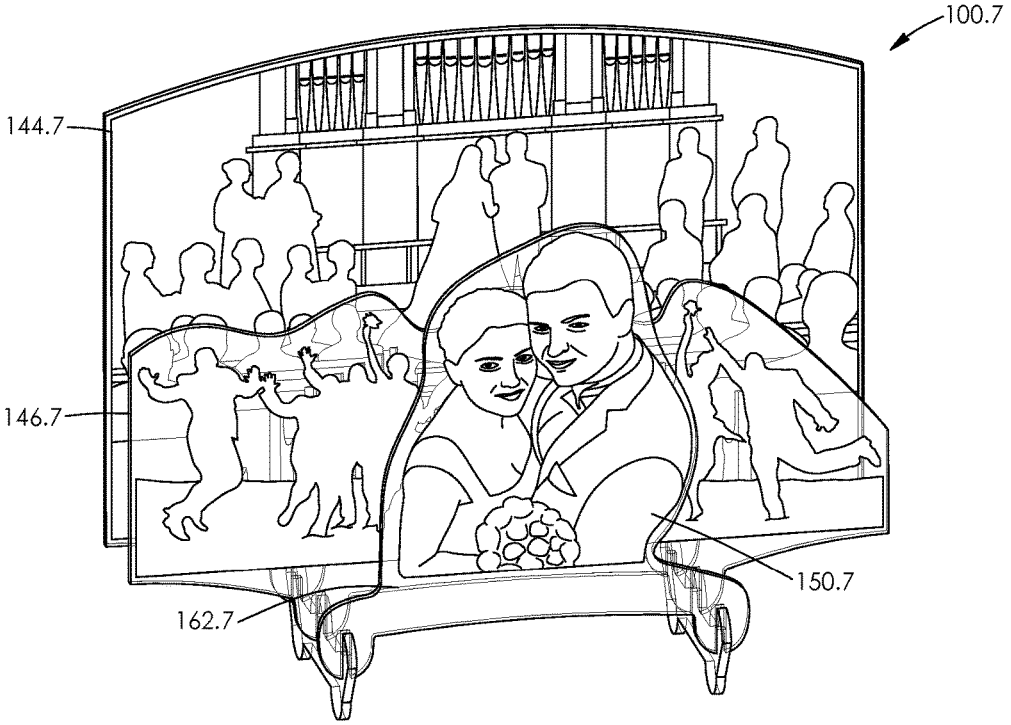
FIG. 73 is a front elevation view of the mounting members, and the rear planar member, the intermediate planar member and the front planar member of FIG. 70 mounted thereon.
Figure 74:
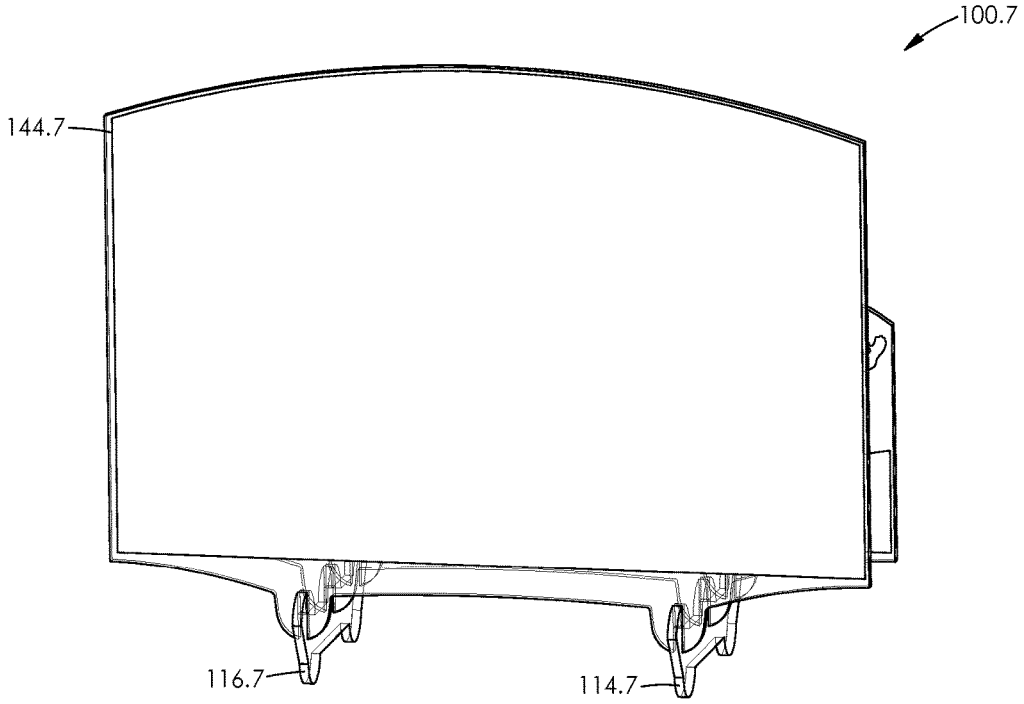
FIG. 74 is a rear elevation view of the assembly of FIG. 70.
Figure 75:
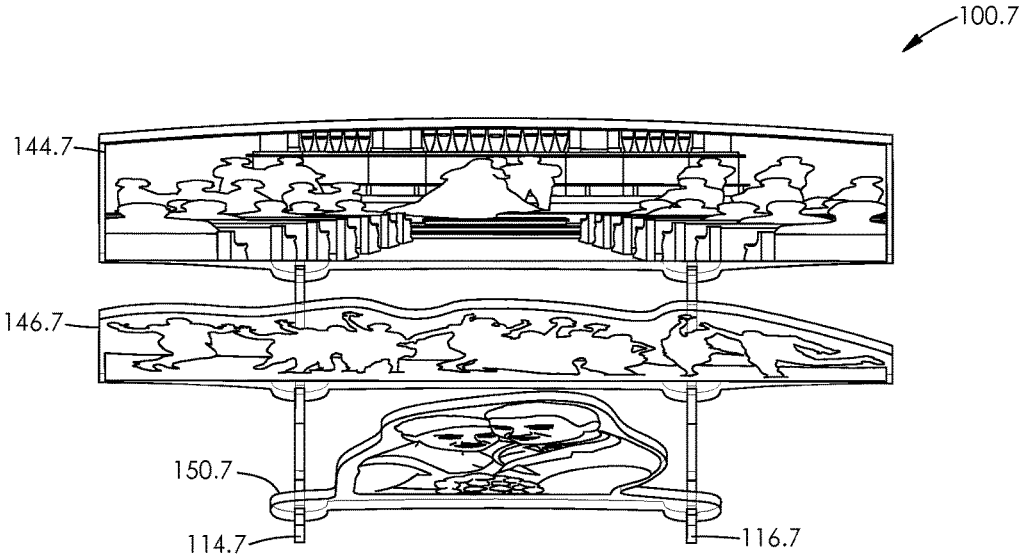
FIG. 75 is a top, front perspective view thereof.
Figure 76:
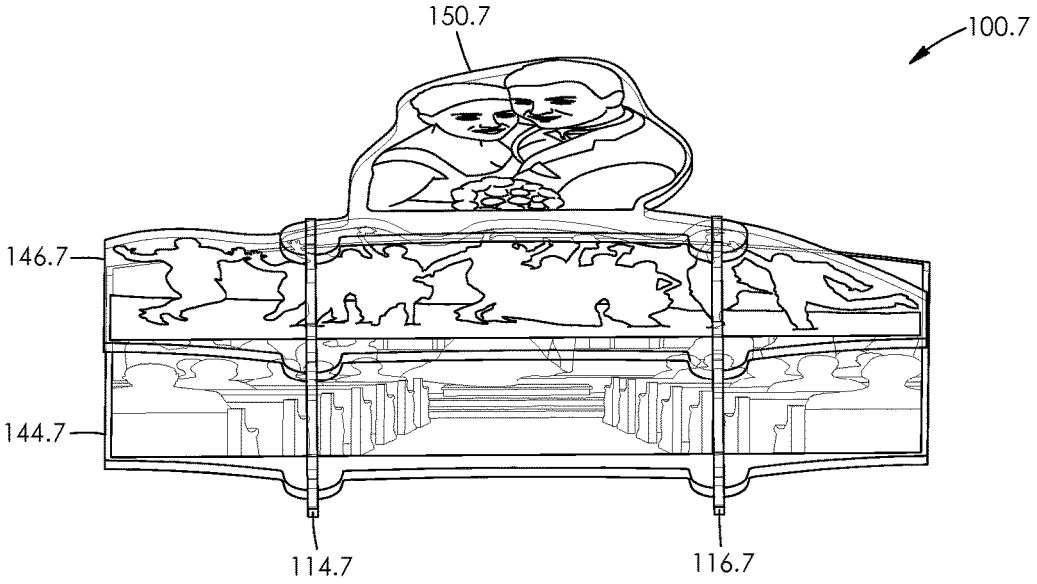
FIG. 76 is a bottom, front perspective view thereof.
Figure 77:
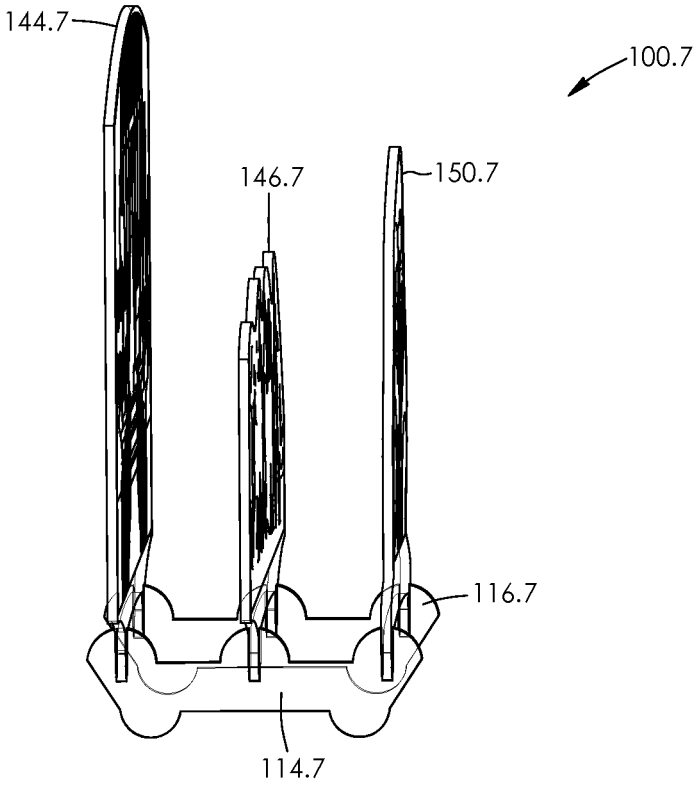
FIG. 77 is a left side elevation view thereof.
Figure 78:
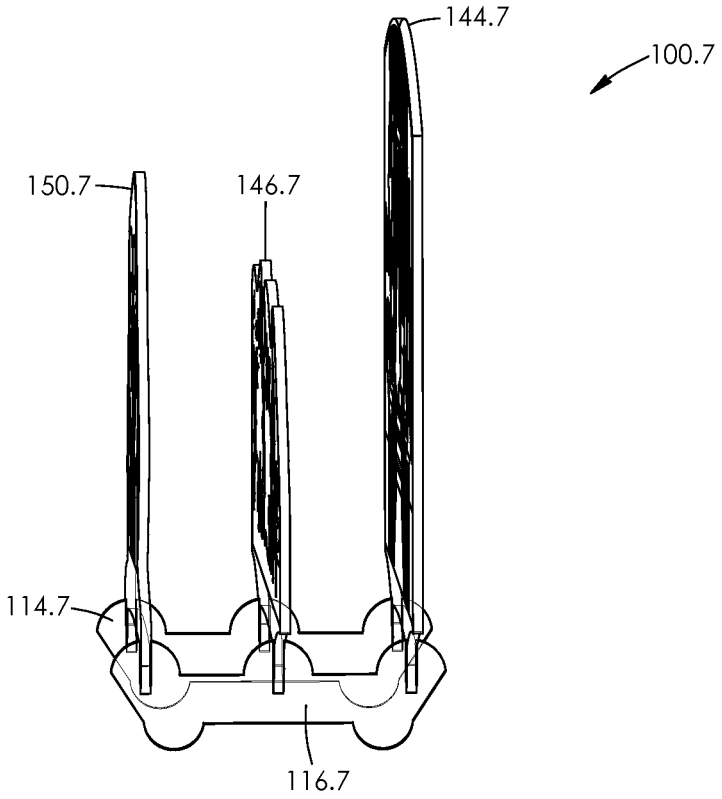
FIG. 78 is a right side elevation view thereof.

As seen in FIG. 46, front planar member 150.4 has a cut-out shape substantially the same as that of intermediate planar member 148.4 in this example. The front planer member has image indicia 152.4 in the form of a plurality of spaced-apart starts shown in white and positioned in the top left corner region 194 of the assembly when viewed from the front 102.4. This is positioned in place via stem portion 162.4 of the planar member.

FIGS. 52 to 60 show a display assembly 100.5 according to a sixth aspect. Like parts have like numbers and functions as the display assembly 100.4 shown in FIGS. 42 to 51 with decimal extension ".5" replacing decimal extension ".4" and being added for like parts not previously having decimal extensions. Display assembly 100.5 is the same as described for display assembly 100.4 shown in FIGS. 42 to 51 with at least the following exceptions.

In this example, display assembly 100.5 conveys a superhero image and logo, in this example an image and logo of Batman®. The assembly comprises three planar members: rear planar member 144.5, intermediate planar member 146.5, and front planar member 150.5.

Front planar member 150.5 is centrally located and has image indicia 152.5 thereon which recites BATMAN in red font outlined by black shading in this example. Intermediate planar member 146.5 has image indicia 161.5 thereon in the form of a graphic illustration of a portion of batman. Rear planar member 144.5 has a two-dimensional geographic shape in this example in the form of an oval and has image indicia 163.5 thereon which is primarily yellow in color with a red oval-shaped border in this example.

FIGS. 61 to 69 show a display assembly 100.6 according to a seventh aspect. Like parts have like numbers and functions as the display assembly 100.5 shown in FIGS. 52 to 60 with decimal extension ".6" replacing decimal extension ".5" and being added for like parts not previously having decimal extensions. Display assembly 100.6 is the same as described for display assembly 100.5 shown in FIGS. 52 to 60 with at least the following exceptions.

In this example, display assembly 100.6 conveys a sports logo, in this example that of the New York Yankees® baseball team. The assembly comprises three planar members: rear planar member 144.6, intermediate planar member 146.6, and front planar member 150.6.

Front planar member 150.6 is centrally located and has image indicia 152.6 and a shape in the form of an upwardly extending baseball bat shown in red and white, with a red, white and blue hat resting thereon. Intermediate planar member 146.6 is circular, with centrally located upper and lower cut-out portions 147.6, image indicia 161.6 thereon in the form of the wording YANKEES shown in red and a red border encircling the same. Rear planar member 144.6 has a two-dimensional geographic shape in this example in the form of a circle and has image indicia 163.6 thereon which is primarily white in color with red stitching to convey the image of a baseball in this example. In this case, the image indicia of the rear planar member is most visible or conspicuous and has a larger front area when viewed from the front of the assembly 100.6 compared to the image indicia of the other of the planar members.

FIGS. 70 to 78 show a display assembly 100.7 according to an eighth aspect. Like parts have like numbers and functions as the display assembly 100.6 shown in FIGS. 61 to 69 with decimal extension ".7" replacing decimal extension ".6" and being added for like parts not previously having decimal extensions. Display assembly 100.7 is the same as described for display assembly 100.6 shown in FIGS. 61 to 69 with at least the following exceptions.

In this example, display assembly 100.7 conveys a collage of wedding photos. The assembly in this example comprises three planar members: rear planar member 144.7, intermediate planar member 146.7, and front planar member 150.7.

Front planar member 150.7 is centrally located and has an image indicia 152.7 and shape in the form and outline of the married couple. Intermediate planar member 146.7 substantially along the bottom half of the assembly 100.7 and has a shape and image indicia 161.7 in the form of the wedding party jumping up in celebration. Rear planar member 144.7 has a front area that is a geometric shape, in this example, generally that of a rectangle. The front area of the rear planar member is largest in this example compared to that of planar members 146.7 and 150.7, and has image indicia 163.7 thereon in the form of the wedding ceremony itself in a church in this example.

Assembly 100.7 is thus configured to be a custom-made product that is an alternative to traditional two-dimensional wedding photos. The assembly is configured to convey a three-dimensional wedding scene by displaying the most important wedding elements, namely: the ceremony location as shown on the rear planar member 144.7, the wedding party as shown on the intermediate planar member 146.7, and the bride and groom alone as shown on the front planar member 150.7.

Figure 79:
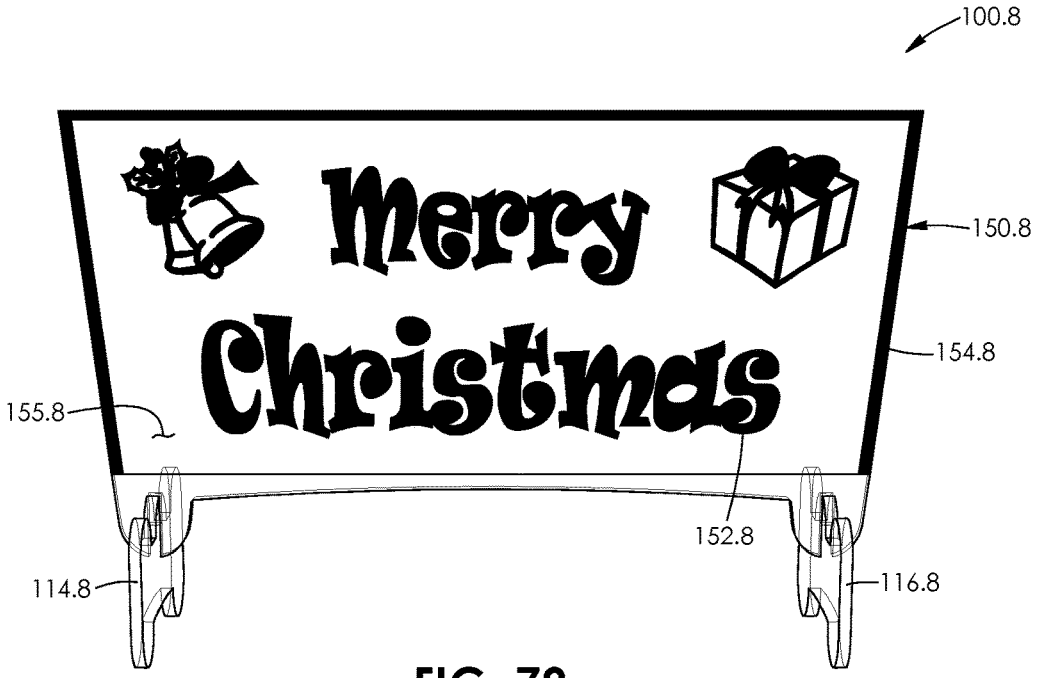
FIG. 79 is a front elevation view of a part of a display assembly according to a ninth aspect.

FIG. 79 shows part of a display assembly 100.8 according to a ninth aspect. Like parts have like numbers and functions as the display assembly 100 shown in FIGS. 1 to 10 with decimal extension ".8" being added for like parts not previously having decimal extensions. Display assembly 100.8 is the same as described for display assembly 100 shown in FIGS. 1 to 10 with at least the following exceptions.

In this embodiment, monochrome indicia and engraving are used for the assembly. Instead of printing or decals, the laser is used to engrave the acrylic surface. Then, applied edge lighting makes the engraved areas glow. In a like manner as described above, a plurality of spaced-apart additional planar members may be aligned via mounting members 114.8 and 116.8 so as to convey a three-dimensional effect as described previously in the above embodiments, for example.

Figure 80:
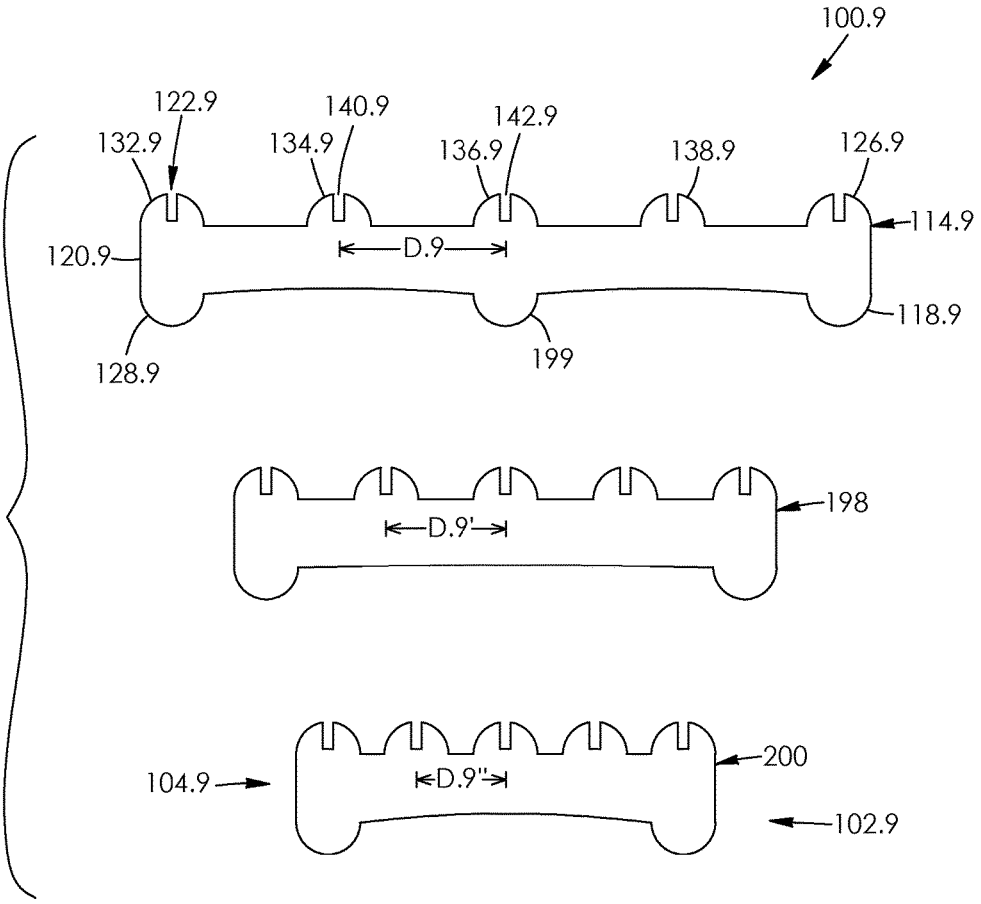
FIG. 80 is a side perspective view of a set of mounting members for a display assembly according to a tenth aspect.

FIG. 80 shows a set of mounting members 114.9, 198, and 200 for a display assembly 100.9 according to a tenth aspect. Like parts have like numbers and functions as the display assembly 100 shown in FIGS. 1 to 10 with decimal extension ".9" being added for like parts not previously having decimal extensions. Display assembly 100.9 is the same as described for display assembly 100 shown in FIGS. 1 to 10 with at least the following exceptions.

The elongate members 114.9, 198, and 200 have different distances of separation D.9', D.9" and D.9'" between their grooves 140.9 and 142.9, with D.9'_<D.9"<D.9'". These differing distances have the effect of spacing planar members further apart or closer together. Planar members are shaped to fit within respective ones of the grooves of a given one, or substantially identical pair, of the mounting members. Substitution of one of the mounting members for another of the mounting members enables the degree of the three-dimensional effect to be adjusted. Thus, substitution of mounting member 200 having adjacent said grooves for mounting member 114.9 having more spaced-apart said grooves enables the three-dimensional effect to be exaggerated. Alternatively, substitution of mounting member 198 having more spaced-apart said grooves for mounting member 200 having less spaced-apart said grooves enables the three-dimensional effect to be reduced.

Much as the focal length of a photographic lens can compress or extend the visual depth effect, the differing spacing of the planar members exaggerates or reduces the three-dimensional effect to the most pleasing visual effect. If the viewer is close to the display assembly, it may be preferred to space the planar member closer together. If the display assembly is further away from the viewer, the three-dimensional effect may need to be exaggerated to convey an equal three-dimensional visual effect. This adjustment of the three-dimensional visual effect is controlled by varying the planar member spacing as define by the pair of rail stand groves. The assemblies as herein described may thus comprise a kit with three choices of planar member spacing by way of providing three sets of rail stands of differing lengths, according to one example. The purpose of varying the spacing of the planar members is to allow an adjustment of the three-dimensional effect to best suit the pleasing visual effect according to the viewer.

Elongate member 114.9 includes an intermediate portion 199 between front portion 126.9 and rear portion 128.9. The intermediate portion is semi-obround in side profile in this example.

Figure 81:
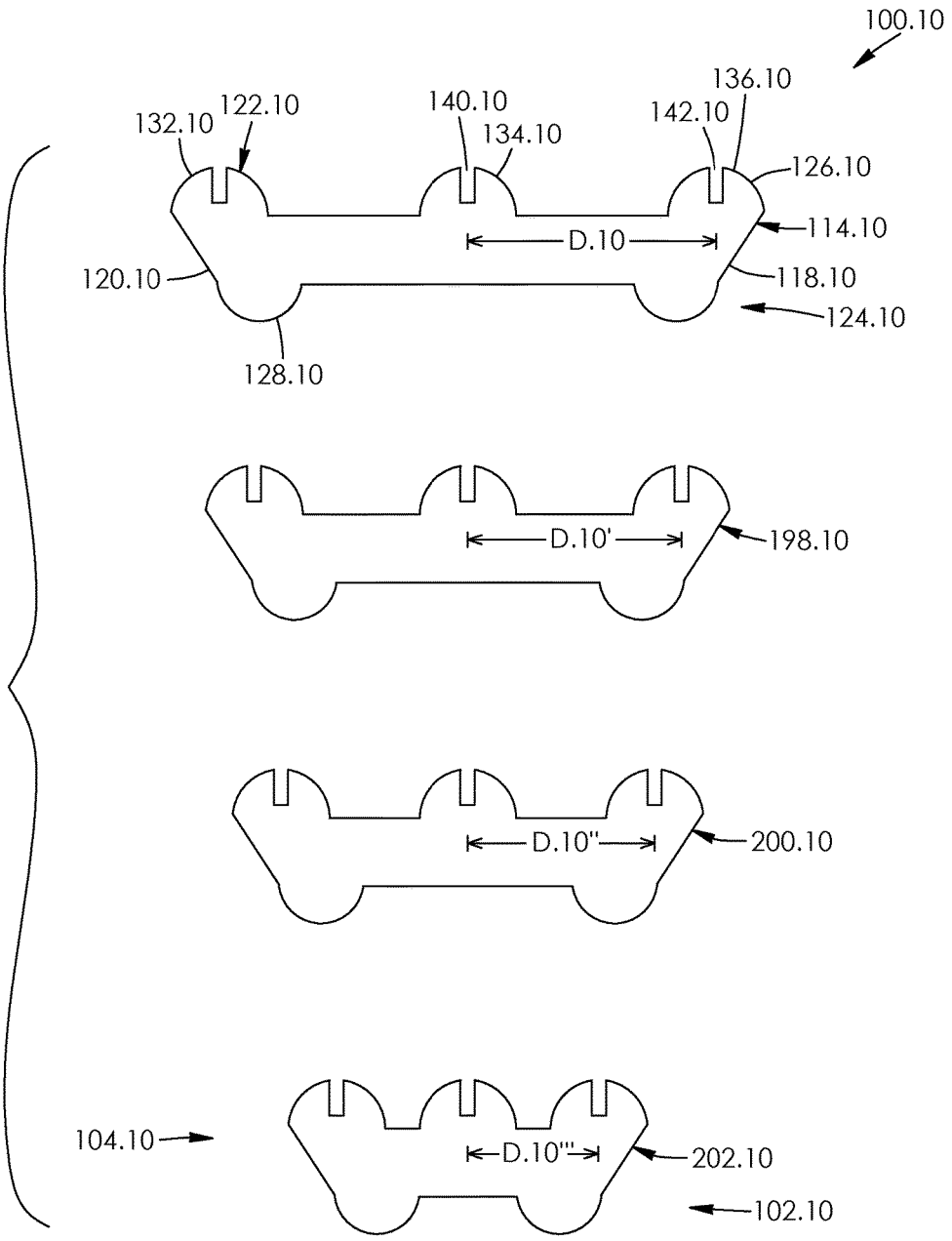
FIG. 81 is a side perspective view of a set of mounting members for a display assembly according to an eleventh aspect.

FIG. 81 shows a set of mounting members 114.10, 198.10, 200.10 and 202.10 for a display assembly 100.10 according to an eleventh aspect. Like parts have like numbers and functions as the display assembly 100.9 shown in FIG. 80 with decimal extension ".10" replacing decimal extension ".9 and being added for like parts not previously having decimal extensions. Display assembly 100.10 is the same as described for display assembly 100.9 shown in FIG. 80 with at least the following exceptions.

In this example, as the distance of separation D.10, D.10', D.10" and D.10'" between the grooves 140.10 and 142.10 of respective mounting members 114.10, 198.10, 200.10, and 202.10 decreases, the front portion 126.10 and rear portion 128.10 of a given mounting member extend more and more outwards relative to each other towards the front 102.10 and the rear 104.10 of the assembly 100.10, respectively, as the front and rear portions extend from the bottom 124.10 of the mounting member towards the top 122.10 of the mounting member.

Figure 82:
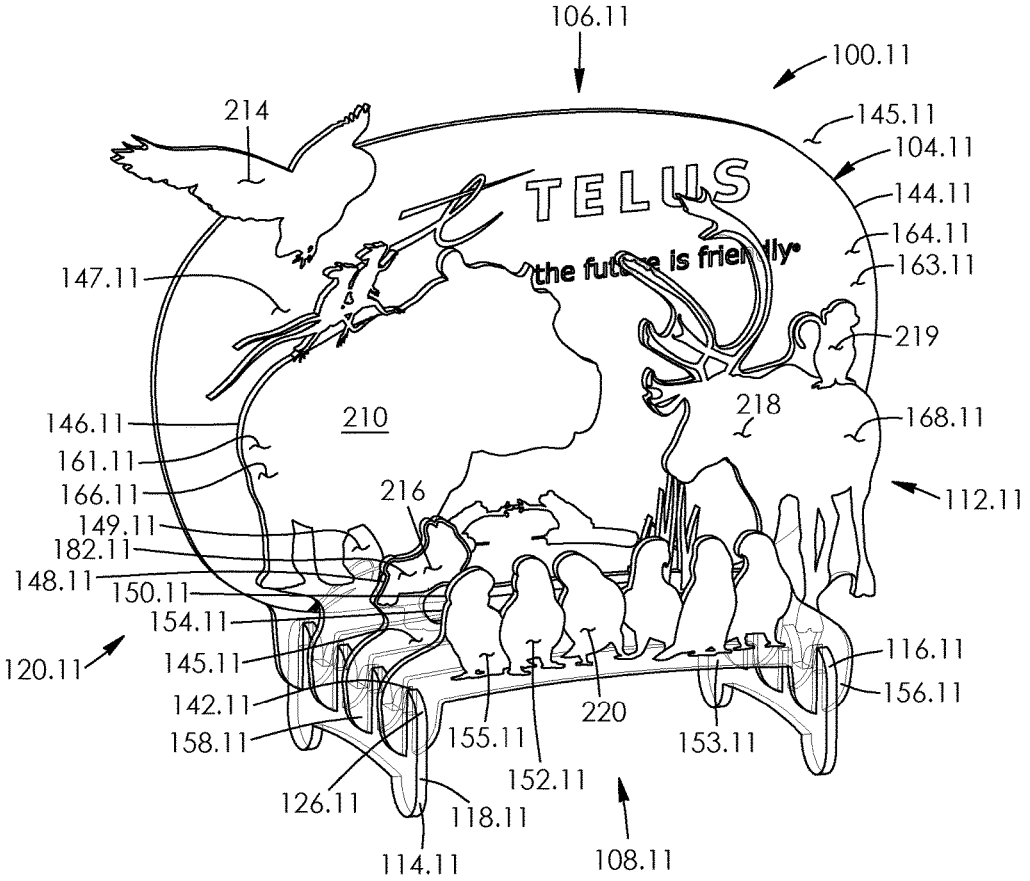
FIG. 82 is a front, right side perspective view of a display assembly according to a further aspect, the display assembly including a pair of mounting members, a rear planar member, a pair of intermediate planar members and a front planar member.

FIG. 82 shows a display assembly 100.11 according to a further aspect. Like parts have like numbers and functions as the display assembly 100.2 shown in FIGS. 20 to 30 with decimal extension ".11" replacing decimal extension ".2" and being added for like parts not previously having decimal extensions. Display assembly 100.11 is the same as described for display assembly 100.2 shown in FIGS. 20 to 30 with at least the following exceptions.

In this example, display assembly 100.11 conveys an advertisement for a third party company, in this example the Telus® Communications Company. The display assembly comprises five planar members in this example: rear planar member 144.11, a first intermediate planar member 146.11, a second intermediate planar member 148.11, and front planar member 150.11. Planar member 146.11 extends between planar members 144.11 and 148.11. Planar member 148.11 extends between planar members 146.11 and 150.11.

Rear planar member 144.11 has a front area that is generally oval-shaped, with the image indicia 163.11 thereof being primarily unitary in color and in this example white and including the wording TELUS THE FUTURE IS FRIENDLY. The front area of the rear planar member of assembly 100.11 is larger than the front areas of at least one of the other of the planar members and, in this example, is larger than the front areas of first intermediate planar member 146.11, second intermediate planar member 148.11, and front planar member 150.11.

Intermediate planar member 146.11 of assembly 100.11 is generally in the shape of a first set of animals, in this example a hippopotamus 210, a lizard 212 and an owl 214. Intermediate planar member 148.11 of assembly 100.11 is generally in the shape of a second set of animals, in this example a rabbit 216, caribou 218 and a monkey 219. The planar member 148.11 has more cut-out portions 149.11 in terms of front area relative to the cut-out portions 145.11 of rear planar member 144.11.

The image indicia 152.11 of the front planar member 150.11 of assembly 100.11 has the most cut-out portions 154.11 in terms of front area relative to the cut-out portions of the other planar members. The front planar member aligns with the bottom 108.11 of the assembly 100.11 and comprises a third set of animals, in this example parrots 220.

FIGS. 83 to 94 show a display assembly 100.12 according to another aspect. Like parts have like numbers and functions as the display assembly 100.2 shown in FIGS. 20 to 30 with decimal extension ".12" replacing decimal extension ".2" and being added for like parts not previously having decimal extensions. Display assembly 100.12 is the same as described for display assembly 100.2 shown in FIGS. 20 to 30 with at least the following exceptions.

In this example, display assembly 100.12 conveys a skyline for Calgary, which is a city located in Alberta, Canada. The display assembly comprises five planar members in this example: an upright rear planar member 144.12, an upright first intermediate planar member 146.12, an upright second intermediate planar member 148.12, an upright third intermediate planar member 180.12, and an angled front planar member 150.12. Planar member 146.12 extends between planar members 144.12 and 148.12. Planar member 148.12 extends between planar members 146.12 and 180.12. Planar member 180 extends between planar members 148.2 and 150.2.

Rear planar member 144.12 has a front area that is generally rectangular, with the image indicia 163.12 thereof comprising mountains, a Canada 150 flag, and the wording ILEA™ INTERNATIONAL LIVE EVENTS ASSOCIATION. The front area of the rear planar member of assembly 100.12 is larger than the front areas of at least one of the other of the planar members and, in this example, is larger than the front areas of first intermediate planar member 146.12, second intermediate planar member 148.12, third intermediate planar member 180.12, and front planar member 150.12.

Intermediate planar member 180.12 of assembly 100.12 is in the shape of the Peace Bridge and has more cut-out portions 181.12 in terms of front area relative to the cut-out portions 147.12 and 149.12 of intermediate planar member 146.12 and 148.12. Intermediate planar member 148.12 of assembly 100.12 is in the shape of a series of trees and the Saddledome sports and entertainment stadium. Intermediate planar member 146.12 of the assembly is in the shape of a series of skyscrapers and includes the Calgary Tower. Intermediate planar member 146.12 has a greater front area than planar member 148.12, which has a greater front area than planar member 180.12 in this example.

Front portions 126.12 of mounting members 114.12 and 116.12 are outwardly, forward-angled in this embodiment.

Figure 83:
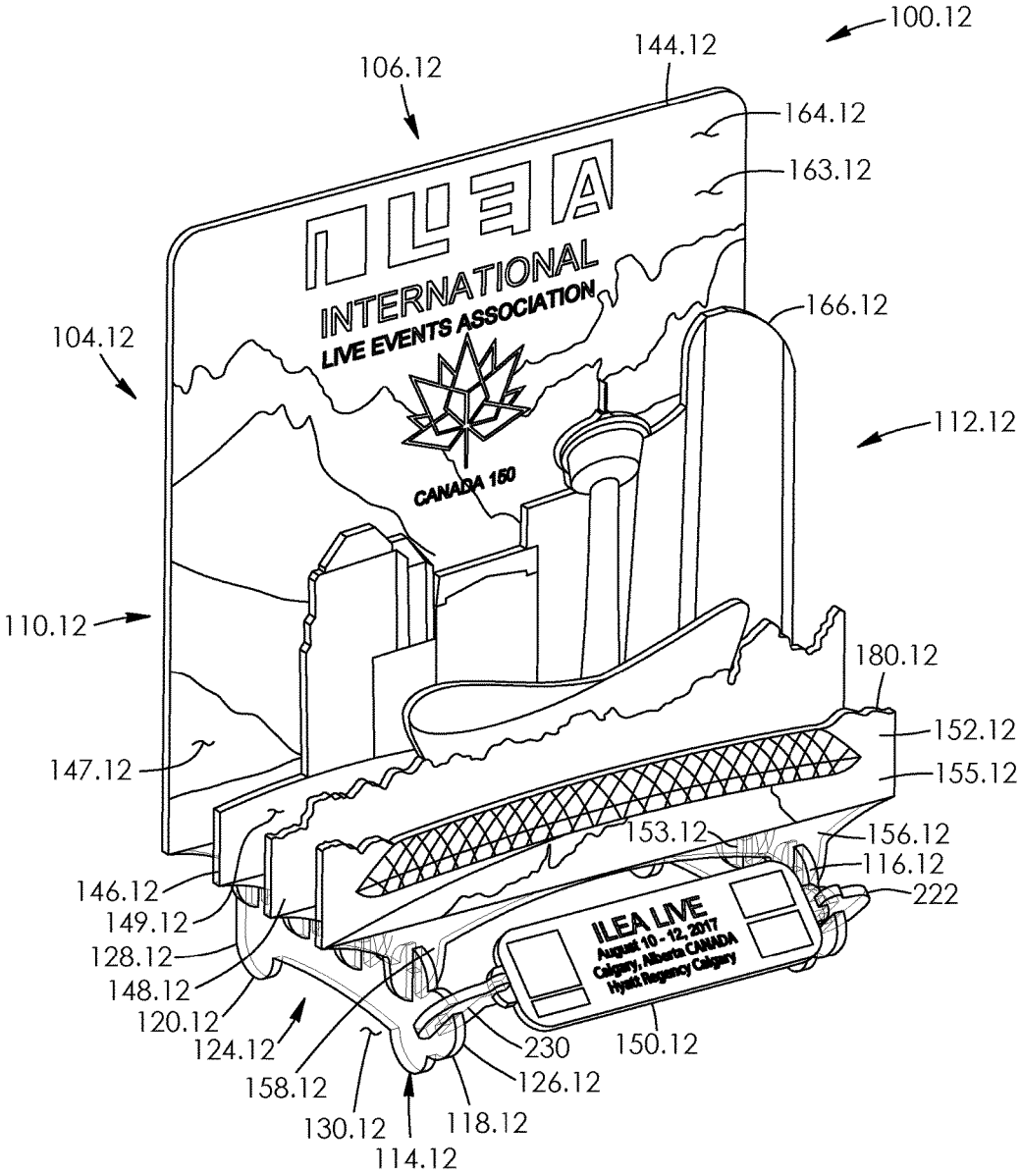
FIG. 83 is a front, left side perspective view of a display assembly according to yet another aspect, the display assembly including a pair of mounting members, a rear planar member, three intermediate planar members, and an angled front planar member.
Figure 84:
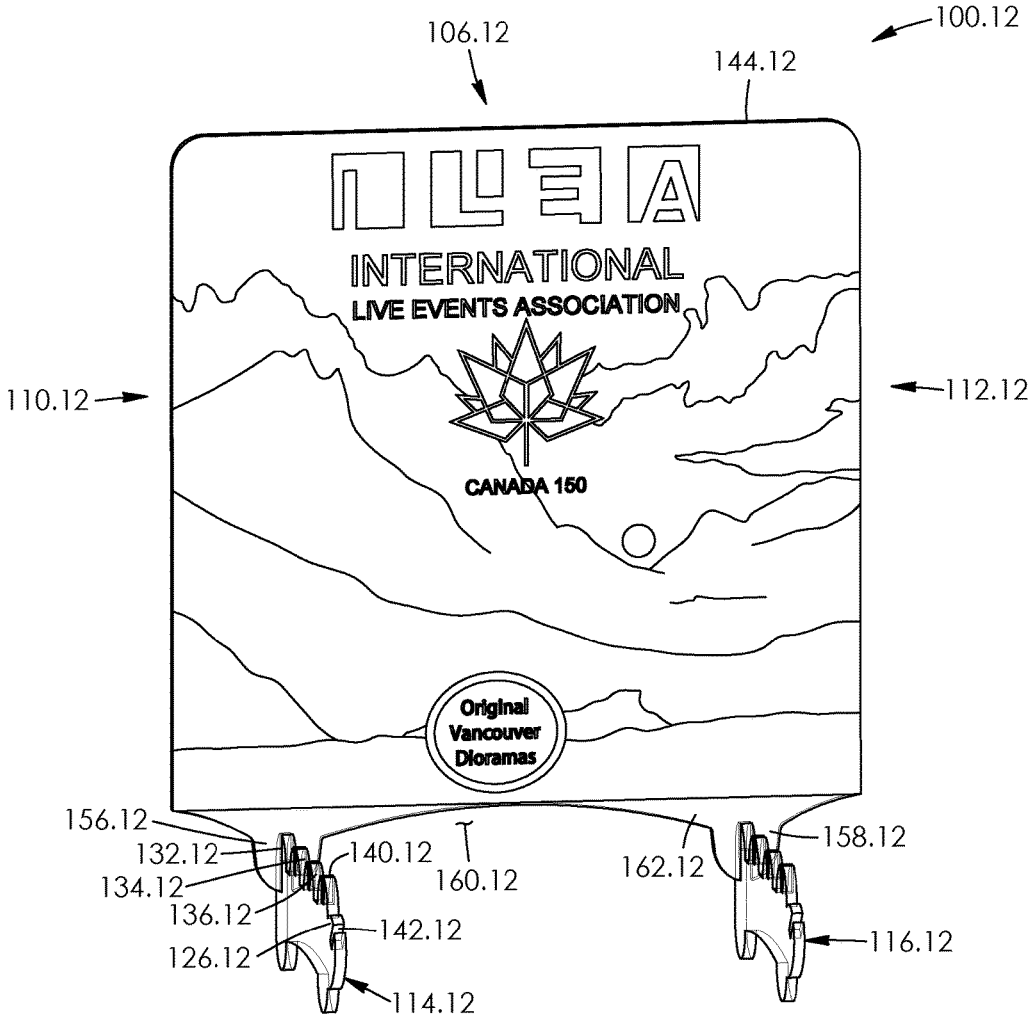
FIG. 84 is a front elevation view of the mounting members and the rear planar member of FIG. 83 mounted thereon.
Figure 85:
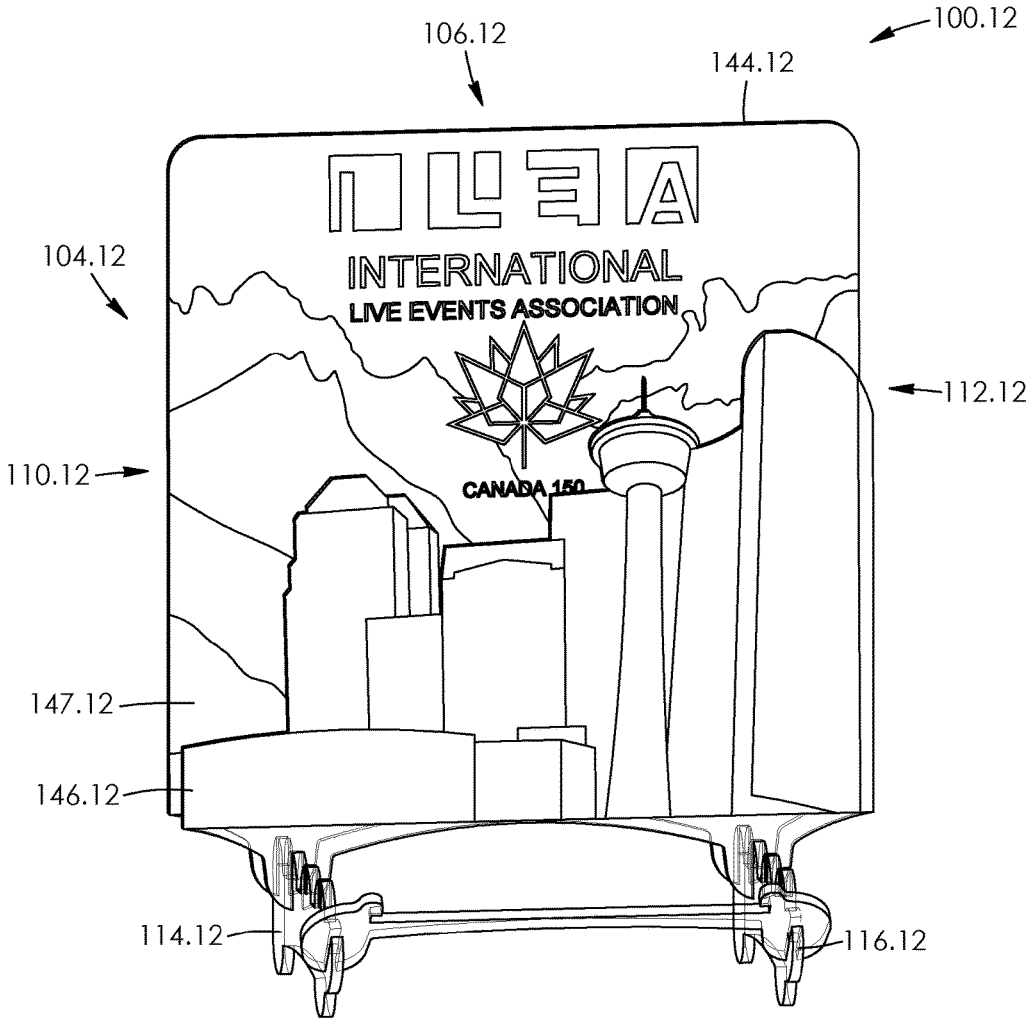
FIG. 85 is a front elevation view of the mounting members, and the rear planar member and a first of the intermediate planar members of FIG. 83 mounted thereon.
Figure 86:
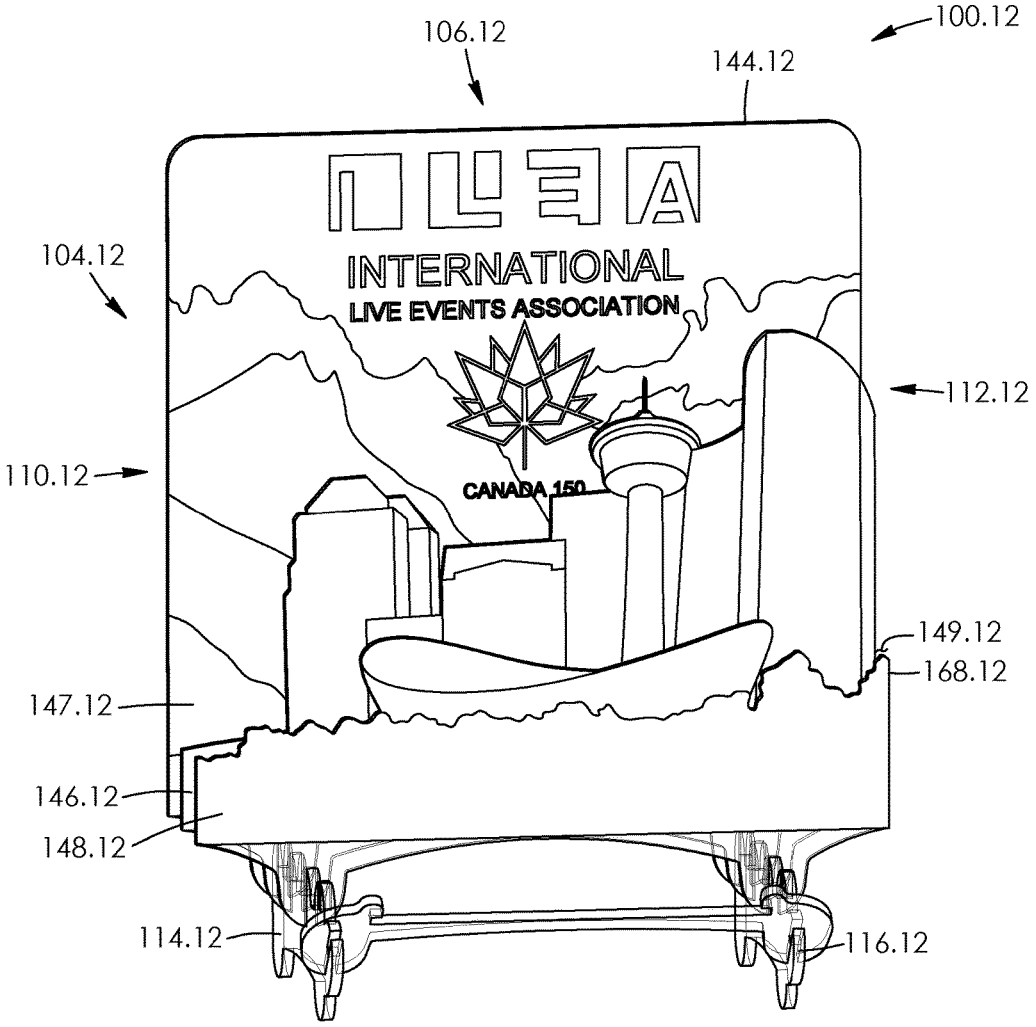
FIG. 86 is a front elevation view of the mounting members, and the rear planar member, and the first and a second of the intermediate planar members of FIG. 83 mounted thereon.
Figure 87:
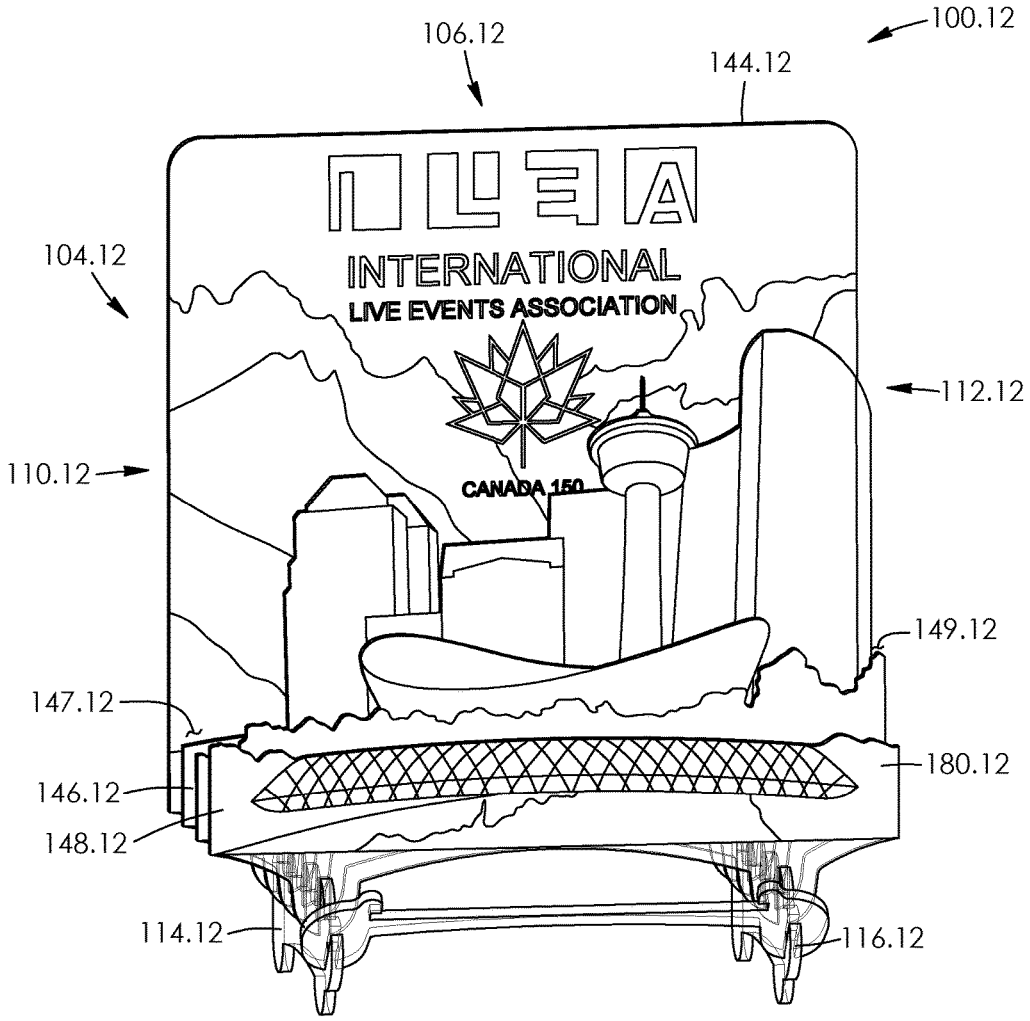
FIG. 87 is a front elevation view of the mounting members, and the rear planar member, and all three of the intermediate planar members of FIG. 83 mounted thereon.
Figure 90:
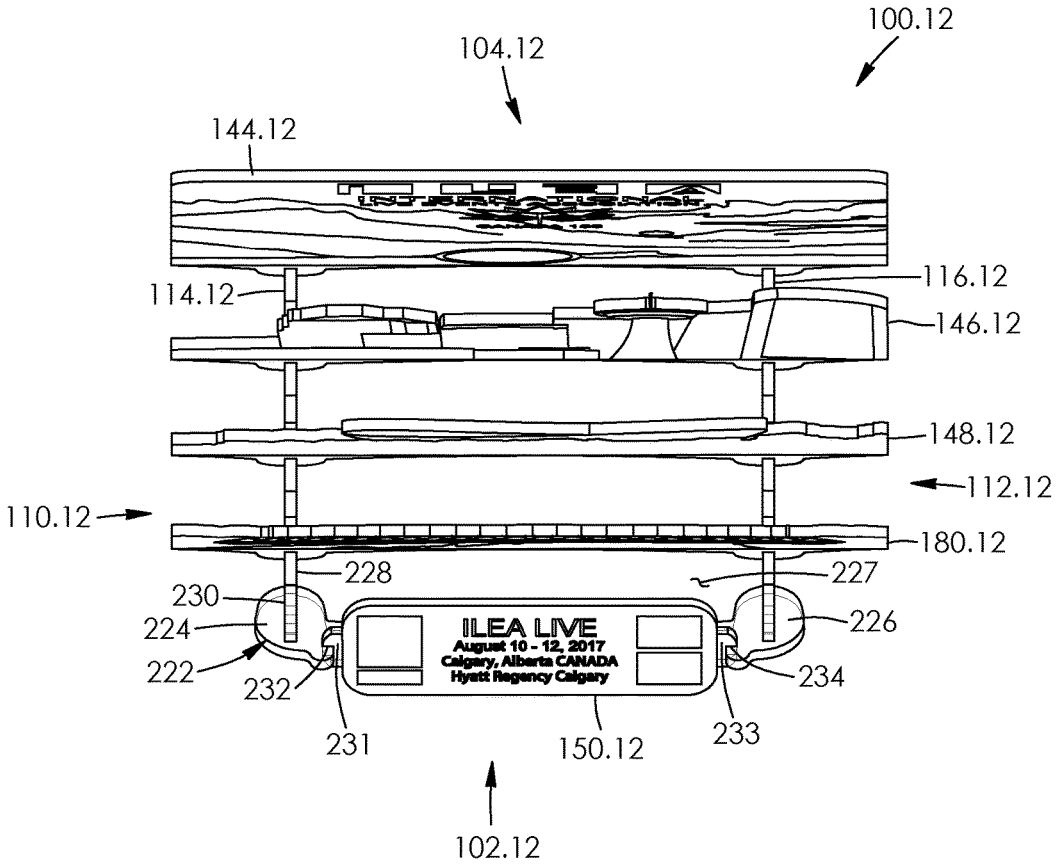
FIG. 90 is a top, front perspective view thereof.
Figure 91:
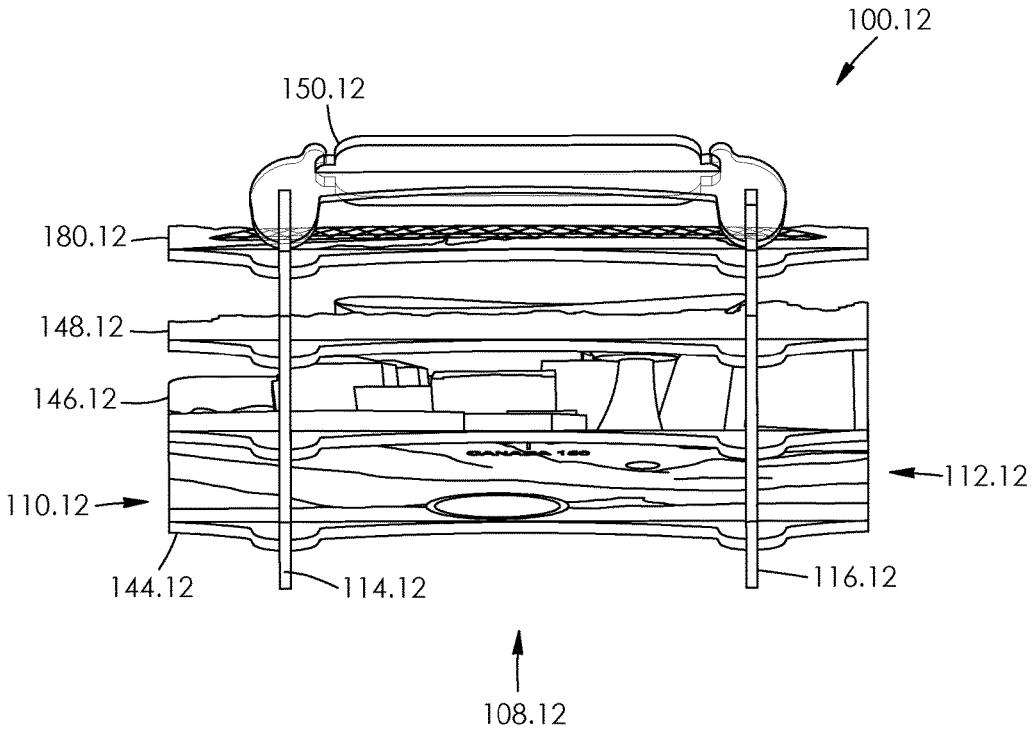
FIG. 91 is a bottom, front perspective view thereof.
Figure 92:
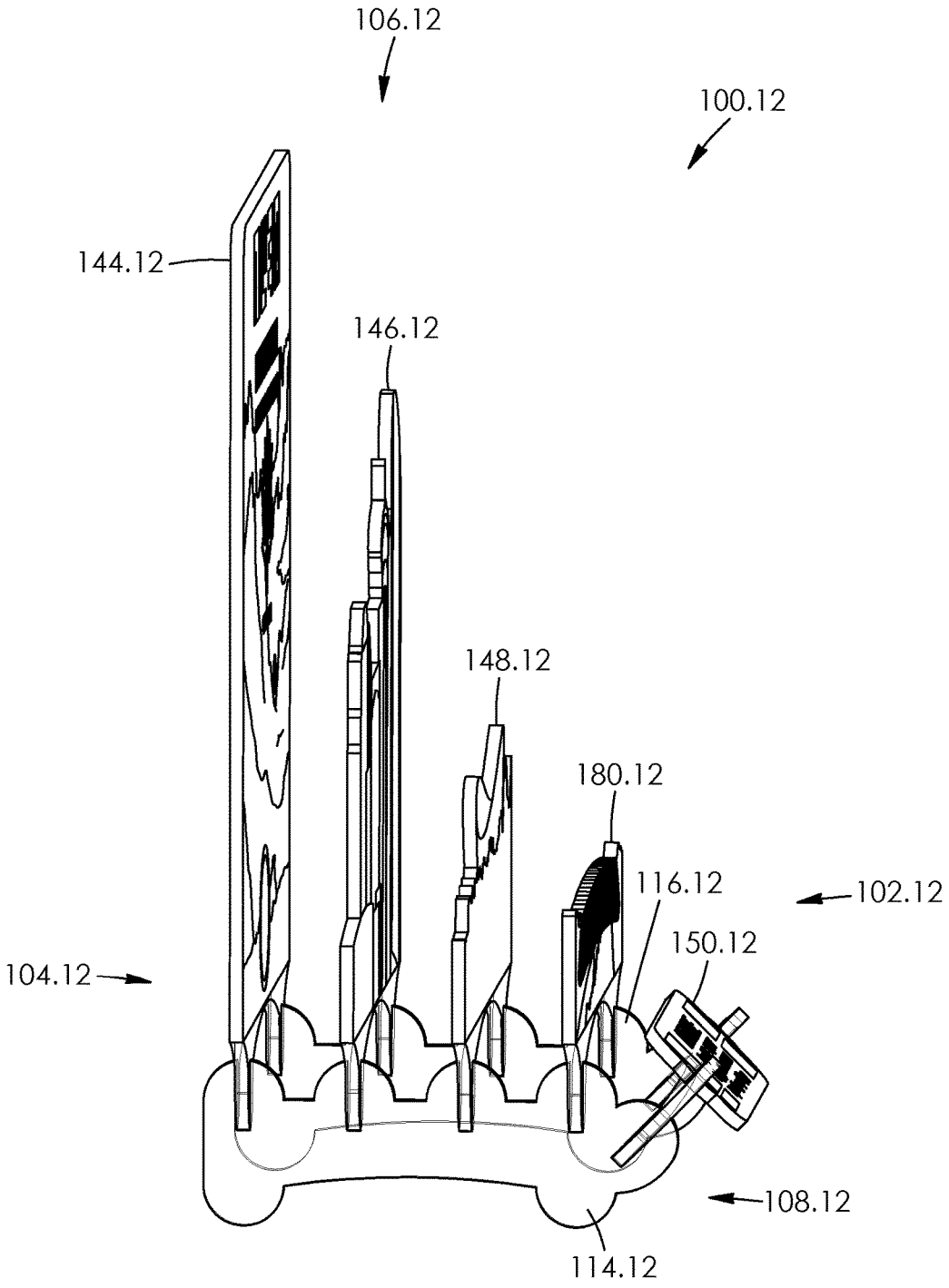
FIG. 92 is a left side elevation view thereof.
Figure 93:
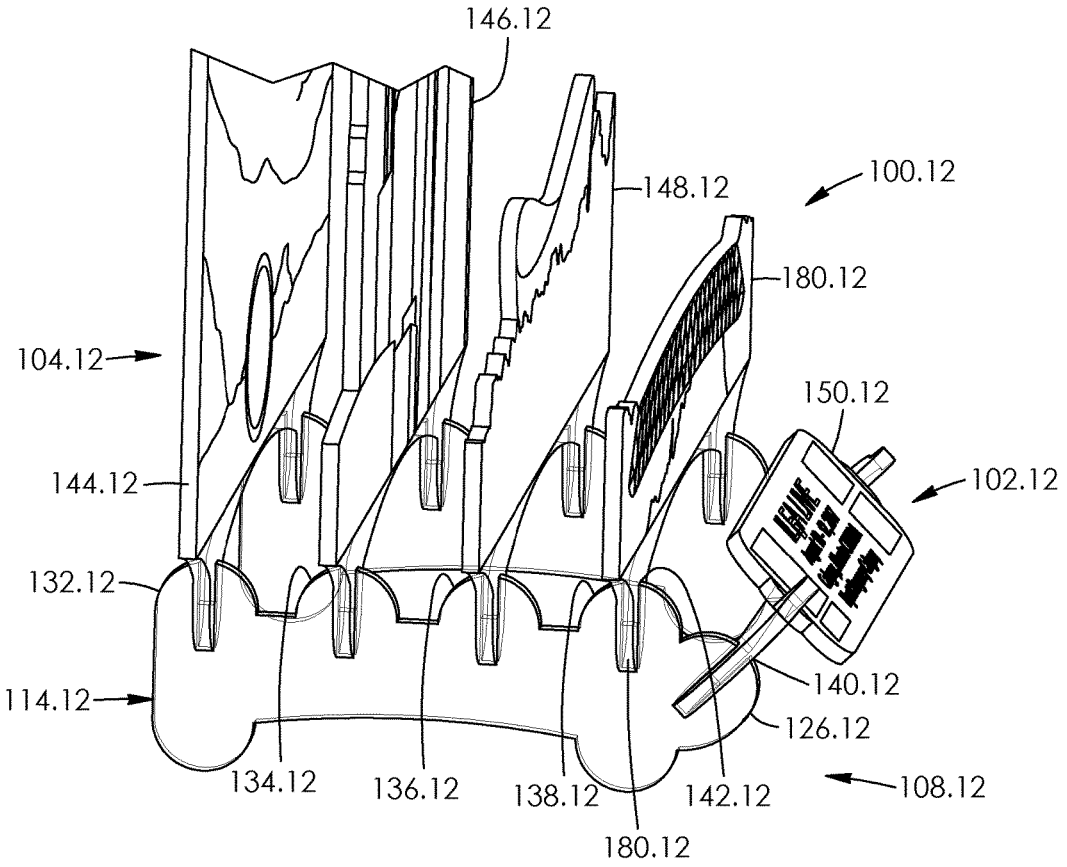
FIG. 93 is an enlarged, fragmented left side elevation view of a lower portion thereof.
Figure 94:
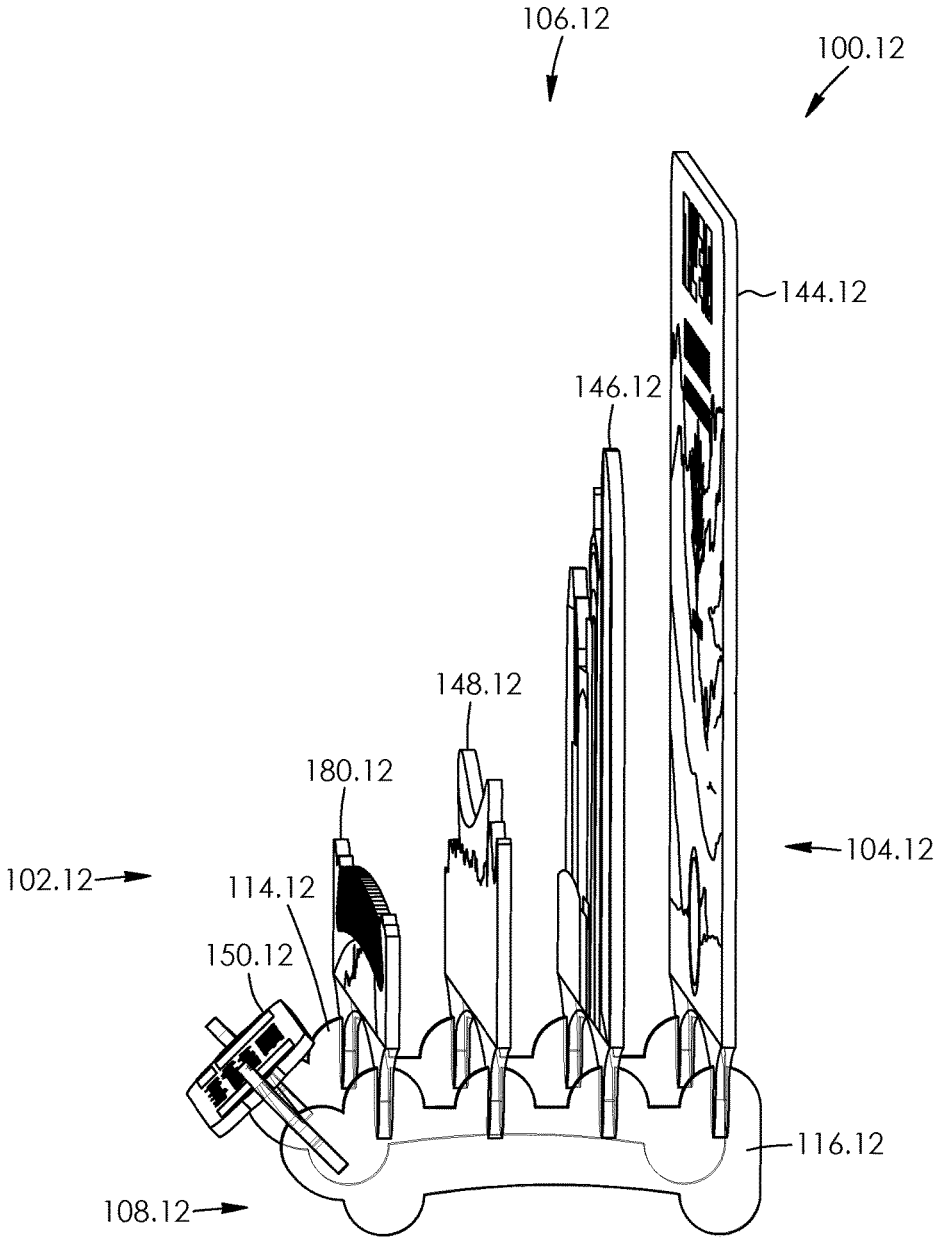
FIG. 94 is a right side elevation view thereof.

Assembly 100.12 includes a front mounting member 222 extending between the elongate mounting members 114.12 and 116.12. As seen in FIG. 90, the front mounting member includes a pair of spaced-apart enlarged portions 224 and 226 each of which has a groove 228 extending therewithin. The front mounting member 222 has a recessed region 227 between the enlarged portions 224 and 226 in this example. Grooves 228 are shaped to fit within grooves 230 of the elongate mounting members 114.12 and 116.12. As seen in FIG. 83, the front mounting member 222 is angled forward relative to the upright planar members 144.12, 146.12, 148.12 and 180.12.

Figure 88:
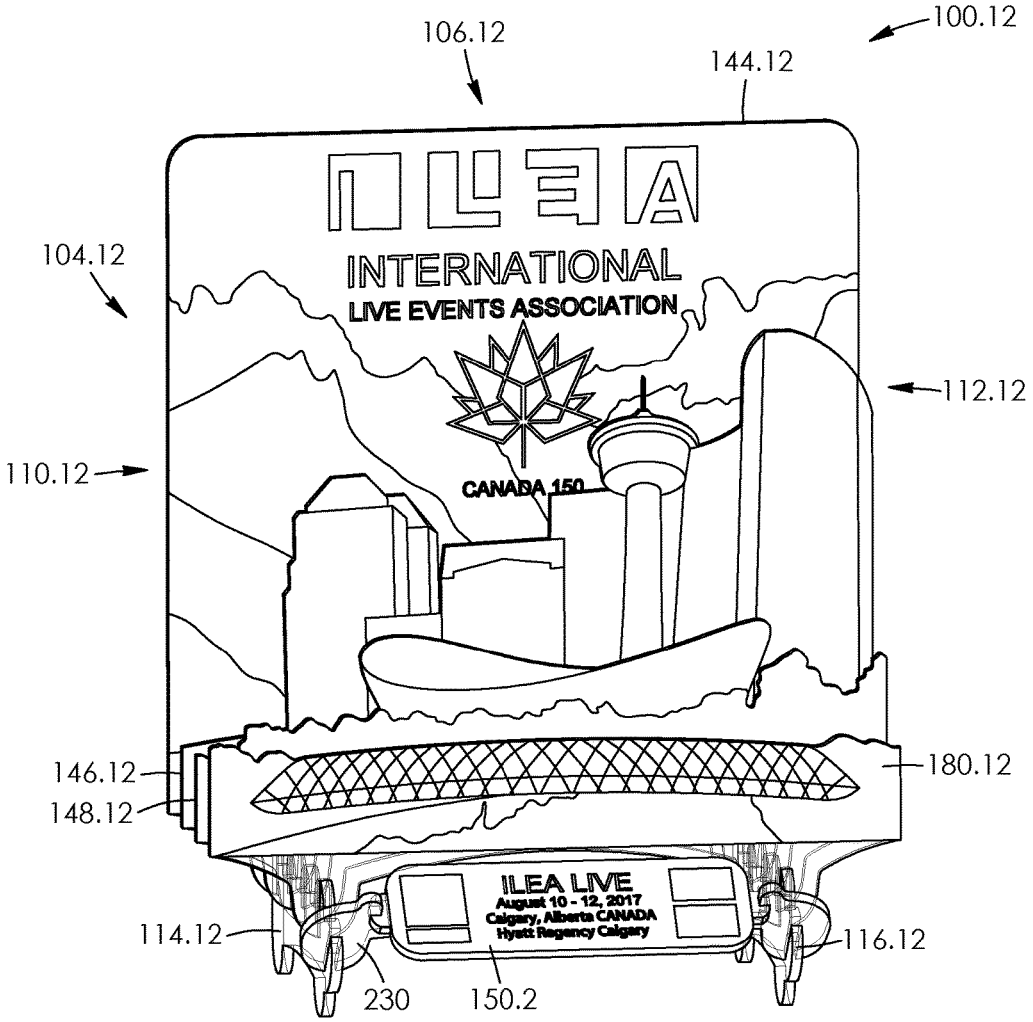
FIG. 88 is a front elevation view of the mounting members, and the rear planar member, all three of the intermediate planar members and the angled front planer member of FIG. 83 mounted thereon.
Figure 89:
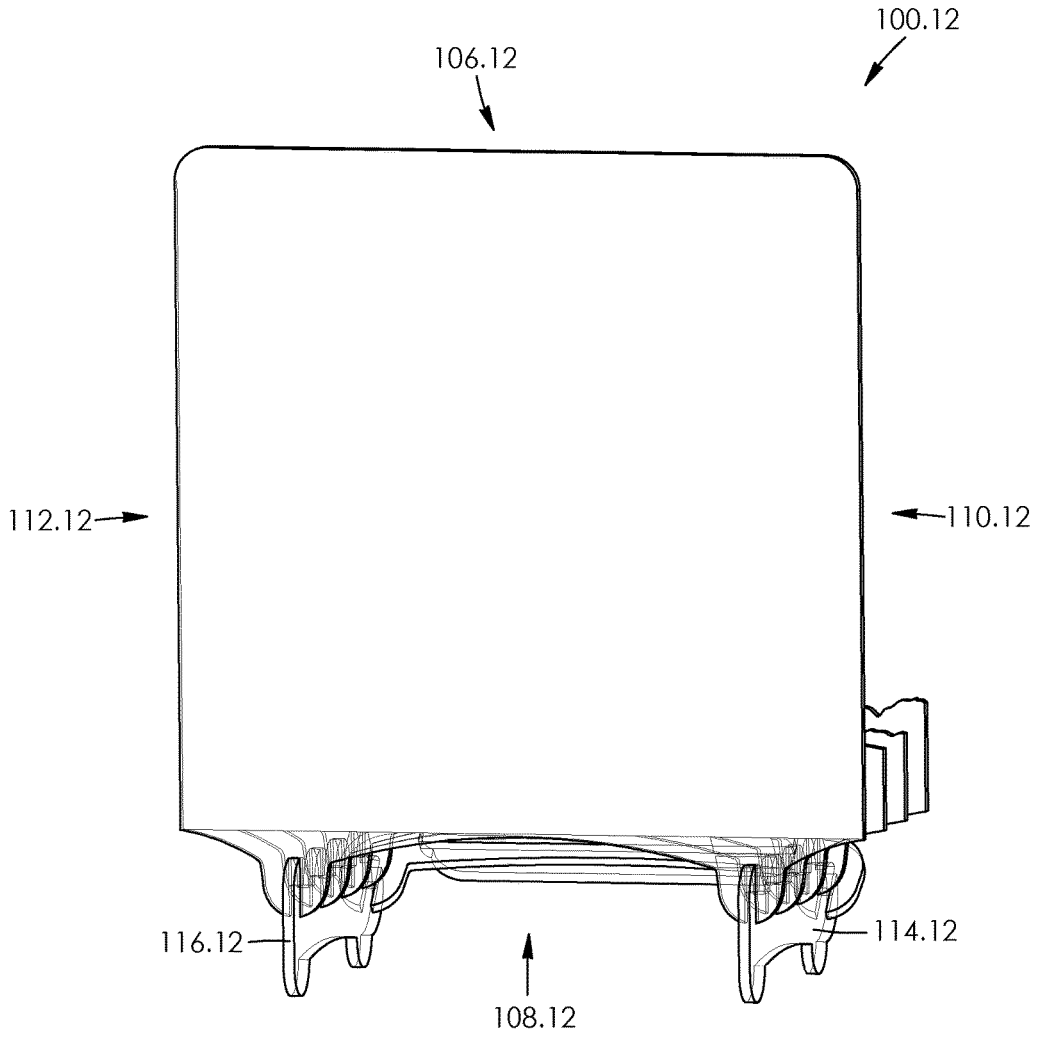
FIG. 89 is a rear elevation view of the assembly of FIG. 83.

Referring to FIG. 90, the front planar member 150.12 is shaped via outwardly-spaced protrusions 231 and 233 to selectively snap fit within facing brackets 232 and 234 of the front mounting member 222. As seen in FIG. 88, the front planar member is thus angled relative to the upright planar members 144.12, 146.12, 148.12 and 180.12. The front planar member 150.12 in this example may thus function as a name or display heading for the rest of the assembly 100.12.

The assemblies as herein described thus incorporate commonly-recognizable, two-dimensional images, such as flags, sports logos, cartoons and photos, and introduces a physical third dimension. From a two-dimensional image, image indicia or picture elements are separated into logical, depth-dependent layers and missing visual information is filled in behind each planar member or layer element, thereby enabling the viewer to look behind layers to see a complete scene on each successive layer. The two dimensional subject image is thus separated into layers as defined by logical depth cues. The most frontal picture object is isolated, and the reminder of the picture must be repaired so to speak. Then, the next top-most object is removed, and the remainder is repaired. This process is repeated until there are no objects left. The final object may constitute the rear-most layer, or the rear-most layer may be a "full frame" solid colour background on which the rest of the layers depend.

Each image layer may thus be applied onto its own custom-cut, clear, acrylic shape or planar member, then positioned, by interlocking mounting members or stand rails, a consistent distance from each other.

It will be appreciated that many variations are possible within the scope of the invention described herein. For example, the assemblies as herein described have related to and depicted flags, cartoon superheroes, sports logos, and wedding scenes. However, one skilled in the art will appreciate that this is not strictly required and that other themes and motives may be incorporated in other examples. For example, other embodiments of the assembly can includes incorporating house plants and other indoor greenery that may be adequately simulated using thin, plastic, vertical surfaces.

Further embodiments of the assembly may incorporate other superheroes, various comic-book characters, as well as famous movie scenes for example, which are inspiring especially for young people. Batman, Superman, Archie, The Simpsons, The Wizard of Oz and E.T. the Extra-Terrestrial have attracted children and adults alike for decades, for example. One skilled in the art will appreciate that there are many, many embodiments that may be incorporated to convey such cultural icons and the like.

The assemblies so shaped and as herein described, with their various vertically-extending mounting members and vertically-extending planar members may inhibit the need for dusting of the same for many months due to their minimal horizontal surfaces.

The number of planar members per display assembly may range from two to at least six.

It will also be understood by someone skilled in the art that many of the details provided above are by way of example only and are not intended to limit the scope of the invention which is to be determined with reference to at least the following claims.

What is claimed is:

1. A display assembly comprising: a pair of spaced-apart elongate discrete mounting members, each having a top, a bottom spaced-apart from the top thereof, and a plurality of spaced-apart grooves extending from the top to the bottom thereof; and a plurality of planar members, each being transparent at least in part and including image indicia thereon, the planar members being shaped to fit within respective ones of said grooves of the elongate mounting members, whereby the image indicia so arranged conveys a three-dimensional effect.

2. The assembly as claimed in claim 1, wherein the assembly has a front and a rear spaced-apart from the front thereof, wherein the plurality of planar members includes a rear said planar member aligned with the rear of the assembly, at least one intermediate said planar member, and a front said planar member aligned with the front of the assembly, and wherein the image indicia of the front said planar member is centrally located.

3. The assembly as claimed in claim 1, wherein the assembly has a front and a rear spaced-apart from the front thereof, wherein each of the planar members has a front area, wherein the plurality of planar members includes a rear said planar member aligned with the rear of the assembly, at least one intermediate said planar member, and a front said planar member aligned with the front of the assembly, and wherein the front area of one of the rear said planar member, the intermediate said planar member and the front said planar member is larger than at least one of the front areas of the other of said planar members.

4. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the rear said planar member having at least a portion thereof which extends outwards beyond the intermediate said planar member and beyond the front said planar member when viewed from the front of the assembly, and the intermediate said planar member having at least a portion thereof which extends outwards beyond the front said planar member when viewed from the front of the assembly.

5. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the image indicia of one of the rear said planar member being most conspicuous and having a larger front area when viewed from the front of the assembly compared to the image indicia of the front said planar member and compared to the image indicia of the intermediate said planar member.

6. The assembly as claimed in claim 1, wherein the assembly has a front and a rear spaced-apart from the front thereof, wherein each of the planar members has a front area, and wherein the plurality of planar members includes a rear said planar member adjacent to the rear of the assembly, a front said planar member adjacent to the front of the assembly, and an intermediate said planar member between the rear and the front of the assembly, the front area of the rear said planar member being larger than the front area of the intermediate said planar member, and the front area of the intermediate said planar member being larger than the front area of the front said planar member.

7. The assembly as claimed in claim 1, wherein the assembly has a front and a rear spaced-apart from the front thereof, and wherein the plurality of planar members includes a rear said planar member adjacent to the rear of the assembly, the rear said planar member having a front area that is a two-dimensional geometric shape.

8. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the front said planar member having more cut-out portions relative to the rear said planar member.

9. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the front said planar member having more cut-out portions relative to the intermediate said planar member, and the intermediate said planar member having more cut-out portions relative to the rear said planar member.

10. The assembly as claimed in claim 1 wherein each of the planar members has a peripheral portion, the peripheral portions of the planar members being at least partially transparent.

11. The assembly as claimed in claim 1 wherein at least one of the mounting members is generally arc-shaped in side profile.

12. The assembly as claimed in claim 1 wherein the assembly has a vertically-extending central axis and wherein each of the planar members is symmetrical about said axis.

13. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the image indicia of the front said planar member being most conspicuous and having a larger front area when viewed from the front of the assembly compared to the image indicia of the rear said planar member and compared to the image indicia of the intermediate said planar member.

14. The assembly as claimed in claim 1, wherein the assembly has a front and a rear spaced-apart from the front thereof, and wherein the plurality of planar members includes a rear said planar member adjacent to the rear of the assembly, a front said planar member adjacent to the front of the assembly, and an intermediate said planar member between the rear and the front of the assembly, the image indicia of the intermediate said planar member being most conspicuous and having a larger front area when viewed from the front of the assembly compared to the image indicia of the front said planar member and compared to the image indicia of the rear said planar member.

15. The assembly as claimed in claim 1, wherein the assembly has a front and a rear spaced-apart from the front thereof, wherein the plurality of planar members includes a rear said planar member aligned with the rear of the assembly, at least one intermediate said planar member, and a front said planar member aligned with the front of the assembly, wherein the rear said planar member and the at least one said intermediate planar member are upright, and wherein the front said planar member is angled relative to the rear said planar member and the at least one intermediate said planar member.

16. The assembly as claimed in claim 1, wherein said image indicia is separated into depth-dependent layers and missing visual information is filled in behind successive said planar members, thereby enabling one to see a complete scene on each successive said layer.

17. The assembly as claimed in claim 1, wherein the planar members are made of clear sheet.

18. The assembly as claimed in claim 1, wherein each said mounting member is made of clear sheet.

19. A display assembly comprising:

a pair of elongate mounting members, each having a top, a bottom spaced-apart from the top thereof, a front, a rear opposite the front thereof, and a centrally positioned recessed region extending between the front and the rear thereof and from the bottom towards the top thereof, and each including a plurality of longitudinally spaced-apart protrusions, the protrusions being obround in side profile, each of the protrusions extending from the top of its respective one of the mounting members towards the bottom of its respective one of the mounting members, and each of the mounting members having a plurality of spaced-apart grooves extending from the top to the bottom thereof, the grooves being centrally located within respective ones of said protrusions; and a plurality of planar members comprising a rear said planar member, at least one intermediate said planar member, and a front said planar member, each of which including image indicia thereon, the image indicia of the front said planar member being centrally located, the planar members being shaped to fit within respective ones of said grooves, and the image indicia so arranged conveys a three-dimensional effect thereby.

20. A display assembly comprising:

a set of elongate mounting members, each having a top, a bottom spaced-apart from the top thereof, a front, a rear opposite the front thereof, a plurality of evenly spaced-apart grooves extending from the top to the bottom thereof, and a distance of separation between respective ones of the grooves, each of the elongate members having a different said distance of separation between its grooves; and a plurality of planar members, each including image indicia thereon, the planar members being shaped to fit within respective ones of said grooves of a given one of the mounting members, the image indicia so arranged conveying a three-dimensional effect thereby, whereby substitution of one of the mounting members for another of the mounting members enables the degree of the three-dimensional effect to be adjusted.

21. The assembly as claimed in claim 20, wherein substitution of one of the mounting members having adjacent said grooves for another of said mounting members having more spaced-apart said grooves enables the three-dimensional effect to be exaggerated.

22. A display assembly comprising:

a pair of elongate mounting members, each having a top, a bottom spaced-apart from the top thereof, and a plurality of spaced-apart grooves extending from the top to the bottom thereof;

a plurality of upright planar members, each including image indicia thereon, the upright planar members being shaped to fit within respective ones of said grooves;

a front mounting member extending between the elongate mounting members, being shaped to fit within a forward pair of said grooves, and angling forward relative to the upright planar members; and a front planar member shaped to selectively couple with the front mounting member.

23. The assembly as claimed in claim 20, wherein substitution of one of the mounting members having more spaced-apart said grooves for another of said mounting members having less spaced-apart said grooves enables the three-dimensional effect to be reduced.

24. The assembly as claimed in claim 1 wherein the planar members extend between the elongate mounting members, wherein each said groove of a first of the mounting members aligns with a respective said groove of a second of the mounting members, and wherein each said planar member is shaped to fit within a respective pair of said grooves so aligned.

* * * * *